United States Patent [19]

Kato et al.

[11] Patent Number: 5,063,130

[45] Date of Patent: Nov. 5, 1991

[54] ELECTROPHOTOGRAPHIC LIGHT-SENSITIVE MATERIAL

[75] Inventors: Eiichi Kato; Kazuo Ishii, both of Shizuoka, Japan

[73] Assignee: Fuji Photo Film Co., Ltd., Kanagawa, Japan

[21] Appl. No.: 491,018

[22] Filed: Mar. 9, 1990

[30] Foreign Application Priority Data

| | | | |
|---|---|---|---|
| Mar. 10, 1989 | [JP] | Japan | 1-56379 |
| Mar. 10, 1989 | [JP] | Japan | 1-58989 |
| Apr. 7, 1989 | [JP] | Japan | 1-86939 |
| Apr. 14, 1989 | [JP] | Japan | 1-93142 |

[51] Int. Cl.[5] ..... G03G 5/05

[52] U.S. Cl. ..... 439/96

[58] Field of Search ..... 430/114, 115, 96, 49

[56] References Cited

U.S. PATENT DOCUMENTS

| | | | |
|---|---|---|---|
| 4,840,865 | 6/1989 | Kato et al. | 430/114 |
| 4,971,871 | 11/1990 | Kato et al. | 430/96 |

*Primary Examiner*—John Goodrow

*Attorney, Agent, or Firm*—Sughrue, Mion, Zinn Macpeak & Seas

[57] ABSTRACT

An electrophotographic light-sensitive material is disclosed. The light-sensitive material comprises an electroconductive support having formed thereon a photoconductive layer containing at least inorganic photoconductive particles and a binder resin, wherein the binder resin containing a copolymer having at least one of polyester type macromonomers having a weight average molecular weight of from $1\times10^3$ to $1.5\times10^4$ represented by the formulae (I), (II), (III), and (IV) as defined in the specification. The electrophotographic light-sensitive material according to the present invention has excellent electrostatic characteristics, moisture resistance and durability.

9 Claims, No Drawings

ELECTROPHOTOGRAPHIC LIGHT-SENSITIVE MATERIAL

FIELD OF THE INVENTION

This invention relates to an electrophotographic light-sensitive material, and more particularly to an electrophotographic light-sensitive material having excellent electrostatic characteristics, moisture resistance, and durability.

BACKGROUND OF THE INVENTION

An electrophotographic light-sensitive material may have various structures depending upon the characteristics required or an electrophotographic process being employed.

An electrophotographic system in which the light-sensitive material comprises a support having thereon at least one photoconductive layer and, if necessary, an insulating layer on the surface thereof is widely employed. The electrophotographic light-sensitive material comprising a support and at least one photoconductive layer formed thereon is used for the image formation by an ordinary electrophotographic process including electrostatic charging, imagewise exposure, development, and, if necessary, transfer.

Furthermore, a process of using an electrophotographic light-sensitive material as an offset master plate for direct plate making is widely practiced.

A binder which is used for forming the photoconductive layer of an electrophotographic light-sensitive material is required to be excellent in the film-forming property by itself and the capability of dispersing therein a photoconductive powder as well as the photoconductive layer formed using the binder is required to have satisfactory adhesion to a base material or support. Also, the photoconductive layer formed by using the binder is required to have various charging capacity, less dark decay, large light decay, and less fatigue before light-exposure and also have an excellent photographing property that the photoconductive layer stably maintains these electrostatic properties to the change of humidity at photographing.

Binder resins which have conventionally used include silicone resins (e.g., JP-B-34-6670, the term "JP-B" as used herein means an "examined published Japanese patent publication"), styrene-butadiene resins (e.g., JP-B-35-1960), alkyd resins, maleic acid resins, polyamides (e.g., JP-B-35-11219), polyvinyl acetate resins (e.g., JP-B-41-2425), vinyl acetate copolymers (e.g., JP-B-41-2426), acrylic resins (JP-B-35-11216), acrylic acid ester copolymers (e.g., JP-B-35-11219, JP-B-36-8510, and JP-B-41-13946), etc.

However, in the electrophotographic light-sensitive materials using these binder resins, there are various problems such as 1) the affinity of the binder with photoconductive powders is poor thereby reducing the dispersibility of the coating composition containing them, 2) the charging property of the photoconductive layer containing the binder is low, 3) the quality (in particular, the dot image reproducibility and resolving power) of the imaged portions of copied images is poor, 4) the image quality is liable to be influenced by the surrounding conditions (e.g., high temperature and high humidity or low temperature and low humidity) at the formation of copies, and 5) the photoconductive layer is insufficient in film strength and adhesion, which causes, when the light-sensitive material is used for an offset master, peeling off of the photoconductive layer, etc. at offset printing to reduce the number of prints.

For improving the electrostatic characteristics of a photoconductive layer, various approaches have hitherto been taken. For example, incorporation of a compound having an aromatic ring or a furan ring containing a carboxy group or a nitro group either alone or in combination with a dicarboxylic anhydride in a photoconductive layer is disclosed in JP-B-42-6878 and JP-B-45-3073. However, the thus improved electrophotographic light-sensitive materials are yet insufficient in electrostatic characteristics and, in particular light-sensitive materials having excellent light decay characteristics have not yet been obtained. Thus, for compensating the insufficient sensitivity of these light-sensitive materials, an attempt to incorporate a large amount of a sensitizing dye in the photoconductive layer has been made. However, light-sensitive materials containing a large amount of a sensitizing dye undergo considerable deterioration of whiteness to reduce the quality as a recording medium, sometimes causing deterioration in dark decay characteristics, thereby satisfactory reproduced images are not obtained.

On the other hand, JP-A-60-10254 (the term "JP-A" as used herein means an "unexamined published Japanese patent application") discloses a method of using a binder resin for a photoconductive layer by controlling the average molecular weight of the resin. That is, JP-A-60-10254 discloses a technique of improving the electrostatic characteristics (in particular, reproducibility at repeated use as a PPC light-sensitive material), humidity resistance, etc., of the photoconductive layer by using an acrylic resin having an acid value of from 4 to 50 and an average molecular weight of from $1\times10^3$ to $1\times10^4$ and the acrylic resin having an average molecular weight of from $1\times10^4$ to $2\times10^5$.

Furthermore, lithographic printing master plates using electrophotographic light-sensitive materials have been extensively investigated and, as binder resins for a photoconductive layer having both the eletrostatic characteristics as an electrophotographic light-sensitive material and the printing characteristics as a printing master plate, there are, for example, a combination of a resin having a molecular weight of from $1.8\times10^4$ to $10\times10^4$ and a glass transition point (Tg) of from 10° to 80° C. obtained by copolymerizing a (meth)acrylate monomer and other monomer in the presence of fumaric acid and a copolymer composed of a (meth)acrylate monomer and a copolymerizable monomer other than fumaric acid as disclosed in JP-B-50-31011, a terpolymer containing a (meth)acrylic acid ester unit with a substituent having a carboxylic acid group at least 7 atoms apart from the ester linkage as disclosed in JP-A-53-54027, a tetra- or pentapolymer containing an acrylic acid unit and a hydroxyethyl (meth)acrylate unit as disclosed in JP-A-54-20735 and JP-A-57-202544, and a terpolymer containing a (meth)acrylic ester unit with an alkyl group having from 6 to 12 carbon atoms as a substituent and a vinyl monomer containing a carboxyl group as disclosed in JP-A-58-68046.

However, none of these resins proposed have proved to be satisfactory for practical use in charging property, dark charge retention, electrostatic characteristics for photosensitivity, and the surface smoothness of the photoconductive layer.

Also, the practical evaluations on conventional binder resins which are said to be developed for electrophotographic lithographic master plates have found that they have problems in the aforesaid electrostatic characteristics, background staining of prints, etc.

For solving these problems, JP-A-63-217354 describes that the smoothness and the electrostatic characteristics of a photoconductive layer can be improved and images having no background staining are obtained by using a low-molecular weight resin (molecular weight of from 1,000 to 10,000) containing from 0.05 to 10% by weight a copolymer component having an acid group at the side chain of the copolymer as the binder resin, and also Japanese Patent Application 63-49817 and JP-A-63-220148 and JP-A-63-220149 described that the film strength of a photoconductive layer can be sufficiently increased to improve the printing impression without reducing the aforesaid characteristics by using the aforesaid low-molecular resin in a combination with a high-molecular resin (molecular weight of 10,000 or more).

However, it has been found that even in the case of using these resins, it is yet insufficient to keep the stable performance in the case of greatly changing the environmetal conditions from high-temperature and high-humidity to a low-temperature and low-humidity. In particular, in a scanning exposure system using a semiconductor laser light, the exposure time becomes longer and also there is a restriction on the exposure intensity as compared to a conventional overall simultaneous exposure system using a visible light, and hence a higher performance has been required for the electrostatic characteristics, in particular, the dark charge retention characteristics and photosensitivity.

SUMMARY OF THE INVENTION

The invention has been made for solving the problems of conventional electrophotographic light-sensitive materials as described above and meeting the requirement for the light-sensitive materials.

An object of this invention is to provide an electrophotographic light-sensitive material having stable and excellent electrostatic characteristics and giving clear good images even when the environmental conditions during the formation of duplicated images are changed to a low-temperature and low-humidity or to high-temperature and high-humidity.

Another object of this invention is to provide a CPC electrophotographic light-sensitive material having excellent electrostatic characteristics and showing less environmental reliance.

A further object of this invention is to provide an electrophotographic light-sensitive material effective for a scanning exposure system using a semiconductor laser beam.

A still further object of this invention is to provide an electrophotographic lithographic printing master plate having excellent electrostatic characteristics (in particular, dark charge retention and photosensitivity), capable of reproducing faithful duplicated images to original, forming neither overall background stains nor doted background stains of prints, and showing excellent printing durability.

It has now been discovered that the above and other objects can be attained by the present invention as described hereinbelow.

That is, the present invention relates to an electrophotographic light-sensitive material comprising a support having provided thereon a photoconductive layer containing at least inorganic photoconductive particles and a binder resin, wherein the binder resin comprises a copolymer containing at least one of polyester type macromonomers having a weight average molecular weight of from about $1\times10^3$ to about $1.5\times10^4$ and represented by the following formulae (I), (II), (III), and (IV) as the polymer component;

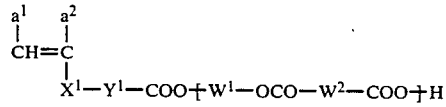

(I)

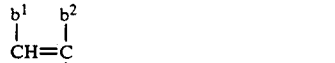

(II)

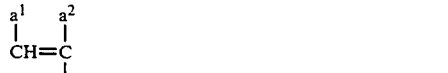

(III)

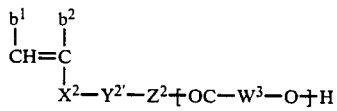

(IV)

wherein the group in the bracket represents a recurring unit; $a^1$ and $a^2$, which may be the same or different, each represents a hydrogen atom, a halogen atom, a cyano group, a hydrocarbon group having from 1 to 8 carbon atoms, —COO—Z, or —COO—Z bonded through a hydrocarbon group having from 1 to 8 carbon atoms (wherein Z represents a hydrocarbon group having from 1 to 18 carbon atoms); $X^1$ represents a direct bond, —COO—, —OCO—, $-CH_2\text{-}(l_1)\text{-}COO-$, $-(CH_2)_{l_2}-OCO-$ (wherein $l^1$ and $l^2$ each represents an integer of from 1 to 3),

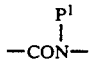

(wherein $P^1$ represents . a hydrogen atom or a hydrocarbon group having from 1 to 12 carbon atoms), —CONHCONH—, —CONHCOO—, —O—,

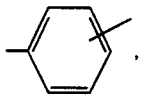

or $-SO_2-$; $Y^1$ represents a group bonding $X^1$ to —COO—; $W^1$ and $W^2$, which may be the same or different, each represents a divalent aliphatic group, a divalent aromatic group (each of the aforesaid groups may have, in the bond of each divalent organic residue, at least one bonding group selected from —O—, —S—,

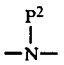

(wherein $P^2$ represents a hydrogen atom or a hydrocarbon group having from 1 to 12 carbon atoms), $-SO_2-$, —COO—, —OCO—, —CONHCO—, —NHCONH—, $$-\overset{\overset{P^3}{|}}{C}ON-$$

(wherein $P^4$ has the same meaning as $P^2$), $$-\overset{\overset{P^4}{|}}{S}O_2N-$$

(wherein P4 has the same meaning as $P^2$), and $$-\overset{\overset{P^3}{|}}{\underset{\underset{P^4}{|}}{Si}}-$$

or an organic residue composed of a combination of these residues; $b^1$ and $b^2$ have the same meaning as $a^1$ and $a^2$; $X^2$ has the same meaning as $X^1$; $Y^2$ represents a group bonding $X^2$ to —COO—; n represents an integer of 0 or 1; m represents an integer of from 3 to 18; $Y^{1'}$ represents a group bonding $X^1$ to $Z^1$; $Z^1$ represents $—CH_2—$, —O—, or —NH—; $Y^{2'}$ represents group bonding $X^2$ to $Z^2$; $W^3$ represents a divalent aliphatic group; and $Z^2$ has the same meaning as $X^1$.

Another embodiment of this invention is to provide an electrophotographic light-sensitive material comprising a support having provided thereon a photoconductive layer containing at least inorganic photoconductive particles and a resin binder, wherein the resin binder comprising the aforesaid copolymer containing at least one of the polyester type macromonomers represented by aforesaid formulae (I), (II), (III), and (IV) as the polymer component and at least one of a heat-curable and/or photo-curable resin and a crosslinking agent.

In a preferred embodiment, the aforesaid copolymer has at least one acid group or polar group selected from $—PO_3H_2$, $—SO_3H$, —COOH, and —OH at one terminal of the main chain of the copolymer.

DETAILED DESCRIPTION OF THE INVENTION

The present invention is described hereinafter in detail.

The binder resin for use in this invention contains the graft type copolymer having at least one polyester type macromonomer shown by formula (I), (II), (III), or (IV) described above (the graft copolymer is hereinafter referred to as resin (A)) and the resin (A) may have at least one acid group selected from $—PO_3H_3$, $—SO_3H$, and —COOH as described above (hereinafter, the graft type copolymer having such an acid group is referred to as resin (A')).

Furthermore, when the binder resin contains the above described resin (A) having a low weight average molecular weight of from $1\times10^3$ to $2\times10^4$ (hereinafter the low molecular weight resin (A) is referred to as resin (AL)) or the resin (A) having a low weight average molecular weight of from $1\times10^3$ to $2x10^4$ and having at least one acid group selected from $—PO_3H_3$, $—SO_3H$, or —COOH bonded at one terminal of the polymer main chain (hereinafter, the low molecular weight resin (A) having the acid group is referred to as resin (AL') and at least one of the following resins (B), (C) and (D), the electrophotographic light-sensitive material has more improved mechanical strength such as printing durability, when used as a printing plate.

Resin (B):

The resin having a weight average molecular weight of from $5\times10^4$ to $5\times10^5$ and having neither acid group (i.e., $—PO_3H_3$, $—SO_3H$, or —COOH) nor a basic group.

Resin (C):

The resin having a weight average molecular weight of from $5\times10^4$ to $5\times10^5$ and containing from 0.1 to 15% by weight a copolymer component having at least one functional group selected from —OH and a basic group. Resin (D):

The resin having a weight average molecular weight of from $5\times10^4$ to $5\times10^5$ and containing a copolymer component having an acid group at less than 50% of the content of the acid group of the aforesaid copolymer (i.e., the resin (A')) or the resin having a weight average molecular weight of from $5\times10^4$ to $5\times10^5$ and containing a copolymer component containing at least one acid group selected from $—PO_3H_3$, $—SO_3H$, —COOH, and $$-\overset{\overset{O}{\|}}{\underset{\underset{OH}{|}}{P}}-OR^0$$

(wherein $R^0$ represents a hydrocarbon group), the acid group having larger pKa than the pKa of the acid group contained in the aforesaid copolymer (i.e., resin (A')).

The electrophotographic light-sensitive material of this invention containing at least one of the resins (AL), (AL'), (B), (C), and (D) as the binder resin for the photoconductive layer thereof has an improved mechanical strength and also shows an improved printing impression when the electrostatic light-sensitive material is used as a printing plate after being processed.

The resin (A) for use in this invention as the binder resin is, as described above, the graft type copolymer containing at least one of the polyester type macromonomer each having a polymerizable double bond at one terminal thereof and a carboxy group at the other terminal as shown by formula (I) or (II) or at least one of the polyester type macromonomers each having a polymerizable double bond at one terminal thereof and a hydroxy group at the other terminal as shown by formula (III) or (IV) as the copolymer component.

The weight average molecular weight of the graft type copolymer is suitably from about $1\times10^3$ to about $5\times10^5$ as described above and, from the viewpoint of the electrophotographic characteristics, the weight average molecular weight thereof is preferably from $1\times10^3$ to $1.5\times10^4$, and more preferably from $3\times10^3$ to $1\times10^4$.

The content of the aforesaid macromonomer in the copolymer is from about 1 to about 70 parts by weight per 100 parts by weight of the copolymer.

In a preferred embodiment of this invention, an acid group is bonded to one terminal of the main chain of the copolymer, the proportion of the acid group in the copolymer is from 0.1 to 10 parts by weight per 100 parts by weight of the copolymer.

The aforesaid copolymer for use in this invention has a molecular weight of from about $1\times10^3$ to about $5\times10^5$ per 100 parts by weight of the copolymer as described above. When the molecular weight of the copolymer is relatively low such as from $1\times10^3$ to $1.5\times10^4$, it is preferred that the content of the aforesaid macromonomer is relatively high such as from about 40 to about 70 parts by weight per 100 parts by weight of the copolymer and the proportion of the acid group bonded to one terminal of the main chain of the copolymer is relatively high, e.g., from 3 to 10 parts by weight per 100 parts by weight of the copolymer. On the other hand, when the molecular weight of the copolymer is relatively high such as from $7\times10^4$ to $5\times10^5$, it is preferred that the content of the macromonomer is relatively low, e.g., from 1 to 40 parts by weight per 100 parts by weight of the copolymer and the proportion of the acid group bonded to one terminal of the main chain of the copolymer is relatively low, e.g., from 0 to 2 parts by weight per 100 parts by weight of the copolymer.

The conventional acid group-containing binder resins as described above are mainly for offset master, the molecular weight of the resins is relatively high (e.g., higher than $5\times10^4$) for improving the printing durability by keeping the film strength, and each of these binder resins is a random copolymer, wherein the acid group-containing copolymer components randomly exist in the main chain thereof.

On the other hand, the resin (A) for use in this invention is a graft type copolymer and the acid group contained in the resin does not randomly exist in the main chain of the copolymer but is bonded to a specific portion(s) of the copolymer, i.e., at the terminal of the grafted portion, or at the terminal of the grafted portion terminal and the main chain terminal.

Thus, it is assumed that the acid group moiety existing at a specific position apart from the main chain of the copolymer adsorbs onto stoichiometric defects of inorganic photoconductive particles and the main chain portion of the copolymer mildly and sufficiently coat the surface of the photoconductor particles. Accordingly, the copolymer compensates the trap of a photoconductor to improve the humidity characteristics thereof, and sufficiently disperses therein photoconductive particles to suppress the aggregation of the photoconductive particles. That is, when the weight average molecular weight of the copolymer is low, the coating property of the copolymer on the surface of photoconductor particles is more improved, while when the molecular weight of the copolymer is high, the phenomenon of accelerating the aggregation of photoconductive particles with each other, which is very severe in the case of using a conventional random copolymer, is effectively suppressed. Thus, the smoothness of the surface of the photoconductive layer is improved by the use of the aforesaid binder resin in the present invention.

On the other hand, when an electrophotographic light-sensitive material having a photoconductive layer with a rough surface is used as an electrophotographic lithographic printing master plate, the dispersion state of zinc oxide particles as photoconductive particles and a binder resin is improper and thus a photoconductive layer is formed in a state containing aggregates of the photoconductive particles, whereby the surface of the non-image portions of the photoconductive layer is not uniformly and sufficiently rendered hydrophilic even by applying thereto an oil-desensitizing treatment with an oil-desensitizing solution to cause attaching of printing ink at printing, which results in the formation of background staining at the non-image portions of prints.

When the resin (A) for use in this invention has a low molecular weight, it may be feared that the film strength might become brittle. However, it has been found that by sufficiently dispersing the binder resin and photoconductive particles to coat the surface of the particles by the adsorption of the binder resin, the filming property of the resin is kept and the photoconductive layer formed has a sufficient film strength as a CPC light-sensitive material or an offset master plate capable of printing several thousands of prints. Furthermore, it has been confirmed that the binder resin (A) for use in this invention can form a photosensitive layer having a higher photosensitivity than the case of using a conventional random copolymer resin having an acid group not at a terminal of a graft portion but at the side chain bonded to the main chain of the copolymer.

In spectral sensitizing dyes which are usually used for giving a photosensitivity in the region of from visible light to infrared light, the spectral sensitizing action sufficiently functions by adsorbing the dyes onto photoconductive particles and hence it is assumed that the binder resin containing the aforesaid copolymer in this invention properly interacts with photoconductive particles without hindering the adsorption of a spectral sensitizing dye onto the photoconductive particles. The action of the binder resin is particularly remarkable for cyanine dyes or phthalocyanine series pigments which are particularly effective as spectral sensitizing dyes for the sensitization in the range of from near infrared to infrared.

If the molecular weight of the resin (A) is less than about $1\times10^3$, the film-forming ability thereof is undesirably reduced, whereby the photoconductive layer formed cannot keep a sufficient film strength, while if the molecular weight thereof is larger than about $5\times10^5$, the electrophotographic characteristics (in particular, initial potential and dark decay retention) of the photoconductive layer are undesirably reduced. In particular, in the case of using the resin having a higher molecular weight and the content of the acid group is over 3% by weight, the electrophotographic characteristics of the photoconductive layer are greatly deteriorated, and the background staining markedly increases in the case of using as an offset master.

Also, if the content of the acid group (COOH at a graft terminal and an acid group at the terminal of an optional main chain) in the resin (A) for use in this invention is less than 0.5% by weight, the initial potential of the photoconductive layer formed is low and thus a sufficient image density cannot be obtained. On the other hand, if the content of the acid group is larger than 10% by weight, the dispersibility of photoconductive particles is reduced, the smoothness of the photoconductive layer and the electrophotographic characteristics in a high humidity condition are reduced, and further, background staining is increased in the case of using as an offset master.

The glass transition point of the resin (A) is in the range of from —10° C. to 100° C., and more preferably from —5° C. to 85° C.

Then, the macromonomer shown by formula (I) or (II) having a polymerizable double bond group at one terminal and a carboxy group at the other terminal, which is used as the copolymer component for the graft type copolymer resin in this invention, is described in greater detail.

In formulae (I) and (II) described above, the group in the brackets represents a recurring unit sufficient for making the weight average molecular weight of the macromonomer shown by formula (I) or (II) to the range of from about $1\times10^3$ to about $1.5\times10^4$.

Preferred embodiments of the macromonomer shown by formula (I) are as follows.

In formula (I), $a^1$ and $a^2$, which may be the same or different, each represents a hydrogen atom, a halogen atom (e.g., chlorine, bromine, and fluorine), a cyano group, an alkyl group having from 1 to 3 carbon atoms (e.g., methyl, ethyl, and propyl), —COOZ, or —$CH_2$COOZ (wherein Z represents an alkyl group having from 1 to 8 carbon atoms (e.g., methyl, ethyl, propyl, butyl, pentyl, hexyl, and octyl), an aralkyl group having from 7 to 9 carbon atoms (e.g., benzyl, phenethyl, and 3-phenylpropyl), or a phenyl group which may be substituted (e.g., phenyl tolyl, xylyl, and methoxyphenyl)).

It is more preferred that one of $a^1$ and $a^2$ is a hydrogen atom.

$X^1$ represents preferably —COO—, —OCO—, —$CH_2$COO—, —$CH_2$OCO—, —CONH—, —CONHCONH—, —CONHCO—, or

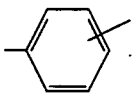

$P^1$ represents a hydrogen atom or a hydrocarbon group having from 1 to 12 carbon atoms (e.g., methyl, ethyl, propyl, butyl, hexyl, octyl, decyl, dodecyl, 2-methoxyethyl, 2-chloroethyl, 2-cyanoethyl, benzyl, methylbenzyl, chlorobenzyl, methoxybenzyl, phenethyl, phenyl, tolyl, chlorophenyl, methoxyphenyl, and butylphenyl).

$Y^1$ represents a group bonding $X^1$ to —COO—, i.e., a direct bond or a linkage group. Practical examples of the linkage group are those shown by

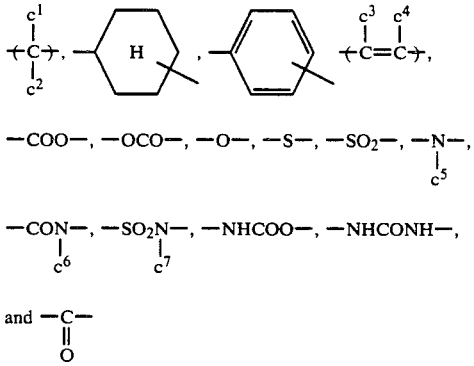

or a linkage group formed by a combination of these linkage groups (in the above formulae, $c^1$ to $c^4$, which may be the same or different, each represents a hydrogen atom, a halogen atom (e.g., preferably, fluorine, chlorine, and bromine), or a hydrocarbon group having from 1 to 7 carbon atoms (e.g., preferably, methyl, ethyl, propyl, butyl, 2-chloroethyl, 2-methoxyethyl, 2-methoxycarbonylethyl, benzyl, methoxybenzyl, phenyl, methoxyphenyl, and methoxycarbonylphenyl) and $C^5$ to $C^7$ each has the same meaning as $P^1$ described above).

Also, $w^1$ and $w^2$, which may be the same or different, each represents a divalent organic residue, i.e., a divalent aliphatic group or a divalent aromatic group, which may contain a linkage group such as —O—, —S—,

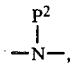

—SO—, —$SO_2$—, —COO—, —OCO—, —CONHCO—, —NHCONH—,

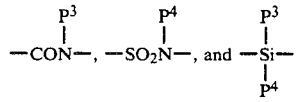

(wherein $P^2$ to $P^4$ each has the same meaning as $P^1$ described above) or an organic residue formed by a combination of these divalent residues.

Examples of the divalent aliphatic group are

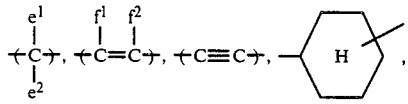

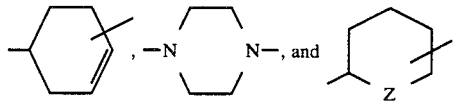

(wherein $e^1$ and $e^2$, which may be the same or different, each represents a hydrogen atom, a halogen atom (e.g., fluorine, chlorine, and bromine), or an alkyl group having from 1 to 12 carbon atoms (e.g., methyl, ethyl, propyl, chloromethyl, bromomethyl, butyl, hexyl, octyl, nonyl, and decyl); $f^1$ and $f^2$, which may be the same or different, each has the same melanin as $e^1$ and $e^2$; and Z represents —O—, —S—, or —$NR^1$— (wherein $R^1$ represents an alkyl group having from 1 to 4 carbon atoms, —$CH_2$Cl or —$CH_2$Br)).

Examples of the divalent aromatic group include a benzene ring group, a naphthalene ring group, and a 5- or 6-membered heterocyclic ring group (containing at least one of oxygen atom, sulfur atom, and nitrogen atom as the hetero atom constituting the heterocyclic ring).

These aromatic groups may have a substituent such as a halogen atom (e.g., fluorine, chlorine, and bromine), an alkyl group having from 1 to 8 carbon atoms (e.g., methyl, ethyl, propyl, butyl, hexyl, and octyl), and an alkoxy group having from 1 to 6 carbon atoms (e.g., methoxy, ethoxy, propoxy, and butoxy).

Examples of the heterocyclic group are furan, thiophene, pyridine, pyrazine, piperazine, tetrahydrofuran, pyrrole, tetrahydropyran, and 1,3-oxazoline.

Then, preferred embodiments of the macromonomer shown by formula (II) described above are as follows.

In formula (II), preferred groups of $b^1$, $b^2$, $X^2$ and $Y^2$ are same as the preferred groups of $a^1$, $a^2$, $X^1$, and $Y^1$ in formula (I) described above.

$W^3$ represents a divalent aliphatic group and is represented by $-(CH_2)_m-$ (wherein m represents an integer of 2 to 18) or the following formula (a):

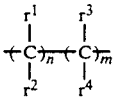

(a)

wherein $r^1$ and $r^2$, which may be the same or different, each represents a hydrogen- atom or an alkyl group having from 1 to 12 carbon atoms, $r^3$ and R4, which may be the same or different, each represents a hydrogen atom or an alkyl group having from 1 to 12 carbon atoms, n represent 0 or 1 and m represents an integer of from 3 to 18.

Specific examples of $W^3$ include

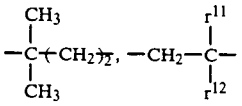

(wherein $r^{11}$ and $r^{12}$, which may be the same or different, each represents a hydrogen atom or an alkyl group having 1 to 12 carbon atoms such as a methyl group, an ethyl group, a propyl group, a butyl group, a hexyl group, an octyl group or a decyl group, with the proviso that $r^{11}$ and $r^{12}$ cannot be hydrogen atoms at the same time),

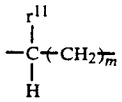

(Wherein $r^{13}$ represents alkyl group having 1 to 12 carbon atoms such as those mentioned for $r^{11}$ and $r^{12}$ above, and m represents an integer of from 3 to 18), and $-(CH_2)_m-$ (wherein m represents an integer of from 2 to 18).

Specific examples of the moieties shown by

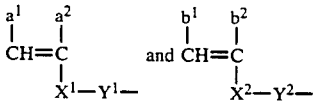

in the macromonomers shown by formula (I) and formula (II) are illustrated below but the present invention is not limited thereto.

In the following formulae, represents —H, $—CH_3$, $—CH^2COOCH_3$, —Cl, —Br, or —CN; b represents —H or $—CH_3$, h represents an integer of from 2 to 12, and i represents an integer of from 1 to 12.

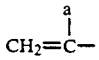

(A-1)

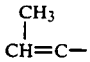

(A-2)

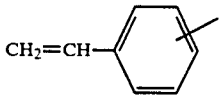

(A-3)

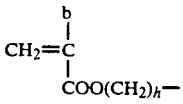

(A-4)

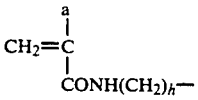

(A-5)

-continued

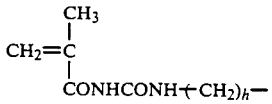

(A-6)

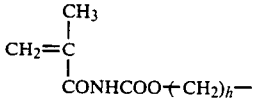

(A-7)

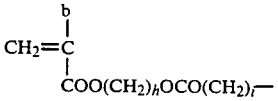

(A-8)

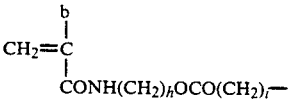

(A-9)

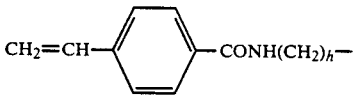

(A-10)

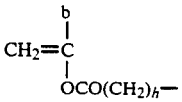

(A-11)

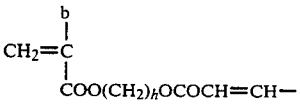

(A-12)

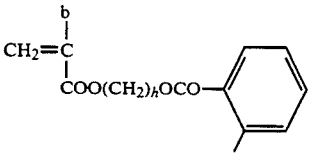

(A-13)

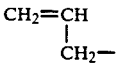

(A-14)

$CH_2=CH-CH_2CH_2-$ (A-15)

$CH_2=CH-CH_2-COO(CH_2)_hOCO(CH_2)_i-$ (A-16)

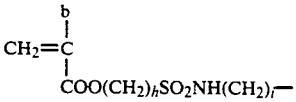

(A-17)

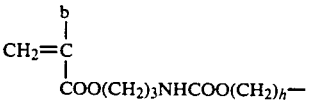

(A-18)

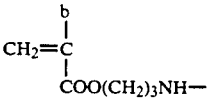

(A-19)

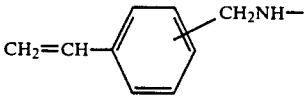

(A-20)

-continued (A-21)

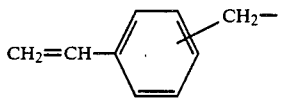

(A-22)

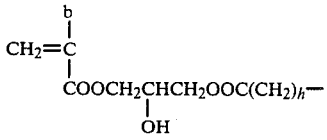

(A-23)

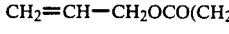

(A-24)

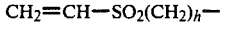

(A-25)

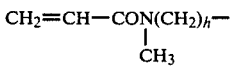

(A-26)

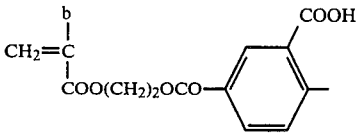

(A-27)

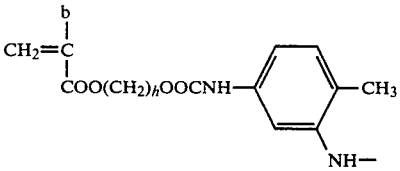

(A-28)

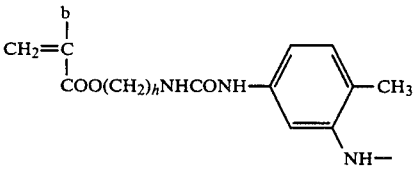

Then, practical examples of the moieties shown by

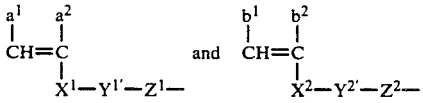

of the macromonomers shown by formulae (III) and (IV), respectively, are illustrated below although the invention is not limited to them.

In the following formulae, a represents —H, —$CH_3$, —$CH_2COOCH_3$, —Cl, —Br, or —CN: b represents —H or —$CH_3$; X represents —Cl or —Br; h represents an integer of from 2 to 12; and i represents an integer of from 1 to 4.

(A'-1)

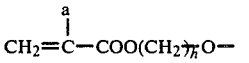

(A'-2)

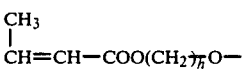

(A'-3)

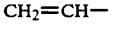

(A'-4)

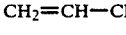

(A'-5)

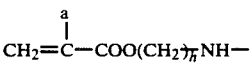

-continued (A'-6)

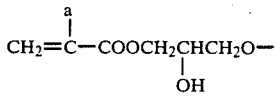

(A'-7)

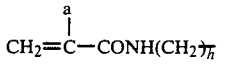

(A'-8)

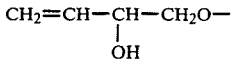

(A'-9)

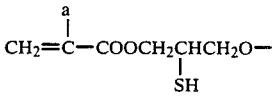

(A'-10)

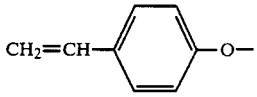

(A'-11)

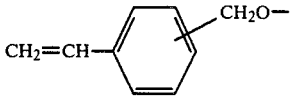

(A'-12)

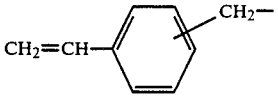

(A'-13)

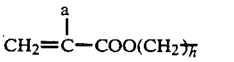

(A'-14)

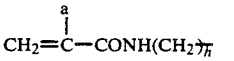

(A'-15)

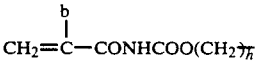

(A'-16)

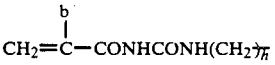

(A'-17)

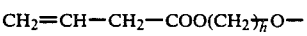

(A'-18)

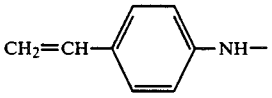

(A'-19)

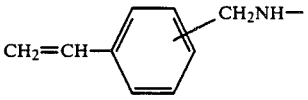

(A'-20)

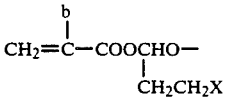

(A'-21)

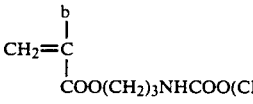

-continued $$CH_2{=}\overset{b}{\overset{|}{C}}{-}COO(CH_2CH_2O)_l CO(CH_2)_n \quad \text{(A'-22)}$$

Then, practical examples of $w^1$ and $w^2$ in formulae (I) and (II) are illustrated below but the present invention is not limited thereto. In the following formulae, $R^1$ represents an alkyl group having from 1 to 4 carbon atoms, $-CH_2Cl$, or $-CH_2Br$; $R^2$ represents an alkyl group having from 1 to 8 carbon atoms, $-(CH_2)_l-OR^1$ (wherein $R^1$ is the same as described above and l represents an integer of from 2 to 8), $-CH_2Cl$, or $-CH_2Br$; $R^3$ represents —H or $-CH_3$; $R^4$ represents an alkyl group having 1 to 4 carbon atoms; Z represents —O—, —S—, or $-NR^1-$ (wherein $R^1$ is the same as described above); p represents an integer of from 1 to 26; q represents an integer of from 1 to 4; r represents an integer of from 1 to 10; j represents an integer of from 0 to 4; and k represents an integer of from 2 to 6.

$$(CH_2)_p \quad \text{(B-1)}$$

$$-CH{=}CH- \quad \text{(B-2)}$$

$$-C{\equiv}C- \quad \text{(B-3)}$$

(B-4)

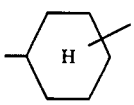

$$-\overset{R_1}{\overset{|}{CH}}- \quad \text{(B-5)}$$

$$(CH\overset{R_1}{\overset{|}{}}-CH_2)_p \quad \text{(B-6)}$$

$$(CH\overset{R_2}{\overset{|}{}}-CH\overset{R_2}{\overset{|}{}}) \quad \text{(B-7)}$$

(two $R^2$s may be the same or different)

$$-CH_2-\overset{R_1}{\overset{|}{\underset{R_1}{\underset{|}{C}}}}-CH_2- \quad \text{(B-8)}$$

(two $R^1$s may be the same or different)

(B-9)

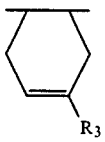

$$-\overset{R_4}{\overset{|}{C}}HCH_2(OCH_2CH_2)_q OCH_2\overset{R_4}{\overset{|}{C}}- \quad \text{(B-10)}$$

$$(CH_2CH_2OCH_2CH_2)_r(OCH_2CH_2)_j \quad \text{(B-11)}$$

$$(CH_2CH_2SCH_2CH_2)_r \quad \text{(B-12)}$$

$$(CH_2CH_2SCH_2CH_2OCH_2CH_2)_r \quad \text{(B-13)}$$

(B-14)

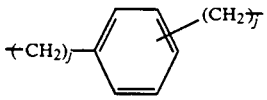

-continued (B-15)

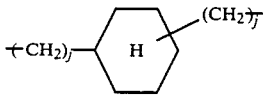

(B-16)

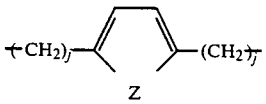

(B-17)

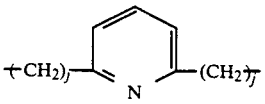

(B-18)

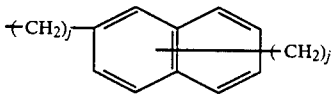

(B-19)

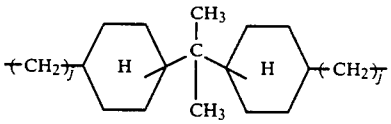

(B-20)

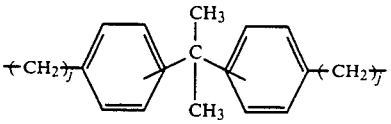

(B-21)

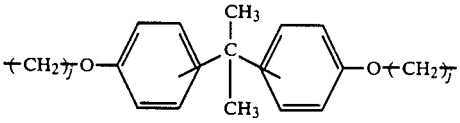

(B-22)

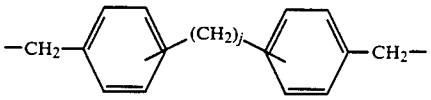

$$-CH_2-C{\equiv}C-CH_2- \quad \text{(B-23)}$$

$$-CH_2-CH{=}CH-CH_2- \quad \text{(B-24)}$$

$$-CH_2OCH_2CH_2- \quad \text{(B-25)}$$

$$-CH_2CH_2CH_2OCH_2CH_2CH_2- \quad \text{(B-26)}$$

$$(CH_2)_k SO_2(CH_2)_k \quad \text{(B-27)}$$

$$(CH_2)_k S-S(CH_2)_k \quad \text{(B-28)}$$

$$(CH_2)_k\overset{CH_3}{\overset{|}{\underset{CH_3}{\underset{|}{Si}}}}-O-\overset{CH_3}{\overset{|}{\underset{CH_3}{\underset{|}{Si}}}}(CH_2)_k \quad \text{(B-29)}$$

(B-30)

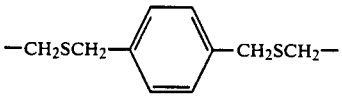

(B-31)

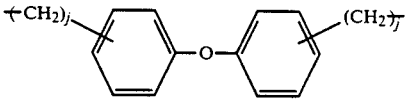

(B-32)

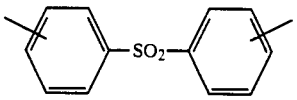

-continued (B-33)

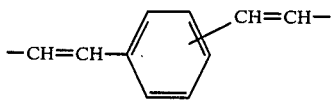

(B-34)

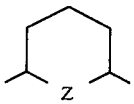

(B-35)

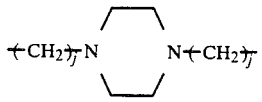

(B-36)

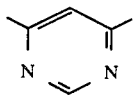

(B-37)

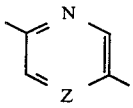

(B-38)

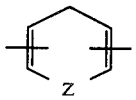

The macromonomer shown by formula (I) can be easily produced by a method of introducing a polymerizable double bond group by a high molecular reaction to a hydroxy group only at one terminal of a polyester oligomer having a weight average molecular weight of from $1\times10^3$ to $1.5\times10^4$ synthesized by a polycondensation reaction of a diol and a dicarboxylic acid, a dicarboxylic acid anhydride, or a dicarboxylic acid ester as described in *High Molecule Data Handbook (Foundation),* edited by Kobunshi Gakkai, published by Baifukan, 1986.

The polyester oligomer can be synthesized by a conventional polycondensation reaction. Practically, the polyester oligomer can be produced according to the methods described in Eiichiro Takiyama, *Polyester Resin Handbook,* published by Nikkan Kogyo Shinbun Sha, 1980; *Jushukugo to Jufuka (Polycondensation and Polyaddition)*, edited by Kobunshi Gakkai, published by Kyoritsu Shuppan K.K., 1980; I. Goodman, *Encyclopedia of Polymer Science and Engineering,* Vol. 12, published by John Wiley & Sons, 1985, etc.

A polymerizable double bond group can be introduced to a hydroxy group only at one terminal of the polyester oligomer by utilizing a reaction of forming an ester from an alcohol or a reaction of forming a urethane from an alcohol conventional known on low molecular compounds.

That is, the introduction reaction of a polymerizable double bond can be carried out by a method of synthesizing the macromonomer by forming an ester by the reaction of an alcohol and a carboxylic acid, a carboxylic acid ester. a carboxylic acid halide, or a carboxylic acid anhydride each having a polymerizable double bond group in the molecule or a method of synthesizing the macromonomer by forming a urethane by the reaction of an alcohol and a mono-isocyanate having a polymerizable double bond group in the molecule.

The practical methods are described in *Shin Jikken Kagaku Koza (New Experimental Chemistry Course)*, 14, *Synthesis and Reaction of Organic Compounds (II)*, Chapter 5, edited by the Chemical Society of Japan, published by Maruzen K.K., 1977 and ibid., *Synthesis and Reaction of organic Compounds (III)*, page 1652, published in 1978.

The macromonomer shown by formula (II) can be produced by a method of synthesizing a polyester oligomer by a self polycondensation reaction of a carboxylic acid having a hydroxy group in the molecule and then forming a macromonomer from the oligomer by the high molecular reaction as in the case of synthesizing the macromonomer shown by formula (I) described above or a method of synthesizing the macromonomer by a living polymerization reaction of a carboxylic acid having a polymerizable double bond group and a lactone. Practical methods of producing the macromonomers are described in T. Yasuda, T. Aida and S. Inoue, *J. Macromol. Sci. Chem.,* A, 21, 1035(1984), T. Yasuda, T. Aide and S. Inoue, *Macromolecules,* 17, 2217(1984), S. Sosnowski, S. Stomkowski and S. Penczek, *Makromol. Chem.,* 188, 1347(1987), Y. Gnanou and P. Rempp., *Makromol. Chem.,* 188, 2267(1987), and T. Shiota and Y. Goto, *J. Appl. Polym. Sci.,* 11, 753(1967).

Then, specific examples of the macromonomers shown by formulae (I) and (II) described above are illustrated below. In the following formulae, the group in the brackets represents a recurring unit sufficient for providing the weight average molecular weight of the macromonomer of from $1\times10^3$ to $1.5\times10^4$, $R^5$ and R6, which may be the same or different, each represents $-CH_3$ or $-C_2H_5$; $R^7$ and $R^8$, which may be the same or different, each represents —Cl, —Br, $-CH_2Cl$, or $-CH_2Br$; s represents an integer of from 1 to 25; t represents an integer of from 2 to 12; represents an integer of from 2 to 12; x represents an integer of from 2 to 4; y represents an integer of from 2 to 6; and z represents an integer of from 1 to 4.

(M-1)

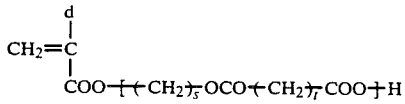

(M-2)

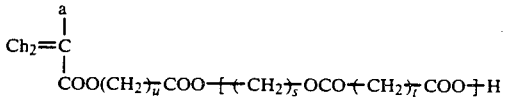

-continued
(M-3)
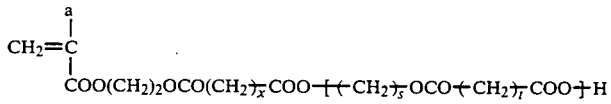
(M-4)
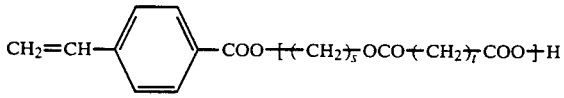
(M-5)
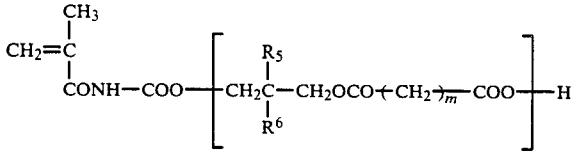
(M-6)
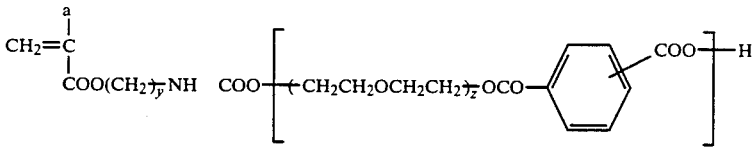
(M-7)
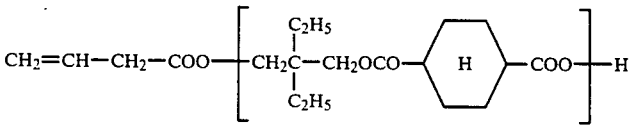
(M-8)
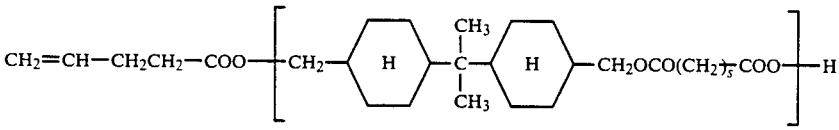
(M-9)
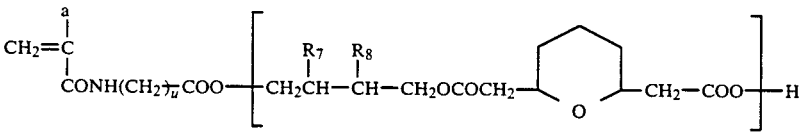
(M-10)
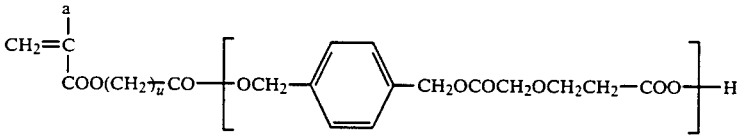
(M-11)
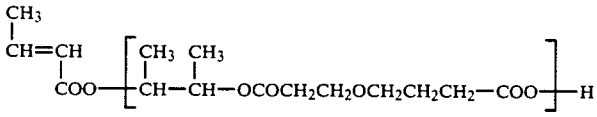
(M-12)
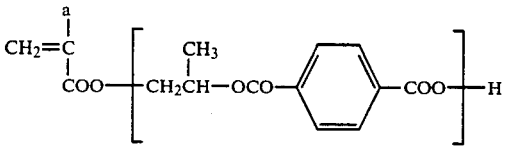
(M-13)
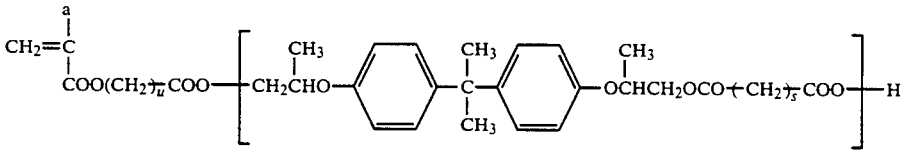

-continued
(M-14)
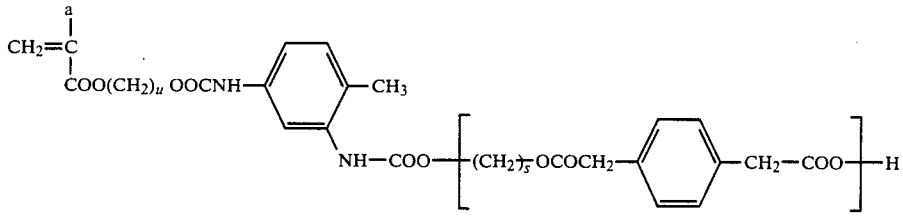
(M-15)
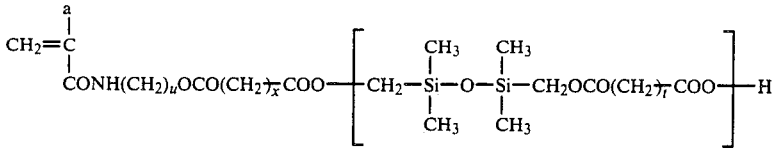
(M-16)
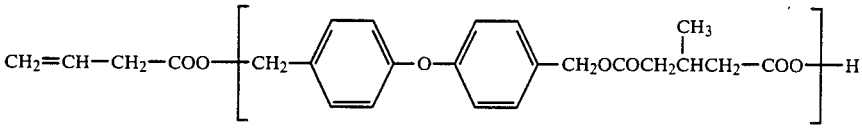
(M-17)
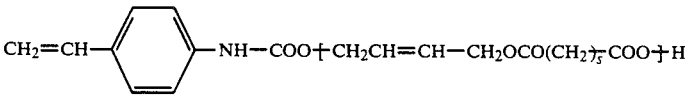
(M-18)
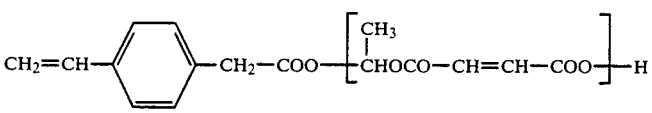
(M-19)
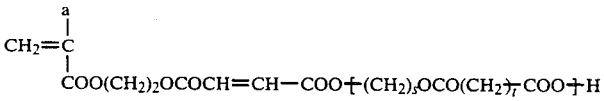
(M-20)
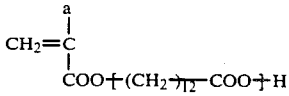
(M-21)
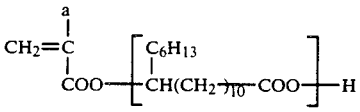
(M-22)
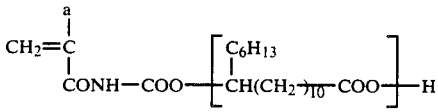
(M-23)
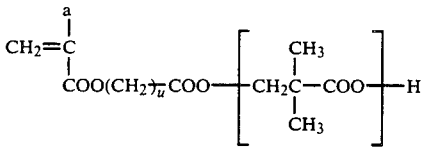
(M-24)
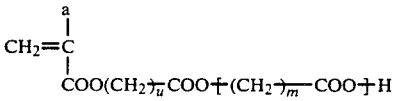
(M-25)
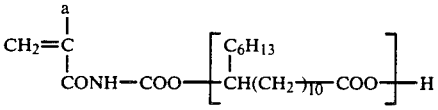

-continued

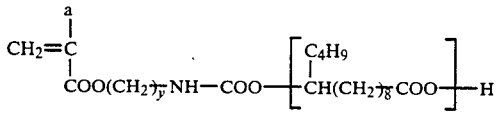

(M-26)

The macromonomer shown by formula (III) can be easily produced by the method of introducing by a high molecular reaction a polymerizable double bond group to a polyester oligomer having a weight average molecular weight of from $1\times10^3$ to $1.5\times10^4$ at a carboxy group only of one terminal thereof, said oligomer being synthesized by the polycondensation reaction of a diol and a dicarboxylic acid, a dicarboxylic acid anhydride, or a dicarboxylic acid ester as described in *High Molecule Data Handbook* (*Foundation*), edited by Koobunshi Gakkai, published by Baifukan K.K., 1986.

The polyester oligomer can be synthesized by a conventional polycondensation reaction. Practically, the polyester oligomer can be produced according to the methods described in Eiichiro Takiyama, *Polyester Resin Handbook,* published by Nikkan Kogyo Shinbun Sha, 1980; *Juushukugo to Juufuka* (*Polycondensation and Polyaddition*), edited by Kobunshi Gakkai, published by Kyoritsu Shuppan K.K., 1980; I. Goodman, *Encyclopedia of Polymer Science and Engineering,* Vol. 12, published by John Wiley & Sons, 1985, etc.

A polymerizable double bond group can be introduced to a hydroxy group only at one terminal of the polyester oligomer by utilizing a reaction of forming an ester from a carboxylic acid or a reaction of forming an acid amide from a carboxylic acid conventionally known on low molecular compounds.

That is, the macromonomer is synthesized by a macromolecular reaction of a compound having a polymerizable double bond group and a functional group capable of causing a chemical reaction with a carboxy group [e.g., —OH,

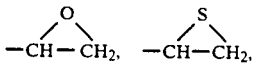

a halide (e.g., chloride, bromide, and iodide), $—NH_2$, —COOR′ (wherein R represents methyl, trifluoromethyl, 2,2,2-trifluoroethyl, etc.), etc.] in the molecule and a polyester oligomer.

Practically, the polyester oligomers can be synthesized according to the methods described in *Shin Jikken Kaguku Koza* (*New Experimental Chemistry Course*), 14, *Synthesis of Organic Compounds and Reaction therefor* (*II*), Chapter 5, edited by the Chemical Society of Japan, published by Maruzen K.K., 1977; Yoshi Iwakura and Keisuke Kurita, *Hannosei Koobunshi* (*Reactive Macromolecules*), published by Kodansha, 1977; etc.

The macromonomer shown by formula (IV) can be produced by a method of synthesizing a polyester oligomer by a self polycondensation reaction of a carboxylic acid having a hydroxy group in the molecule and then synthesizing the macromonomer by a macromolecular reaction of the polyester oligomer as in the aforesaid synthesis of the macromonomer shown by formula (III).

Then, specific examples of the macromonomers shown by formulae (III) and (IV) are illustrated below, but the present invention is not limited to these compounds.

In the following formulae, the group in the brackets represents a recurring unit sufficient for making the weight average molecular weight of each macromonomer from $1\times10^3$ to $1.5\times10^4$; d represents —H or $—CH_3$; $R^5$ and $R^6$, which may be the same or different, each represents $—CH_3$ or $—C_2H_5$; $R^7$ represents $—CH_3$, $—C_2H_5$, $—C_3H_7$, or $—C_4H_9$; Y represents —Cl or —Br; W represents —O— or —S—; s represents an integer of from 2 to 12; t represents an integer of from 1 to 25; u represents an integer of from 2 to 12; x represents an integer of from 2 to 16; y represents an integer of from 1 to 4; and z represents 0, 1 or 2.

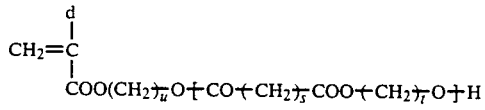

(M′-1)

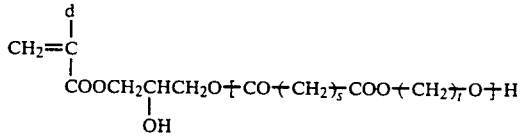

(M′-2)

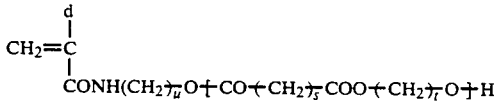

(M′-3)

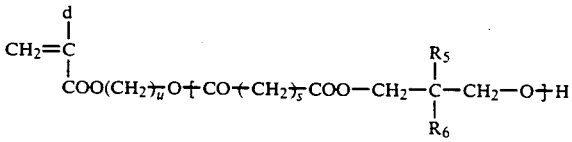

(M′-4)

-continued
(M'-5)
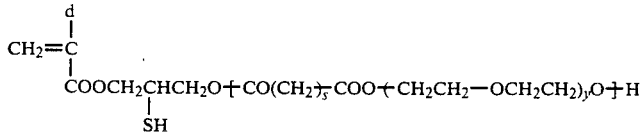
(M'-6)
(M'-7)
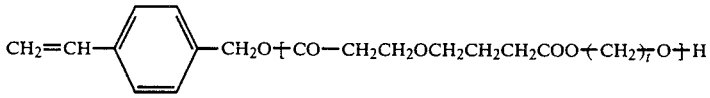
(M'-8)
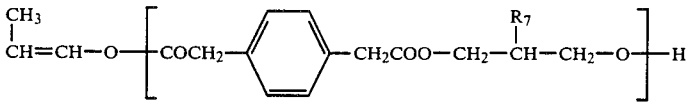
(M'-9)
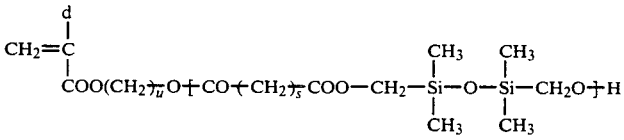
(M'-10)
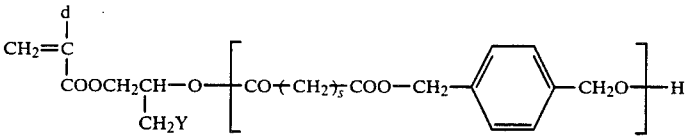
(M'-11)
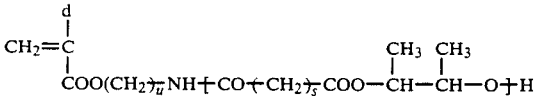
(M'-12)
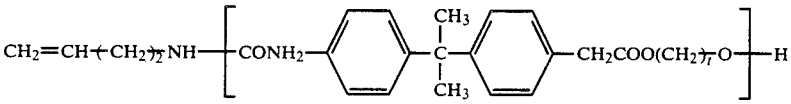
(M'-13)
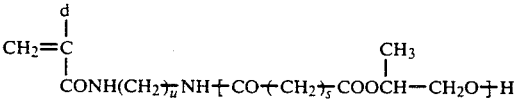
(M'-14)
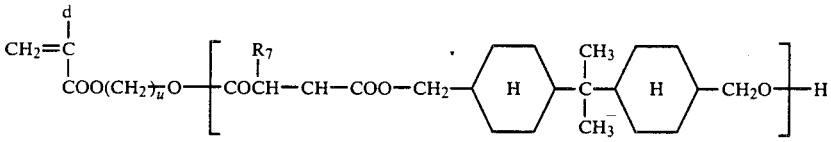
(M'-15)
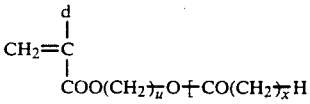
(M'-16)
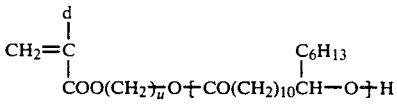
(M'-17)
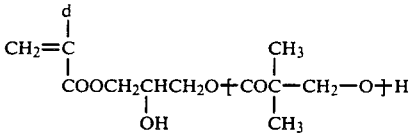

-continued (M'-18)

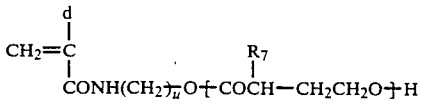

(M'-19)

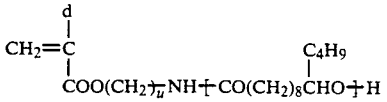

(M'-20)

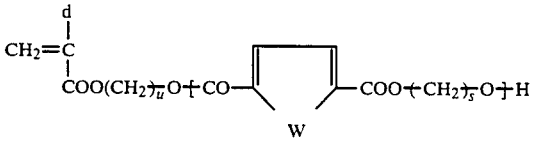

(M'-21)

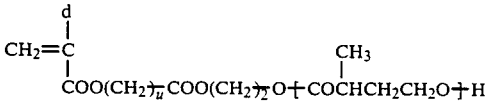

(M'-22)

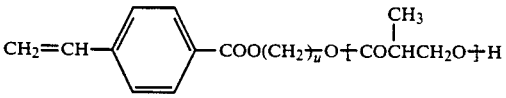

The resin (A) for use in this invention is a graft copolymer containing at least one of the macromonomers shown by aforesaid formulae (I), (II), (III), and (IV) as the copolymer component and may contain other monomer which meets the properties of the binder resin and can be radical-copolymerized with the aforesaid macromonomer as other copolymer component.

For example, the binder resin contains preferably a monomer represented by following formula (V) as such another copolymer component in an amount of from 30% by weight to 99% by weight of the copolymer.

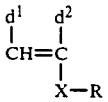

(V)

wherein $d^1$ and $d^2$ have the same meaning as $a^1$ and $a^2$ in formula (I) described above and is preferably a hydrogen atom or a methyl group; X represents —COO—, —OCO—, or —O— and is preferably —COO—.

Also, R in the above formula represents a hydrocarbon group having from 1 to 18 carbon atoms, such as, preferably, an alkyl group having from 1 to 18 carbon atoms, which may be substituted (e.g., methyl, ethyl, propyl, butyl, pentyl, hexyl, octyl, decyl, dodecyl, tridecyl, tetradecyl, 2-methoxyethyl, 2-ethoxyethyl, 2-hydroxyethyl, 3-hydroxyethyl, 2-hydroxyethyl, 3-hydroxypropyl, 2-hydroxypropyl, 2-hydroxypropyl, 2-chloroethyl, 2-cyanoethyl, 2-(N,N-dimethylamino)ethyl, 2,3-dihydroxypropyl, and 3-carbamoylpropyl), an aralkyl group having from 7 to 12 carbon atoms, which may be substituted (e.g., benzyl, phenetyl, methoxybenzyl, ethoxybenzyl, methylbenzyl, dimethylbenzyl, chlorobenzyl, dichlorobenzyl, dibromobenzyl, acetoxybenzyl, cyanobenzyl, naphthylmethyl, and 2-naphthylethyl), a cycloalkyl group having from 5 to 8 carbon atoms, which may be substituted (e.g., cyclopentyl, cyclohexyl, and cyclobutyl) and an aryl group (e.g., phenyl, tolyl, xylyl, mesity, naphthyl, methoxyphenyl, ethoxyphenyl, chlorophenyl, dichlorophenyl, bromophenyl, dibromophenyl, chlorobromophenyl, acetoxyphenyl, acetylphenyl, chloromethylphenyl, bromomethylphenyl, cyanophenyl, and methoxycarbonylphenyl).

The resin (A) for use in this invention may further contain still other monomers as the copolymer component in addition to the aforesaid monomer.

Examples of such monomers are α-olefins, alkanoic acid vinyl esters, alkanoic acid allyl esters, acrylonitrile, methacrylonitrile, vinyl ethers, acrylamides, methacrylamides, styrenes, and heterocyclic vinyls (e.g., vinylpyrrolidone, vinylpyridine, vinylimidazole, vinylthiophene, vinylimidazoline, vinylpyrazole, vinyldioxane, vinylquinoline, vinylthiazole, and vinyloxazine).

The content of the aforesaid monomer which may be contained in the resin (A) together with the monomer shown by formula (V) is not more than 20% by weight of the copolymer.

In the graft copolymer of this invention, if the content of the copolymer component corresponding to the macromonomer shown by formula (I), (II), (III), or (IV) is less than 1% by weight of the copolymer, the dispersion of photoconductive particles in the binder resin as a coating composition for the photoconductive layer becomes insufficient. On the other hand, if the content thereof is 70% by weight or more, the copolymerization with the monomer shown by formula (V) becomes insufficient and a polymer of the monomer only shown by formula (V) or other monomer only forms in addition to the desired graft copolymer. Furthermore, when photoconductive particles are dispersed in the aforesaid copolymer containing the polymer of the monomer only, the photoconductive particles are aggregated with the copolymer.

The resin (A) may have an acid group such as $—PO_3H_3$, $—SO_3H$, and —COOH at a terminal of the main chain of the graft type copolymer in addition to the carboxy group or hydroxy group bonded to the top side of the grafted portion (i.e. resin (A')) and the resin (A) having no terminal acid group may be used together with the resin (A') having the terminal acid group in this invention.

Practically, the resin (A') can be produced by a method using a polymerization initiator having the acid group or a functional group capable being converted into the acid group, a method of using a chain transfer agent having the acid group or a functional group capable of being converted into the acid group, a method of both the aforesaid polymerization initiator and chain transfer agent, or a method of introducing the functional group by utilizing a termination reaction in an anion polymerization method.

Specific examples of the synthesis method of producing the resin (A') are described in P. Dreyfuss and R. P. Quirk, *Encycl. Polym. Sci. Eng.*, 7, 551(1987), V. Percec, *Appl. Polym. Sci.*, 285, 95(1985), P. F. Rempp and E. Franta, *Adv. Polym. Sci.*, 58, 1(1984), Y. Yamashita, *J. Appl. Polym. Sci., Appl. Polym. Symp.*, 36, 193(1981). R. Asami and M. Takai, *Makromol. Chem. Suppl.*, 12, 163(1985), etc.

The electrophotographic light-sensitive material of this invention is sometimes desired to have a higher mechanical strength while keeping the excellent electrophotographic characteristics thereof. For the purpose, a method of introducing a heat- and/or photo-curable functional group into the main chain of the graft type copolymer can be applied.

That is, it is preferred that the binder resin for use in this invention contains at least one kind of a heat- and/or photo-curable functional group together with the macromonomer shown by formula (I), (II), (III) or (IV) and, preferably, the monomer shown by formula (V). By properly crosslinking the polymers by such a heat- and/or photo-curable functional group, the interaction among the polymers can be increased to improve the strength of the film formed by the binder resin. Thus, the binder resin of this invention further containing such a heat- and/or photo-curable functional group has the effects of increasing the interaction among the binder resins, thereby more improving the film strength without obstructing the proper adsorption and coating of the binder resin on the surface of the photoconductive particles such as zinc oxide particles.

The heat- and/or photo-curable functional group in this invention is a functional group capable of setting a resin by at least one action of heat and light.

As a thermosetting functional group (i.e., a functional group of performing a thermosetting reaction) in this invention, there are functional groups described in Tsuyoshi Endo, *Netsukokasei Kobunshi no Seimitsuka* (*Making Thermosetting Macromolecules Precise*), published by C.M.C. K.K., 1968, Yuuji Harasaki, *Newest Binder Technology Handbook*, Chapter II-1, published by Sogo Gijutsu Center, 1985, Takayuki Ootsu, *Synthesis, Plan, and New Use Development of Acrylic Resins*, published by Chuubu Keiei Kaihatsu Center Shuppan Bu, 1985, Eizoo Oomori, *Functional Acrylic Resins*, published by Technosystem, 1985, etc.

Specific examples of such a functional group are —OH, —SH, —$NH_2$, —$NHR^{11}$ (wherein $R^{11}$ represents a hydrocarbon group and practically has the same meaning as R in formula (III)),

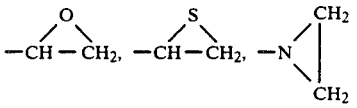

—$CONHCH_2OR^{12}$ (wherein $R^{12}$ represents a hydrogen atom or an alkyl group having from 1 to 8 carbon atoms (e.g., methyl, ethyl, propyl, butyl, hexyl, and octyl)), —N=C=O, and

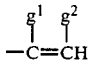

(wherein $g^1$ and $g^2$ each represents a hydrogen atom, a halogen atom (e.g., chlorine and bromine), or an alkyl group having from 1 to 6 carbon atoms (e.g., methyl and ethyl)).

Specific examples of the polymerizable double bond group described above are

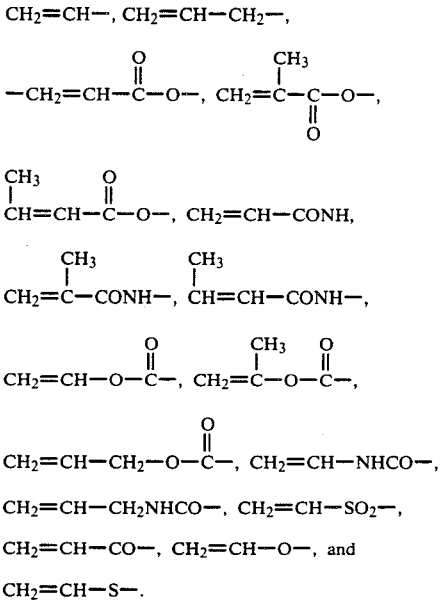

As a photo-curable functional group in this invention, there are functional groups described in Takahiro Tsunoda, Kankoosei Jushi (Photosensitive Resins), published by Insatu Gakkai Shuppan Bu, 1972, Mototaro Nagamatsu and Hideo Inui, *Kankoosei Koobunshi* (*Photosensitive Macromolecules*), published by Kodansha K.K., 1977, G. A. Delgenne, *Encyclopedia of Polymer Science and Technology, Supplement*, Vol. 1, 1976, etc.

Specific examples of such a functional group are addition polymer groups such as an allyl ester group, a vinyl ester group, etc., and dimerizing groups such as a cyannamoyl group, a maleimido ring group which may be substituted, etc.

The binder resin containing the heat- and/or photo-curable functional group for use in this invention can be produced by using a monomer having the heatand/or photo-curable functional group as a copolymer component having the heat- and/or photo-curable functional group.

When the binder resin for use in this invention has the thermosetting functional group, a reaction accelerator may be, if necessary, added thereto for accelerating the crosslinking reaction in the photosensitive In the case of a reaction system of forming a chemical bond between the functional groups, an organic acid (e.g., acetic acid, propionic acid, butyric acid, benzenesulfonic acid, and p-toluenesulfonic acid), a crosslinking agent, etc., can be used.

Practical examples of the crosslinking agent are described in Shinzo Yamashita and Toosuke Kanneko,

*Crosslinking Agent Handbook,* published by Taisei Sah, 1981. For example, there are crosslinking agents such as organic silanes, polyurethane, polyisocyanate, etc., and hardening agents such as epoxy resins, melamine resins, etc.

In the case of a polymeric reaction system, a polymerization initiator (e.g., peroxides and azobis series compounds, and preferably azobis series polymerization initiators) or a monomer having a polyfunctional polymeric group (e.g., vinyl methacrylate, allyl methacrylate, ethylene glycol diacrylate, polyethylene glycol diacrylate, divinylsuccinic acid ester, divinyladipinic acid ester, diallylsuccinic acid ester, 2-methylvinyl methacrylate, and divinylbenzene) can be used.

Also, in the case of using the binder resin having such a heat-curable functional group in this invention, a heat-curing treatment is applied to the resin. The heat-curing treatment can be applied by making severe the drying condition in the preparation of the light-sensitive material. For example, the light-sensitive material having the coated layer of the photoconductive composition may be dried for from 5 minutes to 120 minutes at a temperature of from 60° C. to 120° C. In this case, when the aforesaid reaction accelerator is used together, a milder condition can be . employed for drying the coated photoconductive layer. In this invention, when the binder resin contains at least one of the low molecular resins (AL) and (AL') each having a weight average molecular weight of from $1\times10^3$ to $2\times10^4$ and at least one of the high molecular weight resins (B), (C), and (D) each having a weight average molecular weight of from $5\times10^4$ to $5\times10^5$ described above, the mechanical strength of the electrophotographic light-sensitive material is further improved.

The use of the resin (B), (C), or (D) sufficiently increases the mechanical strength of the photoconductive layer when the mechanical strength of the photoconductive layer is insufficient by the resin (A) only.

Also, in the electrophotographic light-sensitive material of this invention using the low molecular resin (AL) and one of the high molecular resins (B), (C), and (D) together, the smoothness of the surface of the photoconductive layer is good in the case of using it as an electrophotographic lithographic printing master plate and since photoconductive particles such as zinc oxide particles are sufficiently dispersed in the binder resin, when the photoconductive layer is subjected to an oil-desensitizing treatment with an oil-desensitizing solution after imagewise exposure and processing, the non-image portions are sufficiently and uniformly rendered hydrophilic and sticking of a printing ink to the non-image portions at printing is inhibited, whereby no background staining occurs even by printing 10,000 prints.

That is, in this invention, when the resin (AL) and one of the resins (B) to (D) are used together, the binder resin is suitably adsorbed onto inorganic photoconductive particles and suitably coat the particles, whereby the film strength of the photoconductive layer is sufficiently kept.

In the resin (AL), the content of the macromonomer shown by the formula (I) to (IV) described above is from 40 to 70% by weight per 100 parts by weight of the resin (AL). Also, the weight average molecular weight of the resin (AL) is preferably from $1\times10^3$ to $1.5\times10^4$ and more preferably from $3\times10^3$ to $1.0\times10^4$.

Furthermore, in the resin (AL'), the content of the acid group bonded to the terminal of the main chain of the copolymer is preferably from 0.5% by weight to 10% by weight in 100 parts by weight of the resin (AL'). The weight average molecular weight of the resin (AL') and the content of the recurring unit corresponding to the macromonomer in the resin (AL') are the same as . those in the resin (AL) described above.

Then, the use of a combination of the low molecular weight resin (AL) and/or the low molecular weight resin (AL') having at least one of the aforesaid acid groups at the terminal of the main chain of the copolymer and the high molecular weight resin (B) having neither acid group nor basic group in the binder resin for use in this invention is described in detail.

The resin (B) which can be used in this invention is the resin having a weight average molecular weight of from $5\times10^4$ to $5\times10^5$ and having neither the aforesaid acid group (i.e., the acid group such as COOH or OH at the terminal of the grafted portion and the acid group at the terminal of the main chain in the resin (A)) nor a basic group at the terminal of the grafted portion and the terminal of the main chain of the copolymer. The weight average molecular weight of the resin is preferably from $8\times10^4$ to $3\times10^5$.

The glass transition point of the resin (B) is in the range of preferably from 0° C. to 120° C., and more preferably from 10° C. to 80° C.

Any resins (B) which are conventionally used as a binder resin for electrophotographic light-sensitive materials can be used in this invention solely or as a combination thereof. Examples of these resins are described in Harumi Miyahara and Hidehiko Takei, *Imaging,* Nos. 8 and 9 to 12, 1978 and Ryuuji Kurita and Jiroo Ishiwata, *Koobunshi* (*Macromolecule*), 17, 278–284(1958).

Specific examples of the resin (B) are an olefin polymer, an olefin copolymer, a vinyl chloride copolymer, a vinylidene chloride copolymer, a vinyl alkanoate polymer, a vinyl alkanoate copolymer, an allyl alkanoate polymer, an allyl alkanoate copolymer, styrene, a styrene derivative, a styrene polymer, a styrene copolymer, a butadiene-styrene copolymer, an isoprenstyrene copolymer, a butadiene-unsaturated carboxylic acid ester copolymer, an acrylonitrile copolymer, a methacrylonitrile copolymer, an alkyl vinyl ether copolymer, an acrylic acid ester polymer, an acrylic acid ester copolymer, a methacrylic acid ester polymer, a methacrylic acid copolymer, a styrene-acrylic acid ester copolymer, a styrene-methacrylic acid ester copolymer, an itaconic acid diester polymer, an itaconic acid diester copolymer, a maleic anhydride copolymer, an acrylamide copolymer, a methacrylamide copolymer, a hydroxy group-modified silicone resin, a polycarbonate resin, a ketone resin, an amide resin, a hydroxy group- or carboxy group-modified polyester resin, a butyral resin, a polyvinyl acetal resin, a cyclized rubber-methacrylic acid ester copolymer, a cyclized rubber-acrylic acid ester copolymer, a copolymer having a heterocyclic group containing no nitrogen atom (examples of the heterocyclic ring are furan, tetrahydrofuran, thiophene, dioxane, dioxolan, lactone, benzofuran, benzothiophene, and 1,3-dioxetane), and an epoxy resin.

More practically, as the resin (B), there are, for example, (meth)acrylic copolymers or polymers each containing at least one monomer shown by following formula (VI) as a (co)polymer component in a total amount of at least 30% by weight;

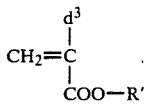

(VI)

wherein $d^3$ represents a hydrogen atom, a halogen atom (e.g., chlorine and bromine), a cyano group, or an alkyl group having from 1 to 4 carbon atoms, and is preferably an alkyl group having from 1 to 4 carbon atoms and R' represents an alkyl group having from 1 to 18 carbon atoms, which may be substituted (e.g., methyl, ethyl, propyl, butyl, pentyl, hexyl, octyl, decyl, dodecyl, tridecyl, tetradecyl, 2-methoxyethyl, and 2-ethoxyethyl), an alkenyl group having from 2 to 18 carbon atoms, which may be substituted (e.g., vinyl, allyl, isopropenyl, butenyl, hexenyl, heptenyl, and octenyl), an aralkyl group having from 7 to 14 carbon atoms, which may be substituted (e.g., benzyl, phenethyl, methoxybenzyl, ethoxybenzyl, and methylbenzyl), a cycloalkyl group having from 5 to 8 carbon atoms, which may be substituted (e.g., cyclopentyl, cyclohexyl, and cycloheptyl), or an aryl group (e.g., phenyl, tolyl, xylyl, mesityl, naphthyl, methoxyphenyl, ethoxyphenyl, chlorophenyl, and dichlorophenyl).

Furthermore, R' represents preferably an alkyl group having from 1 to 4 carbon atoms, an aralkyl group having from 7 to 14 carbon atoms, which may be substituted (particularly preferably benzyl, phenethyl, naphthylmethyl, and 2-naphthylethyl each may be substituted), or a phenethyl group or a naphthyl group, which may be substituted (examples of the substituent are chlorine, bromine, methyl, ethyl, propyl, acetyl, methoxycarbonyl, and ethoxycarbonyl and the phenethyl group or naphthyl group may have 2 or 3 substituents).

Furthermore, in the resin (B), a component which is copolymerized with the aforesaid (meth)acrylic acid ester may be other monomer than the monomer shown by formula (VI) and examples of the monomer are α-olefins, alkanic acid vinyl esters, alkanic acid allyl esters, acrylonitrile, methacrylonitrile, vinyl ethers, acrylamides, methacrylamides, styrenes, and heterocyclic vinyls (e.g., 5- to 7-membered heterocyclic rings having from 1 to 3 non-metallic atoms other than nitrogen atom (e.g., oxygen and sulfur) and practical examples are vinylthiophene, vinyldioxane, and vinylfuran).

Preferred examples of the monomer are alkanoic acid vinyl esters or alkanoic acid allyl esters each having from 1 to 3 carbon atoms, acrylonitrile, methacrylonitrile and styrene derivatives (e.g., vinyltoluene, butylstyrene, methoxystyrene, chlorostyrene, dichlorostyrene, bromostyrene, and ethoxystyrene).

On the other hand, the resin (B) for use in this invention does not have a basic group and examples of the basic group are an amino group and a nitrogen atom having heterocyclic group, which may have a substituent.

Then, the case of using a combination of the aforesaid low molecular weight resin (AL) and/or (AL') and the high molecular weight resin (C) having at least one of —OH and a basic group is explained in detail.

In the resin (C), the content of the copolymer component containing —OH and/or a basic group is from 0.05 to 15% by weight, and preferably from 0.5 to 10% by weight of the resin (C). The weight average molecular weight of the resin (C) is from $5\times10^4$ to $5\times10^5$, and preferably from $8\times10^4$ to $1\times10^5$. The glass transition point of the resin (C) is in the range of preferably from 0° C. to 120° C., and preferably from 10° C. to 80° C.

In this invention, it is considered that the OH component or the basic group component in the resin (C) has a weak interaction with the interface with the photoconductive particles and the resin (AL) or (AL') to stabilize the dispersion of the photoconductive particles and improve the film strength of the photoconductive layer after being formed. However, if the content of the component in the resin (C) is over 15% by weight, the photoconductive layer formed is liable to be influenced by moisture and the moisture resistance of the photoconductive layer is reduced. However, if the resin (C) has the aforesaid properties, conventionally known resins having such properties as described as to the resin (B) can be used.

Practically, the aforesaid (meth)acrylic copolymers each containing the monomer shown by formula (VI) describe above in a proportion of at least 30% by weigh as the copolymer component can be used as the resin (C).

As "the copolymer component containing —OH and/or a basic group" contained in the resin (C), any vinylic compounds each having the substituent (i.e., —OH and/or the basic group) copolymerizable with the monomer shown by aforesaid formula (VI) can be used.

As the aforesaid basic group, there are, for example, an amino group represented by following formula (VII) and a nitrogen-containing heterocyclic group.

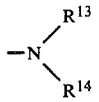

(VII)

wherein $R^{13}$ and $R^{14}$, which may be the same or different each represents an alkyl group which may be substituted (e.g., methyl, ethyl, propyl, butyl, hexyl, octyl, decyl, dodecyl, tertadecyl, octadecyl, 2-bromoethyl, 2-chloroethyl, 2-hydroxyethyl, and 3-ethoxypropyl), an alkenyl group which may be substituted (e.g., allyl, isopropenyl and 4-butenyl), an aralkyl group which may be substituted (e.g., benzyl, phenethyl, chlorobenzyl, methylbenzyl, methoxybenzyl, and hydroxybenzyl), an alicyclic group (e.g., cyclopentyl and cyclohexyl), or an aryl group (e.g., phenyl, tolyl, xylyl, mesityl, butylphenyl, methoxyphenyl, and chlorophenyl). Furthermore, $R^{13}$ and $R^{14}$ each may be bonded by a hydrocarbon group through, if desired, a hetero atom.

As the nitrogen-containing heterocyclic ring, there are, for example, 5- to 7-membered heterocyclic rings each containing from 1 to 3 nitrogen atoms and the heterocyclic ring may further form a condensed ring with a benzene ring, a naphthalene ring, etc. These heterocyclic rings may have a substituent.

Specific examples of the heterocyclic ring are pyrrole, imidazole, pyrazole, pyridine, piperazine, pyrimidine, pyridazine, indolizine, indole, 2H-pyrrole, 3H-indole, indazole, purine, morpholine, isoquinoline, phthalazine, naphthyridine, quinoxaline, acridine, phenanthridine, phenazine, pyrrolidine, pyrroline, imidazolidine, imidazoline, pyrazoline, piperidine, piperazine, quinacridine, indoline, 3,3-dimethylindolenine, 3,3-dimethylnaphthindolenine, thiazole, benzothiazole, naphthothiazole, oxazole, benzoxazole, naphthoxazole, selenazole, benzoselenazole, naphthoselenazole, oxazoline, isooxazoline, benzoxazole, morpholine, pyrrolidone, triazole, benzotriazole, and triazine.

The aforesaid copolymer component or monomer having —OH and/or the basic group is obtained by incorporating —OH and/or the basic group into the substituent of an ester derivative or amide derivative induced from a carboxylic acid or sulfonic acid having a vinyl group as described in *Koobunshi (Macromolecular) Data Handbook (Foundation)*, edited by Koobunshi Gakkai, published by Baifukan, 1986.

Specific examples of such a monomer (copolymer component) are 2-hydroxyethyl methacrylate, 3-hydroxypropyl methacrylate, 3-hydroxy 2-chloromethacrylate, 4-hydroxybutyl methacrylate, 6-hydroxyhexyl methacrylate, 10-hydroxydecyl methacrylate, N-(2-hydroxyethyl)acryl amide, N-(3-hydroxypropyl)methacrylamide, N-($\alpha,\beta$-dihydroxymethyl)ethylmethacrylamide, N-(4-hydroxybutyl)methacrylamide, N,N-dimethylaminoethyl methacrylate, 2-(N,N-diethylaminoethyl) methacrylate, 3-(N,N-dimethylpropyl) methacrylate, 2-(N,N-dimethylethyl)methacrylamide, hydroxystyrene, hydroxymethylstyrene, N,N-dimethylaminomethylstyrene, N,N-diethylaminomethylstyrene, N-butyl—N-methylaminomethylstyrene, and N-(hydroxyphenyl)-methacrylamide.

Examples of the vinyl compound having a nitrogen-containing heterocyclic ring are described in the aforesaid *Koobunshi Data Handbook (Foundation)*, pages 175–181, D. A. Tomalia, *Reactive Heterocyclic Monomers*, Chapter 1 of Functional Monomers, Vol. 2, Marcel DeRRer Inc., N.Y., 1974, and L. S. LusRin, *Masic Monomers*, Chapter 3 of *Functional Monomers*, Vol. 2, Marcel DeRRer Inc., N.Y., 1974.

Furthermore, the resin (C) may contain other monomer than the aforesaid monomer having —OH and/or the basic group in addition to the latter monomer as a copolymer component. Examples of such a monomer are those practically illustrated above as the monomers which can be used as other copolymer component for the resin (B).

Then, a case of using a combination of the aforesaid low molecular weight resin (AL) and/or (AL') and the high molecular weight resin (D) having an acid group as the side chain of the copolymer component at a content of less than 50%, and preferably less than 30% of the content of the acid group contained in the resin (AL') or an acid group having larger pKa than that of the acid group contained in the resin (AL') as the side chain of the copolymer component is explained in detail.

The weight average molecular weight of the resin (D) is from $5\times10^4$ to $5\times10^5$, and preferably from $7\times10^4$ to $4\times10^5$.

The acid group contained at the side chain of the copolymer in the resin (D) is preferably contained in the resin (D) at a proportion of from 0.05 to 3% by weight and more preferably from 0.1 to 1.5% by weight. Also, it is preferred that the acid group is incorporated in the resin (D) in a combination with the acid group in the resin (AL') shown in Table A below.

TABLE A

| Acid Group in Resin (AL') | Acid Group in Resin (D) |
|---|---|
| $-SO_3H$ and/or $-PO_3H_2$ | $-COOH$ |
| $-SO_3H$, $-PO_3H_2$ and/or $-COOH$ | $-\overset{\overset{O}{\|}}{\underset{\underset{OH}{\|}}{P}}-OR^o$ |

The glass transition point of the resin (D) is in the range of preferably from 0° C. to 120° C., more preferably from 0° C. to 100° C., and far more preferably from 10° C. to 80° C.

The resin (D) shows a very weak interaction for photoconductive particles as compared to the resin (AL) and/or (AL'), has a function of mildly coating the particles, and sufficiently increases the mechanical strength of the photoconductive layer when the strength thereof is insufficient by the resin (AL) or (AL') only without reducing the function of the resin (AL) or (AL').

If the content of the acid group at the side chain of the resin (D) is over 3% by weight, the adsorption of the resin (D) onto photoconductive particles occurs to destroy the dispersion of the photoconductive particles and to form aggregates or precipitates, which results in causing a state of not forming coated layer or greatly reducing the electrostatic characteristics of the photoconductive particles even if the coated layer is formed. Also, in such a case, the surface property of the photoconductive layer is roughened to reduce the strength to mechanical friction.

Practical examples of $R^o$ in $$-\overset{\overset{O}{\|}}{\underset{\underset{OH}{\|}}{P}}-OR^0$$

in the resin are an alkyl group having from 1 to 12 carbon atoms, which may be substituted (e.g., methyl, ethyl, propyl, butyl, hexyl, octyl, decyl, dodecyl, 2-chloroethyl, 2-methoxyethyl, 2-ethoxyethyl, and 3-methoxypropyl), an aralkyl group having from 7 to 12 carbon atoms, which may be substituted (e.g., benzyl, phenethyl, chlorobenzyl, methoxybenzyl, and methylbenzyl), an alicyclic group having from 5 to 8 carbon atoms, which may be substituted (e.g., cyclopentyl and cyclohexyl), and an aryl group which may be substituted (e.g., phenyl, tolyl, xylyl, mesityl, naphthyl, chlorophenyl, and methoxyphenyl).

As the resin (D), conventional known resins having the aforesaid properties can be used in this invention and, for example, the conventionally known resins described above in regard to the resin (B) can be used.

More practically, as examples of the resin (D), there are (meth)acrylic copolymers each containing the aforesaid monomer shown by formula (V) described above as the copolymer component in a proportion of at least 30% by weight of the copolymer.

Also, as "the copolymer component having an acid group" in the resin (D) for use in this invention, any acid group-containing vinyl compounds copolymerizable with the monomer shown by the aforesaid formula (VI) can be used. For example, such vinyl compounds are described in *Koobunshi Data Handbook (Foundation)*, edited by Koobunshi Gakkai, 1986. Practical examples of the vinyl compound are acrylic acid, $\alpha$- and- /or β-substituted acrylic acid (e.g., α-acetoxy compound, α-acetoxymethyl compound, α-(2-amino)-methyl compound, α-chloro compound, α-bromo compound, α-fluoro compound, α-tributylsyrlyl compound, α-cyano compound, β-chloro compound, β-bromo compound, α-chloro-β-methoxy compound, α,β-dichloro compound), methacrylic acid, itaconic acid, itaconic acid half esters, itaconic acid half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-ethyl-2-octenoic acid), maleic acid, maleic acid half esters, maleic acid half amides, vinylbenzenecarboxylic acid, vinylbenzenesulfonic acid, vinylsulfonic acid, vinylphosphonic acid, half ester derivatives of the vinyl group or allyl group of dicarboxylic acids, and ester derivatives or amide derivatives of these carboxylic acids or sulfonic acids having the acid group in the substituent thereof.

Practical examples of these compounds are illustrated below. In addition, in the following formulae, e represents —H, —$CH_3$, —Cl, —Br, —CN, —$CH_2COOCH_3$, or —$CH_2COOH$; f represents —H or —$CH_3$, $n^1$ represents an integer of from 2 to 18; $m^1$ represents an integer of from 1 to 12; and $l^1$ represents an integer of from 1 to 4. In Compound (14), $m^1$'s may be the same or different.

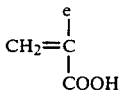
(1)

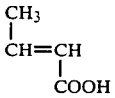
(2)

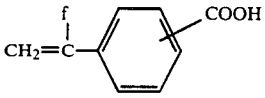
(3)

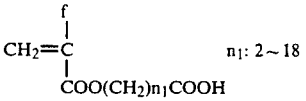
(4)

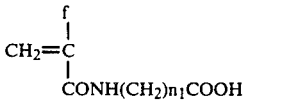
(5)

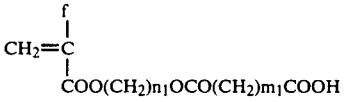
(6)

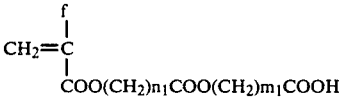
(7)

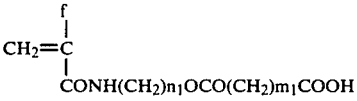
(8)

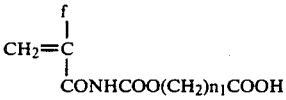
(9)

-continued

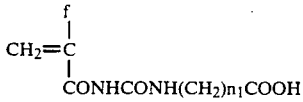
(10)

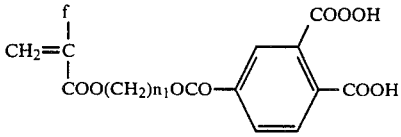
(11)

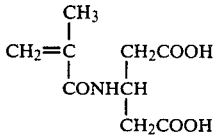
(12)

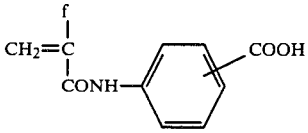
(13)

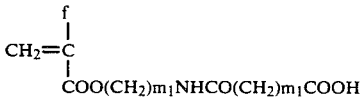
(14)

(15)

(16)

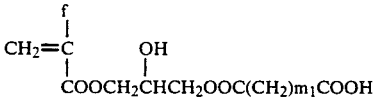
(17)

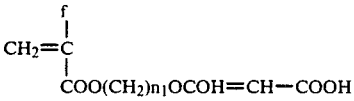
(18)

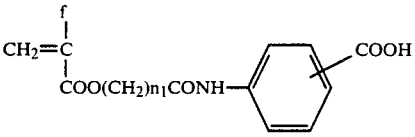
(19)

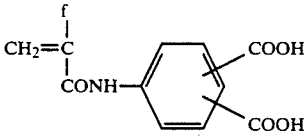
(20)

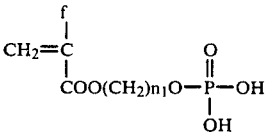
(21)

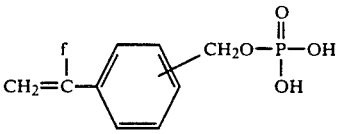
(22)

-continued (23)

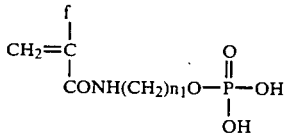

(24)

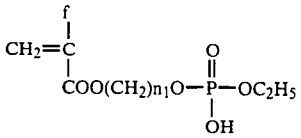

(25)

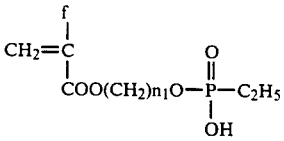

(26)

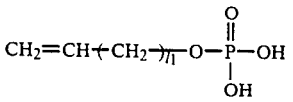

(27)

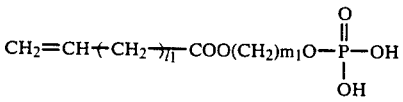

(28)

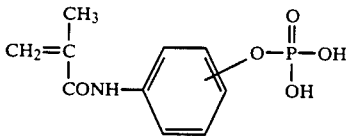

(29)

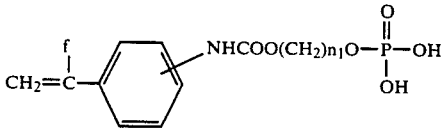

(30)

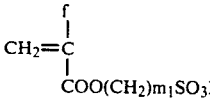

(31)

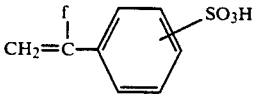

(32)

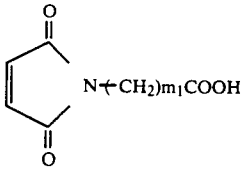

(33)

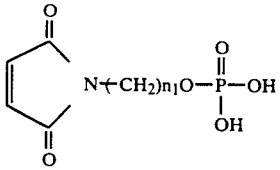

(34)

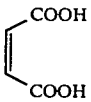

-continued (35)

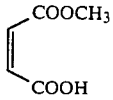

(36)

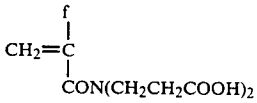

(37)

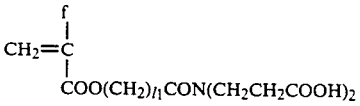

(38)

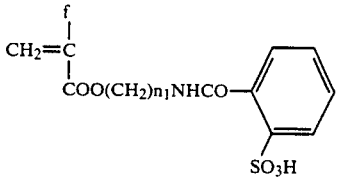

(39)

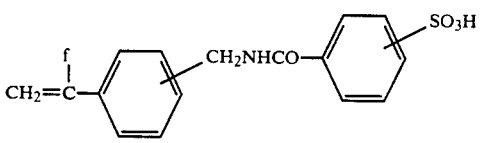

(40)

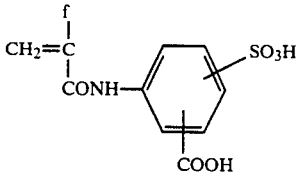

(41)

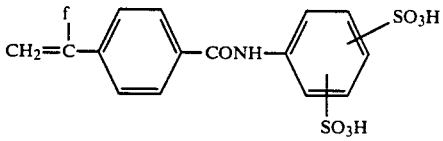

Furthermore, the resin (D) for use in this invention may further contain other component together with the aforesaid monomer shown by formula (V) and the aforesaid monomer having an acid group as other copolymer component. Practical examples of such a monomer are the monomers illustrated above as the monomers which can be contained in the resin (B) as other copolymer component.

Moreover, the binder resin for use in this invention may further contain other resin(s) in addition to the resin (AL) or (AL') and the resin (B), (C) or (D). Examples of other resin are alkyd resins, polybutyral resins, polyolefins, ethylene-vinyl acetate copolymers, styrene resins, styrene-butadiene resins, acrylate-butadiene resins, and vinyl alkenoate resins.

However, the content of other resin(s) must be less than 30% by weight of the resins (AL) or (AL') and (B), (C) or (D) since in this case, the effect (in particular, the improvement of electrostatic characteristics) of this invention will be lost.

The compounding ratio of the resin (AL) or (AL') to the resin (B), (C), or (D) differs according to the kind of an inorganic photoconductor being used, the particle sizes of the photoconductive particles, and the surface state thereof but is generally from 5 to 80 to from 95 to 20 by weight, and preferably from 15 to 60 to from 85 to 40 by weight.

The ratio of the weight average molecular weight of the resin (AL) or (AL') to that of the resin (B), (C), or (D) is preferably at least 1.2, and more preferably at least 2.0.

In other embodiment of this invention, the binder resin for use in this invention contains the aforesaid low molecular weight resin (A) having a weight average molecular weight of from $1.0\times10^3$ to $2.0\times10^4$ and containing at least one of the polyester type macromonomers shown by formula (I), (II), (III), and (IV) described above and at least one of a heat- and/or photo-curable resin (E) and a crosslinking agent (F).

Then, the aforesaid embodiment of this invention is explained in detail.

The resin (E) for use in this invention is a thermosetting resin having a crosslinking functional group, i.e., a functional group causing a crosslinking reaction by the action of at least one of heat and light to form crosslinkage among polymers and preferably forms a crosslinking structure by causing a reaction with the aforesaid functional group capable of being contained in the resin (A).

That is, a reaction system of causing by heat and/or light bonding between molecules by a condensation reaction or addition reaction, or crosslinking by a polymerization reaction is utilized in the aforesaid embodiment.

As practical examples of the thermosetting functional group, there are at least one combination of the functional groups selected from the group consisting of a functional group (e.g., —OH, —SH, and —NHR[13] (wherein R[13] represents a hydrogen atom, an aliphatic group having from 1 to 12 carbon atoms, which may be substituted, or an aryl group which may be substituted)) and

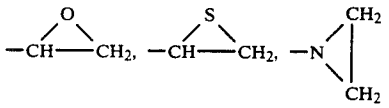

—NCO, —NCS, and a cyclic dicarboxylic acid anhydride; —CONHCH$_2$OR[14] (wherein R[14] represents a hydrogen atom or an alkyl group having from 1 to 6 carbon atoms (e.g., methyl, ethyl, propyl, butyl, hexyl)); and polymerizable double bond groups.

Preferred examples of the functional group having a dissociative hydrogen atom are —OH, —SH, and —NHR[13].

Practical examples of the polymerizable double bond group are

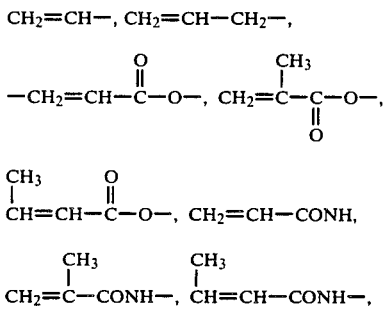

-continued

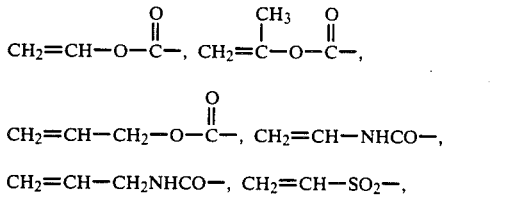

As the photo-curable functional group, the functional groups described, e.g., in Takahiro Tsunoda, *Kankosei Jushi* (*Photosensitive Resins*), published by Insatsu Gakkai Shuppan Bu, 1972, Gentaro Nagamatsu and Hideo Inui, *Kankosei Koobunshi* (*Photosensitive Polymer*), published by Koodansha K.K., 1977, and G. A. Delgenne, *Encyclopedia of Polymer Science and Technology, Supplement,* Vol. 1, 1976.

Practical examples of the photo-curable functional group are addition polymer groups such as an allyl ester group, a vinyl ester group and dimerizing groups such as cinnamoyl group and a maleiimide ring group which may be substituted.

Polymers or copolyers each having the aforesaid functional group are illustrated as examples of the resin (E) for use in the aforesaid embodiment of this invention.

As such polymers or copolymers, there are conventionally known resins described in Tsuyoshi Endo, *Netsu Kokasei Kobunshi no Seimitsuka* (*Making Thermosetting Macromolecules Precise*), published by C.M.C., 1986, Yuuji Harasaki, *Newest Binder Technology Handbook,* Chapter II-1, published by Soogo Gijutsu Center, 1985, Takayuki Ootsu, *Synthesis, Plan, and New Use Development of Acryl Resin,* published by Chuubu Keiei Kaihatsu Center, 1985, and *Kinoosei* (*Functional*) *Acrylic Resins,* published by Techno System, 1985.

For example, there are polyester resins, unmodified epoxy resins, polycarbonate resins, vinylalkanoate resins, modified polyamide resins, phenol resins, modified alkyd resins, melamine resins, acryl resins, and styrene resins.

These resins may contain the aforesaid functional group capable of causing a crosslinking reaction. These resins may or may not contain therein the acid group as described above as to the resin (A').

As practical examples of the monomer corresponding to the copolymer component having the functional group, there are vinylic compounds each having the functional group. Practical examples are described in *Kobushi (Polymer) Data Handbook,* edited by Kobunshi Gakkai, published by Baifuukan, 1986.

Specific examples of the vinylic compound are α- and/or β-substituted acrylic acid (e.g., α-acetoxy compound, α-acetoxymethyl compound, α-(2-amino)-methyl compound, α-chloro compound, α-bromo compound, α-fluoro compound, α-tributylsilyl compound, α-cyano compound, β-chloro compound, β-bromo compound, α-chloro-β-methoxy compound, and α,β-dichloro compound), methacrylic acid, itaconic acid, itaconic acid half esters, itaconic acid half amide, crotonic acid, 2-alkenylcarboxylic acids (e.g., 2-pentenoic acid, 2-methyl-2-hexenoic acid, 2-octenoic acid, 4-methyl-2-hexenoic acid, and 4-ethyl-2-octenoic acid), maleic acid, maleic acid half esters, maleic acid half amides, vinylbenzenecarboxylic acid, vinylbenzenesulfonic acid, vinylsulfonic acid, vinylphosphonic acid, half ester derivatives of the vinyl group or allyl group of dicarboxylic acids, and vinyl compounds having the aforesaid functional group in the substituent of the ester or amide derivatives of these carboxylic acids or sulfonic acid, or the substituent of styrene derivatives.

More practical examples of the resin (E) are (meth)acrylic copolymers each having a monomer represented by following formula (VIII) at a content of at least 30% by weight of the copolymer as a copolymer component;

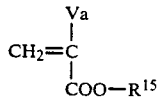

(VIII)

wherein Va represents a hydrogen atom, a halogen atom (e.g., chlorine and bromine), a cyano group, or an alkyl group having from 1 to 4 carbon atoms and $R^{15}$ represents an alkyl group having from 1 to 18 carbon atoms, which may be substituted (e.g., methyl, ethyl, propyl, butyl, pentyl, hexyl, octyl, decyl, dodecyl, tridecyl, tetradecyl, 2-methoxyethyl, and 2-ethoxyethyl), an alkenyl group having from 2 to 18 carbon atoms, which may be substituted (e.g., vinyl, allyl, isopropenyl, butenyl, hexanyl, heptenyl, and octenyl), an aralkyl group having from 7 to 12 carbon atoms, which may be substituted (e.g., benzyl, phenethyl, methoxybenzyl, ethoxybenzyl, and methylbenzyl), a cycloalkyl group having from 5 to 8 carbon atoms, which may be substituted (e.g., cyclopentyl, cyclohexyl, and cycloheptyl), or an aryl group which may be substituted (e.g., phenyl, tolyl, xylyl, mesityl, naphthyl, methoxyphenyl, ethoxyphenyl, chlorophenyl, and dichlorophenyl).

The content of "the copolymer component having a crosslinkable (crosslinking) functional group" in the resin (E) is preferably from 0.5 to 40 mol %.

The weight average molecular weight of the resin (E) is preferably from $1\times10^3$ to $1\times10^5$, and more preferably from $5\times10^3$ to $5\times10^4$.

The compounding ratio of the resin (A) to the resin (E) differs according to the kind of the inorganic photoconductor being used, the particle sizes of the photoconductive particles, and the surface state thereof but is generally from 5 to 80 to from 95 to 20 by weight, and preferably from 10 to 50 to from 90 to 50 by weight ratio.

On the other hand, as the crosslinking agent (F) for use in the aforesaid embodiment of this invention, compounds which are usually used as crosslinking agents can be used. Practical examples thereof are described in Sinzoo Yamashita and Toosuke Kaneko, *Kakyo Zai (Crosslinking Agent) Handbook*, published by Taisei Sha, 1981 and *Koobunshi Data Handbook (Foundation)*, edited by Koobunshi Gakkai, published by Baifukan 1986.

Specific examples thereof are organic silane series compounds a (e.g., silane coupling agents such as vinyltrimethoxysilane, vinyltributoxysilane, γ-glycidoxypropyltrimethoxysilane, γ-mercaptopropyltriethoxysilane, and γ-aminopropyltriethoxysilane), polyisocyanate series compounds (e.g., toluylene diisocyanate, α-toluylene diisocyanate, diphenylmethane diisocyanate, triphenylmethane triisocyanate, polymethylene polyphenyl isocyanate, hexamethylene diisocyanate, isophorone diisocyanate, and high molecular polyisocyanate), polyol series compounds (e.g., 1,4-butanediol, polyoxypropylene glycol, and 1,1,1-trimethylolpropane), polyamine series compounds (e.g., ethylenediamine, γ-hydroxypropylated ethylenediamine, phenylenediamine, hexamethylenediamine, N-aminoethylpiperazine, and modified aliphatic polyamines), polyepoxy group-containing compounds and epoxy resins (e.g., the compounds described in Hiroshi Kakiuchi, *New Epoxy Resins*, published by Shokodo, 1985, and Kuniyuki Hashimoto, *Epoxy Resins*, published by Nikkan Kogyo Shinbun Sha, 1969), melamine resins (e.g., the compounds described in Ichiro Miwa and Hideo Matsunaga, *Urea. Melamine Resins*, published by Nikkan Kogyo Shinbun Sha, 1969), and poly(meth)acrylate series compounds (e.g., the compounds described in Shin Oogawara, Takeo Saegusa, and Toshinobu Higashimura, *Oligomers*, published by Koodan Sha, 1976 and Eizo Ohmori, *Functional Acrylic Resin*, published by Techno System, 1985.

Specific examples of the crosslinking agent are polyethylene glycol diacrylate, neopentyl glycol diacrylate, 1,6-heanediol acrylate, trimethylolpropane triacrylate, pentaerythritol polyacrylate, bisphenol A diglycidyl ether diacrylate, oligoester acrylate, and the corresponding methacrylate compounds of them.

The amount of the crosslinking agent (F) for use in this invention is preferably from 0.5 to 30% by weight and more preferably from 1 to 10% by weight based on the amount of the total binder resins.

In this invention, a reaction accelerator may be, if necessary, added to the binder resin for accelerating the crosslinking reaction in the photoconductive layer.

In the case of a reaction system that the crosslinking reaction forms a chemical bond between the functional groups, an organic acid (e.g., acetic acid, propionic acid, butyric acid, benzenesulfonic acid, and p-toluenesulfonic acid) is used as the reaction accelerator.

When the crosslinking reaction is a polymerization reaction system, polymerization initiators (e.g., peroxides and azobis series polymerization initiators, and preferably azobis series polymerization initiators) and monomers having a polyfunction polymerizable group (e.g., vinyl methacrylate, allyl methacrylate, ethylene glycol diacrylate, polyethylene glycol diacrylate, divinylsuccinic acid esters, divinyladipic acid esters, diallylsuccinic acid esters, 2-methylvinyl methacrylate, and divinylbenzene) can be used as the reaction accelerator.

Furthermore, in the aforesaid embodiment of this invention, resin(s) other than the aforesaid resins can be used in the binder resin. Examples of such resins are alkyd resin, polybutyral resins, polyolefin resins, ethylene-vinyl acetate copolymers, styrene resins, styrenbutadiene resins, acrylate-butadiene resins, and vinyl alkanoate resins.

The proportion of aforesaid other resin must not be over 30% by weight of the total binder resins and if the proportion exceeds 30% by weight, the effects (particularly, the improvement of electrostatic characteristics) of this invention will be lost.

The binder resin for use in this invention is crosslinked or thermally cured after coating the resin as a photoconductive layer. For performing crosslinking or heat-curing, a severer drying condition than conventional drying condition is employed at the formation of the photoconductive layer. For example, a higher drying temperature and/or a longer drying time is employed. Also, after evaporating the solvent in the coated layer by drying, the coated layer is preferably subjected to a heat treatment. For example, the coated layer is dried for from 5 to 120 minutes at a temperature of from 60° C. to 120° C. In this case, by using the aforesaid reaction accelerator, a milder drying condition can be employed.

Also, crosslinking is preferably performed between the aforesaid resins for use in this invention but may be performed between the aforesaid resin(s) and other resin. In the latter case, it is preferred that the resin(s) for use in this invention are crosslinked with other resin having a weight average molecular weight of at least $2\times10^4$.

As the inorganic photoconductor for use in this invention, there are zinc oxide, titanium oxide, zinc sulfide, cadmium sulfide, cadmium carbonate, zinc selenide, cadmium selenide, tellurium selenide, lead sulfide, etc.

The total proportion of the binder resins for the photoconductive layer in this invention is from 10 to 100 parts by weight, and preferably from 15 to 50 parts by weight per 100 parts by weight of the photoconductor.

In this invention, various kinds of dyes can be used, if necessary, for the photoconductive layers as spectral sensitizers. Examples of these dyes are carbonium series dyes, diphenylmethane dyes, triphenylmethane dyes, xanthene series dyes, phthalein series dyes, polymethine dyes (e.g., oxonol dyes, merocyanine dyes, cyanine dyes, rhodacyanine dyes, and styryl dyes), and phthalocyanine dyes (inclusive of metallized dyes) described in Harumi Miyamoto and Hidehiko Takei, *Imaging,* 1973 (No. 8), page 12 C. J. Young, et al, *RCA Review,* 15, 469(1954), Koohei Koyoda, *Journal of Electric Communication Society of Japan, J63 C (No.* 2), 97(1980), Yuuji Harasaki et al, *Kogyo Kagaku Zasshi,* 66, 78 and 188(1963), and Tadaki Tani, *Journal of the Society of Photographic Science and Technology of Japan,* 35, 208(1972).

Specific examples of suitable carbonium series dyes, triphenylmethane dyes, xanthene series dyes, and phthalein series dyes are described in JP-B-51-452, JP-A-50-90334, JP-A-50-114227, JP-A-53-39310, JP-A-53-82353, and JP-A-57-16455, and U.S. Pat. Nos. 3,052,540 and 4,054,450.

Also, suitable oxonol dyes, merocyanine dyes, cyanine dyes, and rhodacyanine dyes are more practically described in U.S. Pat. Nos. 3,047,384, 3,110,591, 3,121,008, 3,125,447, 3,128,179, 3,132,942, and 3,622,317, British Patents 1,226,892, 1,309,274, and 1,405,898, and JP-B-48-7814 and JP-B-55-18892.

Furthermore, polymethine dyes capable of spectrally sensitizing in the wavelength region of from near infrared to infrared longer than 700 nm are described in JP-B-51-41061, JP-A-47-840, JP-A-47-44180, JP-A-49-5034, JP-A-49-45122, JP-A-57-46245, JP-A-56-35141, JP-A-57-157254, JP-A-61-26044, and JP-A-61-27551, U.S. Pat. Nos. 3,619,154 and 4,175,956, and *Research Disclosure,* 216, 117–118(1982).

The light-sensitive material of this invention is excellent in that even when various sensitizing dyes are used for the photoconductive layer, the performance thereof is reluctant to vary by such sensitizing dyes.

If desired, the photoconductive layers may further contain various additives commonly employed in electrophotographic photoconductive layers, such as chemical sensitizers. Examples of such additives are electron-acceptive compounds (e.g., halogen, benzoquinone, chloranil, acid anhydrides, and organic carboxylic acids) described in *Imaging,* 1973, (No. 8), page 12, and polyarylalkane compounds, hindered phenol compounds, and p-phenylenediamine compounds described in Hiroshi Komon, *Recent Photoconductive Materials and Development and Practical Use of Light-sensitive Materials,* Chapters 4 to 6, published by Nippon Kagaku Jooho K.K., 1986.

There is no particular restriction on the amount of these additives but the amount thereof is usually from 0.0001 to 2.0 parts by weight per 100 parts by weight of the photoconductive material.

The thickness of the photoconductive layer is from 1 μm to 100 μm, and preferably from 10 μm to 50 μm.

Also, when the photoconductive layer is used as a charge generating layer of a double layer type electrophotographic light-sensitive material having the charge generating layer and a charge transporting layer, the thickness of the charge generating layer is from 0.01 μm to 1 μm, and preferably from 0.05 μm to 0.5 μm.

As the case may be, an insulating layer is formed on the photoconductive layer for the protection of the photoconductive layer and the improvement of the durability and the dark decay characteristics of the photoconductive layer. In this case, the thickness of the insulating layer is relatively thin but when the light-sensitive material is used for a specific electrophotographic process, the insulating layer having a relatively thick thickness is formed.

In the latter case, the thickness of the insulating layer is from 5 μm to 70 μm, and particularly from 10 μm to 50 μm.

As the charge transporting material for the double layer type light-sensitive material, there are polyvinylcarbazole, oxazole series dyes, pyrazoline series dyes, and triphenylmethane series dyes The thickness of the charge transfer layer is from 5 μm to 40 μm, and preferably from 10 μm t 30 μm.

Resins which can be used for the insulating layer and the charge transfer layer typically include thermoplastic and thermosetting resins such as polystyrene resins, polyester resins, cellulose resins, polyether resins, vinyl chloride resins, vinyl acetate resins, vinyl chloride-vinyl acetate copolymer resins, polyacryl resins, polyolefin resins, urethane resins, epoxy resins, melamine resins, and silicon resins.

The photoconductive layer in this invention can be formed on a conventional support. In general, the support for the electrophotographic light-sensitive material is preferably electroconductive. As the conductive support, there are base materials such as metals papers, plastic sheets, etc., rendered electroconductive by the impregnation of a low resisting material, the base materials the back surface of which (the surface opposite to the surface of forming a photoconductive layer) is rendered electroconductive and having coated with one or more layer for preventing the occurrence of curling of the support, the aforesaid support having formed on the surface a water resisting adhesive layer, the aforesaid layer having formed on the surface at least one precoat, and a support formed by laminating thereon a plastic film rendered electroconductive by vapor depositing thereon an aluminum, etc.

Practical examples of electroconductive base materials and conductivity-imparting materials are described in Yukio Sakamoto, *Denshi Shashin (Electrophotography),* 14 (No. 1), 2–11 (1975), Hiroyui Moriga, *Chemistry of Specific Papers,* published by Koobunshi Kankoo Kai, 1975, M. F. Hoover, *J. Macromol. Sci. Chem.*, A-4 (6), 1327–1417 (1970).

The following examples and intended to illustrate the present invention but not to limit it in any way.

SYNTHESIS EXAMPLE OF MACROMONOMER: MM-1

A mixture of 90.1 g of 1,4-butandiol, 105.1 g of succinic anhydride, 1.6 g of p-toluenesulfonic acid monohydrate, and 200 g of toluene was refluxed with stirring in a flask equipped with a Dean-Stark refluxing condensor for 4 hours. The amount of water azeotropically distilled off with toluene was 17.5 g.

Then, after adding a mixture of 17.2 g of acrylic acid and 150 g of toluene, and 1. og t-butylhydroquinone to the aforesaid reaction mixture, the reaction was carried out for 4 hours with sitrring under refluxing. After cooling to room temperature, the reaction mixture was precipitated in 2 liters of methanol and solids thus precipitated were collected by filtration and dried under reduced pressure to provide 135 g of the desired macromonomer (MM-1) having a weight average molecular weight of $6.8\times10^3$.

$$CH_2{=}CH{-}COO\left[(CH_2)_4{-}OCO(CH_2)_2{-}COO\right]H \qquad \text{(MM-1)}$$

SYNTHESIS 2 OF MACROMONOMER: MM-2

A mixture of 120 g of 1,6-hexanediol, 114.1 g of glutaric acid anhydride, 3.0 g of p-toluenesulfonic acid mono-hydrate, and 250 g of toluene was refluxed under the same condition as in Synthesis Example 1 of macromonomer. The amount of water azeotropically distilled off was 17.5 g.

After cooling to room temperature, the reaction mixture was precipitated in 2 liters of n-hexane and after removing a liquid phase by decantation, the solid precipitates were collected and dried under reduced pressure.

The aforesaid reaction product was dissolved in toluene and the content of a carboxy group was determined by a neutralization titration method with a methanol solution of 0.1 N potassium hydroxide. The content was 500 mole/g.

A mixture of 100 g of the aforesaid solid product, 8.6 g of methacrylic acid, 1.0 g of t-butylhydroquinone, and 200 g of methylene chloride was stirred at room temperature to dissolve the solid product. Then, a mixture of 20.3 g of dicyclohexylcarbodiimide (D.C.C.), 0.5 g of 4-(N,N-dimethyl)aminopyridine, and 100 g of methylene chloride was added dropwise to the aforesaid mixture was stirring over a period of one hour followed by further stirring for 4 hours as it was.

With the titration of the D.C.C. solution, insoluble crystals deposited. The reaction mixture was filtered through a 200 mesh nylon cloth to remove the insoluble matters.

The filtrate was re-precipitated in 2 liters of hexane and powder thus precipitated was collected by filtration. To the powder was added 500 ml of acetone and after stirring the mixture for one hour, insoluble matters were subjected to a natural filtration using a filter. After concentrating the filtrate at reduced pressure to ½ of the original volume, the solution thus concentrated was added to 1 liter of ether and the mixture was stirred for one hour. Solids thus deposited were collected by filtration and dried under reduced pressure.

Thus, 53 g of the desired macromonomer (MM-2) having a weight average molecular weight of $8.2\times10^3$ was obtained.

$$CH_2{=}\overset{\overset{CH_3}{|}}{C}{-}COO\left[(CH_2)_6OCO(CH_2)_5COO\right]H \qquad \text{(MM-2)}$$

SYNTHESIS EXAMPLE 3 OF MACROMONOMER: MM-3

In an oil bath kept at an outside temperature of 150° C. was stirred 500 g of 12-hydroxystearic acid at reduced pressure of from 10 to 15 mmHg for 10 hours while distilling off water produced. The content of a carboxy group of the liquid product obtained was 600 mole/g.

A mixture of 100 g of the aforesaid liquid product, 18.5 g of methacrylic acid anhydride, 1.5 g of t-butylhydroquinone, and 200 g of tetrahydrofuran was stirred for 6 hours at a temperature of from 40° C. to 45° C. and the reaction mixture obtained was added dropwise to 1 liter of water with stirring over a one hour period followed by stirring for further one hour. The mixture was allowed to stand, the sediment thus formed was collected by decantation, dissolved in 200 g of tetrahydrofuran, and precipitated in one liter of methanol. The sediment thus formed was collected by decantation and dried under reduced pressure to provide 62 g of the desired macromonomer (MM-3) having a weight average molecular weight of $6.7\times10^3$.

(MM-3):

$$CH_2{=}\underset{\underset{COO}{|}}{\overset{\overset{CH_3}{|}}{C}}\quad \overset{\overset{C_6H_{13}}{|}}{CH}(CH_2)_{10}{-}COO\left]H\right.$$

SYNTHESIS EXAMPLE 4 OF MACROMONOMER: MM-4

According to the synthesis method described in S. Penczek et al, *Makromol. Chem.*, 188, 1347(1987), the macromonomer (MM-4) having the following structure was synthesized.

$$CH_2{=}\underset{\underset{COO}{|}}{\overset{\overset{CH_3}{|}}{C}}\left[(CH_2)_5COO\right]H$$

Weight average molecular weight: $7.3\times10^3$

SYNTHESIS EXAMPLE 5 OF MACROMONOMER: MM-5

A mixture of 90.1 g of 1,4-butanediol, 105.1 g of succinic anhydride, 1.6 g of p-toluenesulfonic acid monohydrate, and 200 g of toluene was refluxed in a flask equipped with a Dean-Stark refluxing condensor with stirring for 4 hours. The amount of water-azeotropically distilled off with toluene was 17.5 g.

Then, after adding a mixture of 21.2 g of 2-hydroxyethyl methacrylate and 150 g of toluene, and 1.0 g of t-butylhydroquinone to the reaction mixture obtained, a mixture of 33.5 g of dicyclohexylcarbodimide (D.C.C.), 1.0 g of 4-(N,N-dimethylamino)pyridine, and 100 g of methylene chloride was added dropwise to the above mixture with stirring over a one hour period followed by stirring for further 4 hours as they were.

The reaction mixture was filtered through a 200 mesh nylon cloth to filtrate off insoluble matters. The filtrate was precipitated in 200 g of methylene chloride and a powder thus formed was collected by filtration. The powder was dissolved in 200 g of methylene chloride and the solution was re-precipitated in 3 liters of methanol. The powder thus formed was collected by filtration and dried under reduced pressure to provide 103 g of the desired macromonomer (MM-5) having a weight average molecular weight of $6.3\times10^3$.

(MM-5):

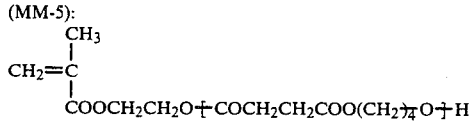

SYNTHESIS EXAMPLE 6 OF MACROMONOMER: MM-6

A mixture of 120 g of 1,6-hexanediol, 114.1 g of glutaric anhydride, 3.0 g of p-toluenesulfonic acid monohydrate, and 250 g of toluene was refluxed as in Synthesis Example 1. The amount of water azeotropically distilled off was 17.5 g.

After cooling to room temperature, the reaction mixture was precipitated in 2 liters of n-hexane and after removing a liquid phase by decantation, the sediment thus formed was collected and dried under reduced pressure.

The reaction product thus obtained was dissolved in toluene and the content of a carboxy group was determined by a neutralization titration method using a methanol solution of 0.1 N potassium hydroxide. The content was 500 mole/g.

A mixture of 100 g of the above solid product, 10.7 g of glycidyl methacrylate, 1.0 g of t-butylhydroquinone, 1.0 g of N,N-dimethyldodecylamine, and 200 g of xylene was stirred for 5 hours at 140° C. After cooling, the reaction mixture was re-precipitated in 3 liters of n-hexane and after removing the liquid phase by decantation, the sediment was collected and dried under reduced pressure.

When the content of remaining carboxy group of the macromonomer obtained was determined by the aforesaid neutralization titration method, the content was 8 m/g and the conversion was 99.8%.

Thus, 63 g of the desired macromonomer (MM-6) having a weight average molecular weight ob $7.6\times10^3$ was obtained.

(MM-6):

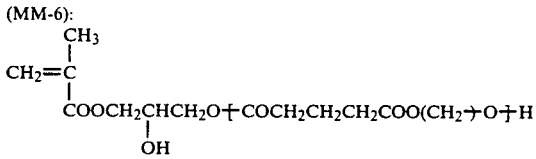

SYNTHESIS EXAMPLE 7 OF MACROMONOMER: MM-7

To a mixture of 10 g of the polyester oligomer obtained in Synthesis Example 6, 200 g of methylene chloride, and 1 ml of dimethylformamide was added dropwise 15 g of thionyl chloride was stirring at a temperature of from 25° C. to 30' C. Thereafter, the mixture was stirred for 2 hours as it is. Then, after distilling off methylene chloride and excessive thionyl chloride under a reduced pressure by aspirator, the residue was dissolved in 200 g of tetrahydrofuran and 11.9 g of pyridine was then 8.7 g of allyl alcohol was added dropwise to the solution with stirring at a temperature of from 25° C. to 30° C. Thereafter, the mixture was stirred for 3 hours as it was and the reaction mixture was poured into one liter of water followed by stirring for one hour. After allowing to stand the reaction mixture, the liquid product thus sedimented was collected by decantation. The liquid product was poured into one liter of water followed by stirring for 30 minutes and after allowing to stand the mixture, the liquid product thus sedimented was collected by decantation. The aforesaid operation was repeatedly carried out until the supernatant solution became neutral.

Then, 500 ml of diethyl ether was added to the liquid product followed by stirring to form solids, which were collected by filtration and dried under reduced pressure to provide 59 g of the desired macromonomer (MM-7) having a weight average molecular weight of $7.7\times10^3$.

$CH_2{=}CH{-}CH_2{-}O{-}COCH_2CH_2CH{-}_2COO(CH_2)_6\ \ O\ \ H$ (MM-7):

SYNTHESIS EXAMPLE 8 OF MACROMONOMER: MM-8

In an oil bath kept at an outside temperature of 150° C. was stirred 500 g of 12-hydroxystearic acid for 10 hours under a reduced pressure of from 10 to 15 mmHg while distilling off water formed. The content of a carboxy group of the liquid product obtained was 600 mole/g.

To a mixture of 100 g of the aforesaid liquid product, 13.9 g of 2-hydroxyethyl acrylate, 1.5 g of t-butylhydroquinone, and 200 g of methylene chloride was added dropwise a mixture of 24.8 g of dicyclohexylcarbodiimide (D.C.C.), 0.8 g of 4-(N,N-dimethyl)aminopyridine, and 100 g of methylene chloride with stirring at room temperature over a one hour period followed by stirring for 4 hours as they were.

The reaction mixture was filtered through a 200 mesh nylon cloth to filtrate off insoluble matters. After concentrating the filtrate under reduced pressure, 300 g of n-hexane was added to the residue formed followed by stirring and insoluble matters were filtered off using a filter paper. After concentrating the filtrate, the residue formed was dissolved in 100 g of tetrahydrofuran, the mixture was re-precipitated in one liter of methanol, and the sediment thus formed was collected by decantation. The product was dried under reduced pressure to provide 60 g of the desired macromonomer (MM-8) having a weight average molecular weigh of $6.7\times10^3$.

(MM-8):

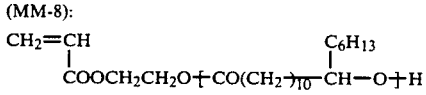

SYNTHESIS EXAMPLE 1 OF RESIN (A): A-1

A mixture of 60 g of benzyl methacrylate, 20 g of methyl methacrylate, 20 g of the compound (MM-1) obtained in Synthesis Example 1 of macromonomer, and 200 g of toluene was heated to 70° C. under nitrogen gas stream and after adding thereto 1.0 g of 2,2'- azobisisobutyronitrile (A.I.B.N.), the mixture was stirred for 2 hours. Thereafter, 0.4 g of A.I.B.N. was added thereto followed by stirring for 2 hours and after further adding thereto 0.2 g of A.I.B.N. followed by stirring for 3 hours.

The weight average molecular weight of the copolymer (A-1) obtained was $4.5\times10^4$.

(A-1):

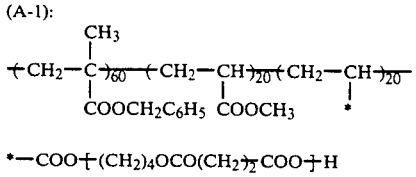

SYNTHESIS OF RESIN (A): A-2

A mixture of 50 g of benzyl methacrylate, 50 g of benzyl methacrylate, 50 g of the compound (MM-2) obtained in Synthesis Example 2 of macromonomer, 1.0 g of n-dodecylmercaptane, and 200 g of toluene was heated to 75° C. under nitrogen gas stream.

Then, 1.0 g of 2,2'-azobisisobutyronitrile (A.I.B.N.) was added to the reaction mixture and the resultant mixture was stirred for 4 hours. Thereafter, 0.4 g of A.I.B.N. was added thereto followed by stirring for 4 hours and then 0.2 g of A.I.B.N. was added thereto followed by stirring for 3 hours.

The weight average molecular weight of the copolymer (A-2) thus obtained was $7.5\times10^3$.

(A-2):

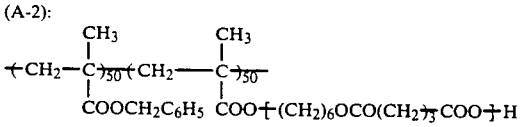

SYNTHESIS EXAMPLE 3 OF RESIN (A): A-3

A mixture of 60 g of benzyl methacrylate, 50 g of the compound (MM-3) obtained in Synthesis Example 3 of macromonomer, 3.0 g of thioglycolic acid, and 200 g of toluene was heated to 75° C. under nitrogen gas stream and after adding 1.5 g of A.I.B.N. to the reaction mixture, the resultant mixture was stirred for 4 hours. Then, 0.4 g of A.I.B.N. was added thereto followed by stirring 2 hours and further 0.2 g of A.I.B.N. was added thereto followed by stirring for 3 hours.

The weight average molecular weight of the copolymer (A-3) thus obtained was $7.0\times10^3$.

(A-3):

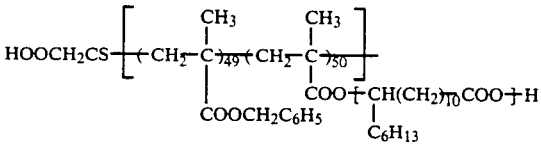

SYNTHESIS EXAMPLE 4 OF RESIN (A): A-4

A mixture of 60 g of 2-chlorophenyl methacrylate, 40 g of the compound (MM-4) obtained in Synthesis Example 4 of macromonomer, 150 g of toluene, and 50 g of isopropyl alcohol was headed to 85° C. under nitrogen gas stream and after adding 5.0 g of 4,4'-azobis(2-cyanovaleric acid) (A.C.V.) to the reaction mixture, the resultant mixture was stirred for 4 hours. Then, 1 g of A.C.V. was added thereto followed by stirring for 2 hours and then 1 g of A.C.V. was added thereto followed by stirring for 3 hours.

The weight average molecular weight of the copolymer (A-4) thus obtained was $8.5\times10^3$.

(A-4):

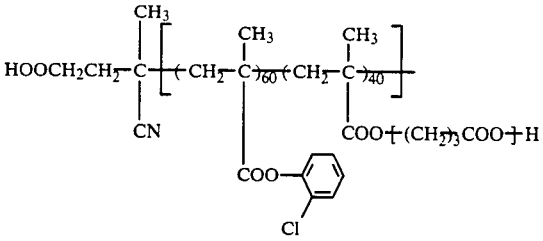

SYNTHESIS EXAMPLE 5 OF RESIN (A): A-5

A mixture of 60 g of benzyl methacrylate, 20 g of methyl methacrylate, 20 g of the compound (MM-1) obtained in Synthesis Example 1 of macromonomer, 150 g of toluene, and 50 g of isopropyl alcohol was heated to 75° C. under nitrogen gas stream and after adding 1.0 g of 4,4'-azobis(2-cyanovaleric acid) (A.C.V.) to the reaction mixture, the resultant mixture was stirred for 4 hours. Then, 0.4 g of A.C.V. was added thereto followed by stirring for 2 hours and then 0.2 g of A.C.V. was added thereto followed by stirring for 3 hours.

The weight average molecular weight of the copolymer (A-5) thus obtained was $4.3\times10^4$.

(A-5):

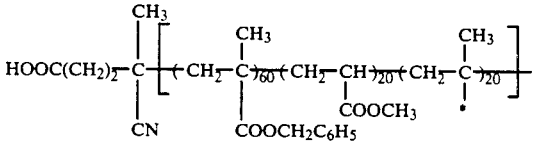

SYNTHESIS EXAMPLE 6 OF RESIN (A): A-6

A mixture of 50 g of benzyl methacrylate, 50 g of the compound (MM-2) obtained in Synthesis Example 2 of macromonomer, 150 g of toluene, and 50 g of isopropyl alcohol was heated to 90° C. under nitrogen gas stream and after adding 5.0 g of A.C.V. to the reaction mixture, the resultant mixture was stirred for 3 hours. Then, 1.0 g of A.C.V. was added thereto followed by stirring for 2 hours and further 0.5 g of A.C.V. was added thereto followed by stirring for 3 hours.

The weight average molecular weight of the copolymer (A-6) thus obtained was $8.3\times10^3$.

(A-6):

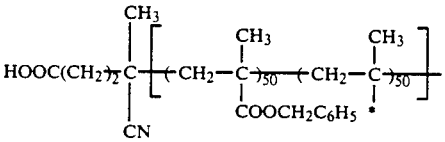

-continued $$*-COOCH_2\underset{\underset{OH}{|}}{C}HCH_2O\!\!\left[COCH_2CH_2CH_2COO(CH_2)_5O\right]\!\!H$$

SYNTHESIS EXAMPLE 7 OF RESIN (A): A-7

A mixture of 47 g of benzyl methacrylate, 50 g of the compound (MM-1) obtained in Synthesis Example 1 of macromonomer, 3.0 g of thioglycolic acid, and 200 g of toluene was heated to 75° C. under nitrogen gas stream and after adding 1.0 g of 2,2'-azobisbutyronitrile (A.I.B.N.) to the reaction mixture, the resultant mixture was stirred for 4 hours. Then, 0.4 g of A.I.B.N. was added thereto followed by stirring for 2 hours and further 0.2 g of A.I.B.N. was added thereto followed by stirring for 3 hours.

The weight average molecular weight of the copolymer (A-7) thus obtained was $7.5\times10^3$.

(A-7):

$$HOOCCH_2S\left[\left(CH_2-\underset{\underset{COOCH_2C_6H_5}{|}}{\overset{\overset{CH_3}{|}}{C}}\right)_{50}\left(CH_2-\underset{\underset{*}{|}}{\overset{\overset{CH_3}{|}}{C}}\right)_{50}\right]$$

$$*-COOCH_2CH_2O\!\!\left[COCH_2CH_2COO(CH_2)_4O\right]\!\!H$$

SYNTHESIS EXAMPLE 8 OF RESIN (A): A-8

A mixture of 70 g of 2-chlorophenyl methacrylate, 30 g of the compound (MM-4) obtained in Synthesis Example 4 of macromonomer, 3.0 g of thioglycolic acid, and 200 g of toluene was heated to 75° C. under nitrogen gas stream and after adding 1.5 g of A.I.B.N. to the reaction mixture, the resultant mixture was stirred for 4 hours. Then, 0.4 g of A.I.B.N. was added thereto followed by stirring for 2 hours and further 0.2 g of A.I.B.N. was added thereto followed by stirring for 3 hours.

The weight average molecular weight of the copolymer (A-8) was $7.0\times10^3$.

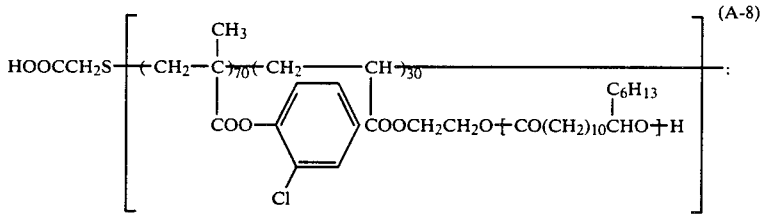

(A-8)

SYNTHESIS EXAMPLE 9 OF RESIN (A): A-9

A mixture of 80 g of n-butyl methacrylate, 20 g of the compound (MM-3) obtained in Synthesis Example 3 of macromonomer, and 200 g of toluene was heated to 80° C. under nitrogen gas stream and after adding 0.8 g of 1,1'-azobis(cyclohexane-1-carbonitrile) (A.C.C.N.) to the reaction mixture, the resultant mixture was stirred for 4 hours. Then, 0.4 g of A.C.C.N. was added thereto followed by stirring for 2 hours and further 0.4 g of A.C.C.N. was added thereto followed by stirring for 3 hours.

The weight average molecular weight of the copolymer (A-9) was $1.5\times10^5$.

$$\left(CH_2-\underset{\underset{COOC_4H_9}{|}}{\overset{\overset{CH_3}{|}}{C}}\right)_{80}\left(CH_2-\underset{\underset{CH_2O\left[COCH_2CH_2CH_2COO(CH_2)_5\right]O\right]H}{|}}{CH}\right)_{20} \quad \text{(A-9)}$$

SYNTHESIS EXAMPLE 10 OF RESIN (A): A-10

A mixture of 60 g of benzyl methacrylate, 20 g of methyl acrylate, 20 g of the compound (MM-1) obtained in Synthesis Example 1 of macromonomer, and 200 g of toluene was heated to 90° C. under nitrogen gas stream and after adding 6.0 g of 2,2'-azobisisobutyronitrile (A.I.B.N.) to the reaction mixture, the resultant mixture was stirred for 4 hours. Then, 2 g of A.I.B.N. was added thereto followed by stirring for 2 hours and further 1 g of A.I.B.N. was added thereto followed by stirring for 3 hours.

The weight average molecular weight of the copolymer (A-10) thus obtained was $9.6\times10^3$.

$$\left(CH_2-\underset{\underset{COOCH_2C_6H_5}{|}}{\overset{\overset{CH_3}{|}}{C}}\right)_{60}\left(CH_2-\underset{\underset{COOCH_3}{|}}{CH}\right)_{20}\left(CH_2-\underset{\underset{*}{|}}{CH}\right)_{20} \quad \text{(A-10)}$$

$$*-COO\left[(CH_2)_4OCO(CH_2)_2COO\right]\!\!H:$$

SYNTHESIS EXAMPLE 11 OF RESIN (A): A-11

A mixture of 50 g of benzyl methacrylate, 50 g of the compound (MM-2) obtained in Synthesis Example 2 of macromonomer, 1.0 g of n-dodecylmercaptan, and 200 g of toluene was heated to 75° C. under nitrogen gas stream and after adding 1.0 g of 2,2'-azobisisobutyronitrile (A.I.B.N.) to the reaction mixture, the resultant mixture was stirred for 4 hours. Then, 0.4 g of A.I.B.N. was added thereto followed by stirring for 2 hours and further 0.2 g of A.I.B.N. was added thereto followed by stirring for 3 hours.

The weight average molecular weight of the copolymer (A-11) thus obtained was $7.5\times10^3$.

$$\left(CH_2-\underset{\underset{COOCH_2C_6H_5}{|}}{\overset{\overset{CH_3}{|}}{C}}\right)_{50}\left(CH_2-\underset{\underset{COO\left[(CH_2)_6OCO(CH_2)_3\right]COO\right]H}{|}}{\overset{\overset{CH_3}{|}}{C}}\right)_{50} \quad \text{(A-11)}$$

SYNTHESIS EXAMPLE 12 OF RESIN (A): A-12

A mixture of 47 g of benzyl methacrylate, 50 g of the compound (MM-3) obtained in Synthesis Example 3 of macromonomer, 3.0 g of thioglycolic acid, and 200 g of toluene was heated to 75° C. under nitrogen gas stream and after adding 1.5 g of A.I.B.N. to the reaction mixture, the resultant mixture was stirred for 4 hours. Then, 0.4 g of A.I.B.N. was added thereto followed by stirring for 2 hours and further 0.2 g of A.I.B.N. was added thereto followed by stirring for 3 hours.

The weight average molecular weight of the copolymer (A-12) thus obtained was $7.0\times10^3$.

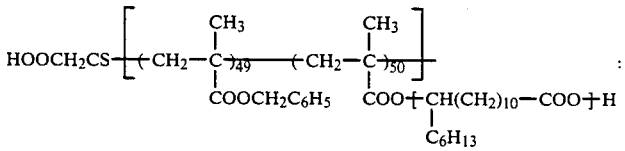

(A-12)

SYNTHESIS EXAMPLE 13 OF RESIN (A): A-13

A mixture of 60 g of 2-chlorophenyl methacrylate, 40 g of the compound (MM-4) obtained in Synthesis Example 4 of macromonomer, 150 g of toluene, and 50 g of isopropyl alcohol was heated to 85° C. under nitrogen gas stream and after adding 5.0 g of 4,4'-azobis(2-cyanovaleric acid) (A.C.V.) to the reaction mixture, the resultant mixture was stirred for 4 hours. Then, 1 g of A.C.V. was added thereto followed by stirring for 2 hours and further 1 g of A.C.V. was added thereto followed by stirring for 3 hours.

The weight average molecular weight of the copolymer (A-13) thus obtained was $8.5\times10^3$.

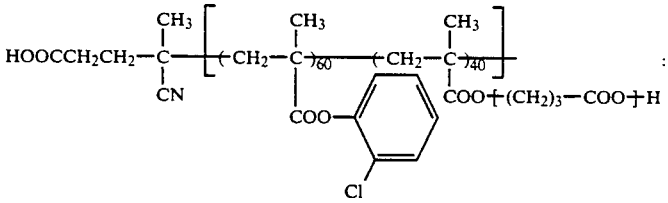

(A-13)

SYNTHESIS EXAMPLE 14 TO 23 OF RESIN (A): A-14TO A-23

According to methods similar to the method of Synthesis Example 10 of Resin (A), resins (A) shown in Table 1 below were produced. The weight average molecular weights thereof were from $8.5\times10^3$ to $1.0\times10^4$.

TABLE 1

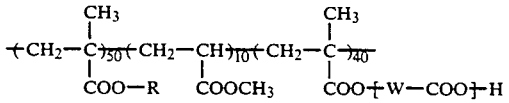

| Resin (A) | R | —W— |
|---|---|---|
| A-14 | $-CH_3$ | $-CH(C_4H_9)(CH_2)_{10}-$ |
| A-15 | $-C_2H_5$ | $-(CH_2)_6OCO-CH_2C(C_2H_5)-$ |

TABLE 1-continued

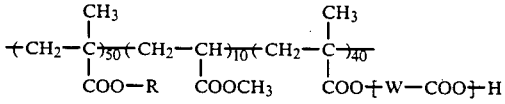

| Resin (A) | R | —W— |
|---|---|---|
| A-16 | 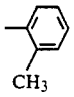 | $-CH_2CH_2OCH_2CH_2OCOCH_2CH_2-$ |
| A-17 | " | 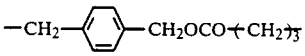 |
| A-18 | 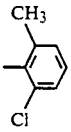 | $-CH(C_6H_{13})(CH_2)_{10}-$ |
| A-19 | $-CH_3$ | $-(CH_2)_5-$ |
| A-20 | 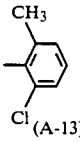 | 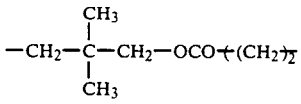 |
| A-21 | $-CH_2C_6H_5$ | 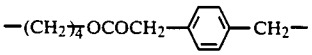 |
| A-22 | 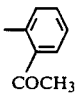 | $-OCH_2CH=CH-CH_2OCO(CH_2)_5-$ |
| A-23 | 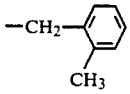 | $-CH(CH_3)OCO-(CH_2)_4-$ |

SYNTHESIS EXAMPLES 24 TO 29 OF RESIN (A): A-24 TO A-29

By following the same procedure as Synthesis Example 12 of Resin (A) except that 3 of each of the mercapto compounds (chain transfer agents) shown in Table 2 below was used in place of 3 g of thioglycolic acid, each of resins (A-24) to (A-29) shown in Table 2 were produced.

TABLE 2

| Resin | Chain Transfer Agent | Weight Average Molecular Weight |
|---|---|---|
| A-24 | $HS(CH_2)_2-COOH$ | 8,300 |
| A-25 | $HS-\underset{\underset{CH_2-COOH}{\vert}}{CH}-COOH$ | 7,600 |
| A-26 | 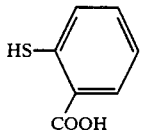 | 7,700 |
| A-27 | $HSCH_2CH_2SO_3H$ | 7,600 |
| A-28 | $HOOCCH_2S-[(CH_2-\underset{\underset{COOCH_2C_6H_5}{\vert}}{C})_{70}-(CH_2-\underset{\underset{COOCH_2CH_2-COO+CH_2-}{\vert}}{C})_{30}]-$  $-CH_2OCO(CH_2)_3-COO+H$ | 7,800 |
| A-29 | $HS(CH_2)_3O-\overset{\overset{O}{\Vert}}{\underset{\underset{OH}{\vert}}{P}}-OH$ <br> $HS(CH_2)_2O-\overset{\overset{O}{\Vert}}{\underset{\underset{OC_2H_5}{\vert}}{P}}-OH$ | 8,000 |

SYNTHESIS EXAMPLE 30 OF RESIN (A): A-30

A mixture of 50 g of 2,6-dichlorophenyl methacrylate, 50 g of the compound (MM-1) obtained in Synthesis Example 1 of macromonomer, 2 g of thioglycolic acid, 150 g of toluene, and 50 g of ethanol was heated to 80° C. under nitrogen gas stream. Then after adding 3 g of A.C.V. to the reaction mixture, the reaction was carried out for 4 hours and after further adding thereto 1.0 g of A.C.V., the reaction was carried out for 4 hours.

The weight average molecular weight of the copolymer (A-30) thus obtained was $8.5\times10^3$.

(A-30)

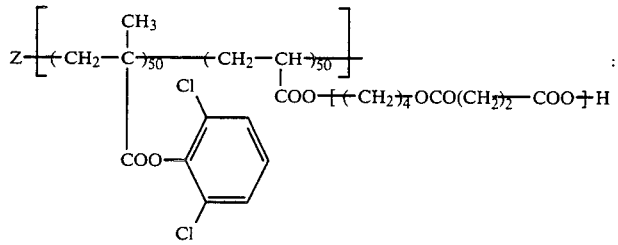

Z: $-\underset{\underset{CN}{\vert}}{\overset{\overset{CH_3}{\vert}}{C}}-CH_2CH_2COOH/-SCH_2COOH$ (1/2)

SYNTHESIS EXAMPLE 31 TO 32 OF RESIN (A): A-31 TO A-32

According to methods similar to the method of Synthesis Example 12 of Resin (A), following resins (A-31) and (A-32) were produced.

(A-31)

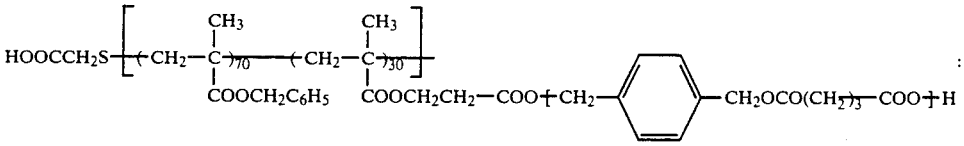

Weight average molecular weight: $8.6\times10^3$.

(A-32)

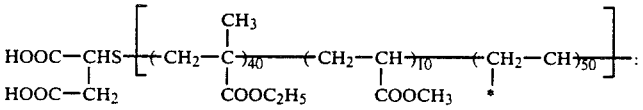

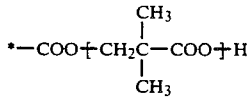

SYNTHESIS EXAMPLE 33 TO 37 OF RESIN (A): A-33 TO A-37

According to methods similar to the method of Synthesis Example 12 of Resin (A), the resins shown in Table 3 below were produced. The weight average molecular weights of the resins obtained were from $3.0\times10^3$ to $8\times10^3$.

TABLE 3

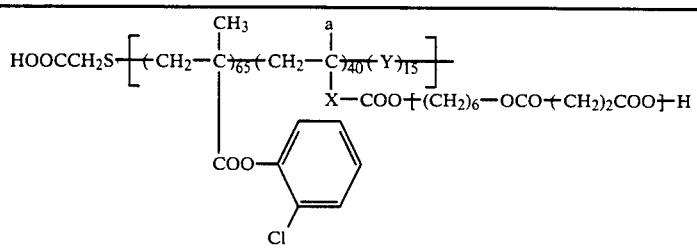

| Resin (A) | X | a | —Y— |
|---|---|---|---|
| A-33 | $-CONH(CH_2)_{10}-$ | H | $-CH_2-C(CH_3)(COO(CH_2)_2OH)-$ |
| A-34 | $-COO(CH_2)_6-$ | $CH_3$ | $-CH_2-C(CH_3)(COO(CH_2)_{10}OH)-$ |
| A-35 | $-COO(CH_2)_2NH$ | $CH_3$ | 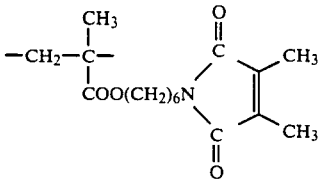 |
| A-36 | $-COO(CH_2)_2-$ | $CH_3$ | 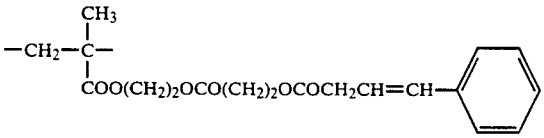 |
| A-37 | 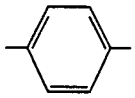 | H | 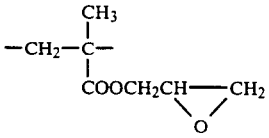 |

SYNTHESIS EXAMPLE 38 TO 47 OF RESIN (A): A-38 TO A-47

According to methods similar to the method of Synthesis Example 1 of Resin (A), the resins shown in Table 4 were produced. The weight average molecular weights of the resins thus obtained were from $5\times10^3$ to $8\times10^3$.

TABLE 4

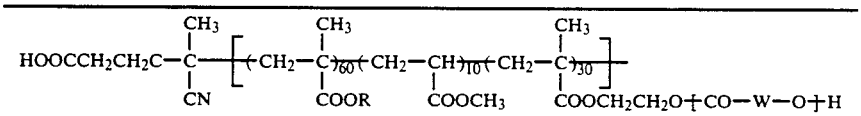

| Resin (A) | R | —W— |
|---|---|---|
| A-38 | $-CH_3$ | $-CH_2CH_2CH_2COOCH_2C(CH_3)_2-CH_2$ |
| A-39 | $-C_2H_5$ | $-CH_2CH_2COOCH_2CH(C_2H_5)CH_2-$ |
| A-40 | 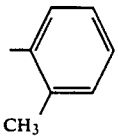 | $-(CH_2)_{10}CH(C_6H_{13})-$ |

TABLE 4-continued

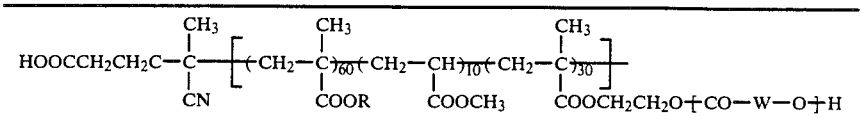

| Resin (A) | R | —W— |
|---|---|---|
| A-41 | " | $-CH_2CH_2-COO(CH_2)_4-$ |
| A-42 | 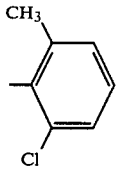 | $-CH_2CH_2COOCH_2-C(C_2H_5)_2-CH_2-$ |
| A-43 | $-CH_3$ | $-CH_2CH_2COOCH_2CH_2OCH_2CH_2-$ |
| A-44 | 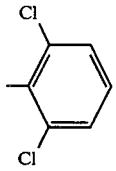 | $-(CH_2)_4COO(CH_3)CH-$ |
| A-45 | $-CH_2C_6H_5$ | $-C(CH_3)_2-CH_2-$ |
| A-46 | 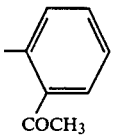 | $-(CH_2)_2COO(CH_2)_6-$ |
| A-47 | 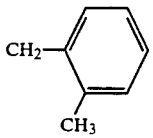 | $-CH=CH-COO-CH_2-CH(CH_3)-CH_2-$ |

SYNTHESIS EXAMPLES 48 TO 53 OF RESIN (A): A-48 TO A-53

By following the same procedure as Synthesis Example 7 of Resin (A) except that 3 g of each of the mercapto compounds (chain transfer agents) shown in Table 5 below was used in place of 3 og thioglycolic acid, each of resins (A-48) to (A-53) shown in Table 5 were produced.

TABLE 5

| Resin | Chain Transfer Agent | Weight Average Molecular Weight |
|---|---|---|
| A-48 | $HS(CH_2)_2-COOH$ | 8,300 |
| A-49 | $HS-CH(CH_2-COOH)-COOH$ | 7,600 |
| A-50 | 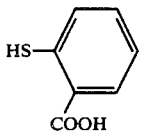 | 7,700 |

TABLE 5-continued

| Resin | Chain Transfer Agent | Weight Average Molecular Weight |
|---|---|---|
| A-51 | $HSCH_2CH_2SO_3H$ | 7,600 |
| A-52 | $HS(CH_2)_3O-P(=O)(OH)-OH$ | 7,800 |
| A-53 | $HS(CH_2)_2O-P(=O)(OC_2H_5)-OH$ | 8,000 |

SYNTHESIS EXAMPLE 54 OF RESIN (A): A-54

A mixture of 50 g of 2,6-dichlorophenyl methacrylate, 50 g of the compound (MM-1) obtained in Synthesis Example 1 of macromonomer, 2 g of thioglycolic acid, 150 g of toluene, and 50 g of ethanol was heated to 80° C. under nitrogen gas stream. Then after adding 3 g of A.C.V. to the reaction mixture, the reaction was carried out for 4 hours and after further adding thereto 1.0 g of A.C.V., the reaction was carried out for 4 hours.

The weight average molecular weight of the copolymer (A-54) thus obtained was $8.5\times10^3$.

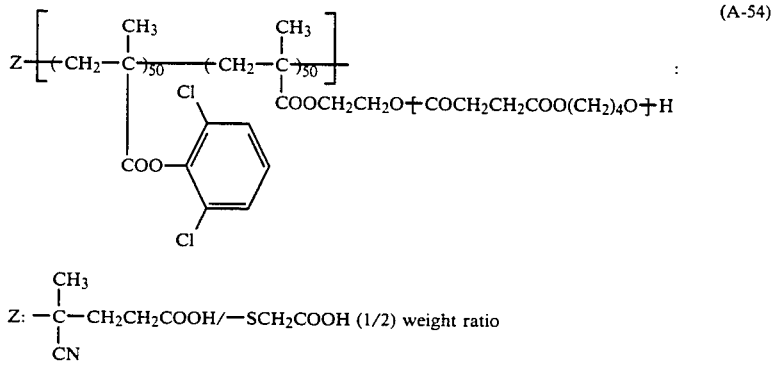

(A-54)

Z: $-C(CH_3)(CN)-CH_2CH_2COOH/-SCH_2COOH$ (1/2) weight ratio

SYNTHESIS EXAMPLES 55 AND 56 OF RESIN (A); A-55 AND A-56

According to methods similar to the method in Synthesis Example 7 of Resin (A), the resins (A-55 ) and (A-56) shown below were produced.

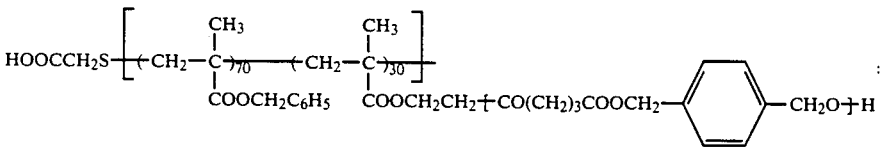

(A-55)

Weight average molecular weight: $8.6\times10^3$.

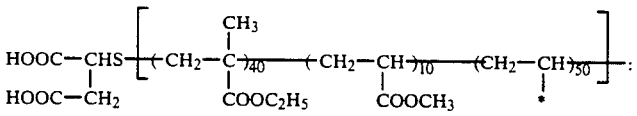

(A-32)

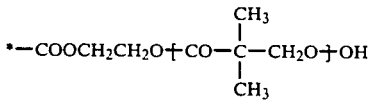

Weight average molecular weight: $8.1\times10^3$.

EXAMPLE 1 AND COMPARISON EXAMPLE A

A mixture of 40 g of Resin (A-1) obtained in Synthesis Example 1 of Resin (A) (as solid content), 200 g of zinc oxide, 0.18 g of cyanine dye (I) shown below, 0.10 g of phthalic anhydride, and 300 g of toluene was dispersed in a ball mill for 2 hours to provide a coating composition for a photoconductive layer. The coating composition was coated on a paper subjected to an electroconductive treatment by a wire bar such that the dry coated amount became 20 g/m$^2$, dried for 30 seconds at 110° C., and allowed to stand for 24 hours under the condition of 20° C. and 65% RH to provide an electrophotographic light-sensitive material.

Cyanine Dye (I):

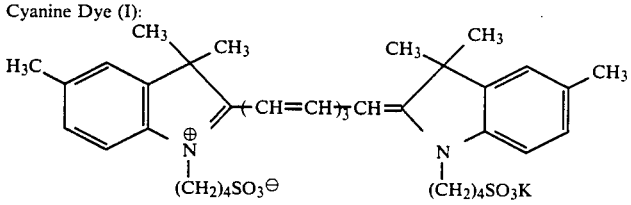

On the other hand, by following the same procedure as Example 1 described above except that 40 g of a resin (P-1) shown below was used in place of the resin (A-1) as the binder resin, a comparison electrophotographic light-sensitive material was prepared.

Comparison Resin (P-1):

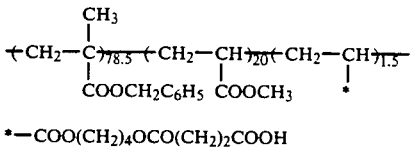

Weight average molecular weight: $3.8\times10^4$

The coating property (surface smoothness), film strength, electrostatic characteristics, imaging property, of these light-sensitive materials, and also the imaging property of them in the surrounding condition of 30° C., 80% RH were determined. Furthermore, the light-sensitive materials were used as offset master plates after processing and the de-sensitizing property of these photoconductive layers (shown by the contact angle of water and the photoconductive layer after being subjected to the de-sensitizing treatment) and the printing properties (background staining, printing impression, etc.) were determined.

The results are shown in Table 6 below.

TABLE 6

| | Example 5 | Comparison Example A |
|---|---|---|
| Smoothness of Photo-*1 conductive Layer (sec/cc) | 95 | 85 |
| Strength of Photo-*2 conductive Layer (%) | 92 | 90 |
| Electrophotographic*3 Characteristics | | |
| $V_{10}$ (−V) | 560 | 450 |
| DRR (%) | 75 | 40 |
| $E_{1/10}$ (erg/cm$^2$) | 42 | 20 |
| Image Forming*4 Performance I:(20° C., 65%) | good | x Dm low, and fine line cut |
| II(30° C., 80%) | good | xx Dm low, fine line cut, and letter not imaged |
| Contact Angle*5 with Water | 10 | 18 |
| Printing Durability*6 | 8,000 prints | Fine line cut from the 1st print |

The properties shown in Table 5 above were evaluated as follows.

1) Smoothness of Photoconductive Layer:

The smoothness (sec/cc) was measured by means of a Beck's smoothness tester manufactured by Kumagaya Riko K.K. under an air volume condition of 1 cc.

2) Mechanical Strength of Photoconductive Layer:

The surface of the photoreceptor was rubbed 1000 times with emery paper (#1000) under a load of 50 g/cm$^2$ by the use of a Heidon 14 Model surface tester (manufactured by Shinto Kagaku K.K.). After dusting, the abrasion loss of the photoconductive layer was measured to obtain a film retention (%).

3) Electrostatic Characteristics:

The sample was charged by corona discharge to a voltage of −6 kV for 20 seconds in a dark room at 20° C. and 65% RH using a paper analyzer ("Paper Analyzer SP-428" manufactured by Kawaguchi Denki K.K.). After the elapse of 10 seconds from the end of the corona discharge, the surface potential $V_{10}$ was measured. The standing of the sample in dark was further continued for an additional 180 seconds, and the potential was measured. The dark decay retention (DRR; %), i.e., percent retention of potential after dark decay for 180 seconds, was calculated from equation:

$$DRR\ (\%) = (V_{180}/V_{10}) \times 100$$

Separately, the sample was charged to −400 V by corona discharge and then exposed to monochromatic light having a wavelength of 780 nm, and the time required for decay of the surface potential $V_{10}$ to one-tenth was measured to obtain an exposure $E_{1/10}$ (erg/cm$^2$).

4) Image Forming Performance:

After the samples were allowed to stand for one day at 20° C. and 65% RH (Condition I) or at 30° C. and 80% RH (Condition II), each sample was charged to −5 kV and exposed to light emitted from a gallium-aluminum arsenic semi-conductor laser (oscillation wavelength: 750 nm; output: 2.8 Mw) at an exposure amount of 64 erg/cm$^2$ (on the surface of the photoconductive layer) at a pitch of 25 μm and a scanning speed of 300 m/sec. The electrostatic latent image was developed with a liquid developer ("ELP-T" produced by Fuji Photo Film Co., Ltd.), followed by fixing. The reproduced image was visually evaluated for fog and image quality.

5) Contact Angle With Water:

The sample was passed once through an etching processor using an oil-desensitizing solution ("ELP-EX" produced by Fuji Photo Film Co., Ltd.) to render the surface of the photoconductive layer oil-desensitive. On the thus oil-desensitized surface was placed a drop of 2 μl of distilled water, and the contact angle formed between the surface and water was measured by a goniometer.

6) Printing Durability:

The sample was processed in the same manner as described in 4) above, and the surface of the photoconductive layer was subjected to oil-desensitization under the same conditions as in 5) above. The resulting lithographic printing plate was mounted on an offset printing machine ("Oliver Model 52", manufactured by Sakurai Seisakusho K.K.), and printing was carried out on fine paper. The number of prints obtained until background stains on non-image areas appeared or the quality of image areas was deteriorated was taken as printing durability. The larger the number of the prints, the higher the printing durability.

*7) Dm (Image Density)

The toner image density at the solid black portion shown by the maximum value, which can be measured by a Macbeth reflection densitometer.

As shown in Table 6 above, it can be seen that the photoconductive layer of the light-sensitive material in the example of this invention was excellent in the smoothness and the electrostatic characteristics as well as the reproduced images had no background stains and had clear images. This is considered to be based on that in the sample, the binder resin is suitably adsorbed on the photoconductive particles and suitably coats the surface of the particles, and also the binder resin does not hinder the adsorption of the spectral sensitizing dye onto the photoconductive particles.

By the same reason as above, when the light-sensitive material in the example of this invention was used as an offset master plate, the desensitizing treatment by the desensitizing solution could be sufficiently applied thereto to reduce the contact angle between the water drop and the non-image portion below 15 degrees, which showed that the surface thereof was sufficiently rendered hydrophilic. When practical printing was run using the master plate, no background stain of prints was observed.

On the other hand, the electrophotographic light-sensitive material in Comparison Example A had a sufficiently high film strength but was greatly inferior in electrophotographic characteristics, in particular, D.R.R. and at practical photographing, satisfactory reproduced could not be obtained. In the sample, $E_{1/10}$ reduced in appearance but this was caused by the reduction of D.R.R. and was not by the so-called improved photoconductivity of showing photoconductivity by light exposure. This is considered to show that the binder resin in the comparison sample, which was a conventional random copolymer, excessively and strongly coated the surface of zinc oxide particles, thereby the resin hindered the adsorption of the spectrally sensitizing dye onto the photoconductive particles to reduce the electrostatic characteristics and also when a desensitizing treatment was applied to the photoconductive layer, etching of zinc oxide particles did not sufficiently proceeded by the existence of the strongly adhered binder resin.

As described above, the photoconductive layer of the light-sensitive material prepared in the example of this invention was excellent in all the surface smoothness, film strength, electrostatic characteristics, and printing properties.

EXAMPLES 2 TO 11

By following the same procedure as Example 1 except that 40 g of each of the resins shown in Table 7 below was used in place of the resin (A-1) as the binder resin, each of the electrophotographic light-sensitive materials were produced and on each sample, the surface smoothness, film strength, and electrostatic characteristics thereof were evaluated. The results were almost same as the case of the example.

TABLE 7

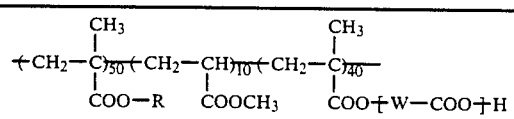

Weight Average Molecular Weight of Resin: $3 \times 10^4 \sim 5 \times 10^4$ (weight ratio)

| Example No. | Resin (A) | R | —W— |
|---|---|---|---|
| 2 | A-5 | $-CH_3$ | $-CH(C_4H_9)(CH_2)_{10}-$ |
| 3 | A-6 | $-C_2H_5$ | $-(CH_2)_6OCO-CH_2C(C_2H_5)-$ |
| 4 | A-7 | 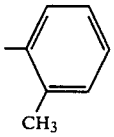 | $-CH_2CH_2OCH_2CH_2OCOCH_2CH_2-$ |
| 5 | A-8 | " | 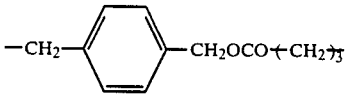 |
| 6 | A-9 | 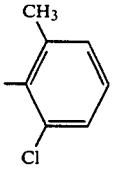 | $-CH(C_6H_{13})(CH_2)_{10}-$ |
| 7 | A-10 | $-CH_3$ | $-(CH_2)_3-$ |
| 8 | A-11 | 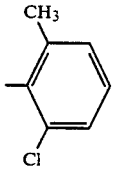 | $-CH_2-C(CH_3)_2-CH_2-OCO-(CH_2)_2-$ |
| 9 | A-12 | $-CH_2C_6H_5$ | 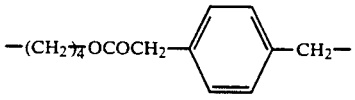 |
| 10 | A-13 | 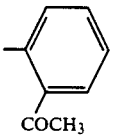 | $-OCH_2CH=CH-CH_2OCO-(CH_2)_3-$ |

TABLE 7-continued

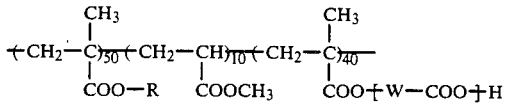

Weight Average Molecular Weight of Resin: $3 \times 10^4 \sim 5 \times 10^4$ (weight ratio)

| Example No. | Resin (A) | R | —W— |
|---|---|---|---|
| 11 | A-14 | 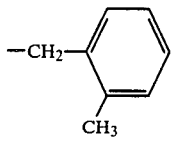 | 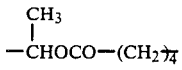 |

EXAMPLE 12

By following the same procedure as Example 1 except that 8 g (as solid component) of resin (A-2) and 32 g of poly(ethyl methacrylate) (weight average molecular weight: $3.4 \times 10^5$) (resin (B-1)) were used in place of 40 g of resin (A-1), an electrophotographic light-sensitive material was prepared. On the light-sensitive material, the properties were measured as in Example 1.

The surface smoothness of the photoconductive layer was good as 95 (sec/cc) and $V_{10}$ was −580 V, D.R.R. 85%, and $E_{1/10}$ 29 (erg/cm$^2$). Also, the imaging property was good and the image quality of images formed at 30° C., 80% RH was good.

As described above, the electrophotographic light-sensitive material obtained by using resin (A) and resin (B) in this invention together as the binder resin were excellent in charging property, dark charge retentivity, and light sensitivity and provided clear images having no background fog and fine line cutting even under severe high temperature and high humidity (30° C., 80% RH) conditions. Furthermore, on printing using the light-sensitive material as an offset master plate, more than 10,000 prints having clear images and having no background fog at the non-image portions could be obtained.

EXAMPLE 13

By following the same procedure as Example 12 except that 8 g of resin (A-3) was used in place of 8 g of resin (A-2) and 32 g of poly(butyl methacrylate) (weight average molecular weight: $3.4 \times 10^5$ ) (resin (B-2)) was used in place of 32 g of resin (B-1), an electrophotographic light-sensitive material was prepared.

On the light-sensitive material, the properties were measured as in Example 1. The surface smoothness of the photoconductive layer was good as 100 (sec/cc) and $V_{10}$ was −560 C, D.R.R. 88%, and $E_{1/10}$ 30 (erg/cm$^2$). Also, images formed at 30° C., 80% RH had good image quality. Furthermore, on printing using the light-sensitive material as an offset master plate, more than 10,000 prints having clear images could be obtained.

EXAMPLES 14 TO 19

By following the same procedure as Synthesis Example 3 of Resin (A) except that 3 g of each of mercapto compounds (chain transfer agents) shown in Table 8 below was used in place of 3 g of thioglycolic acid, each of resins (A-15) to (A-20) were produced.

TABLE 8

| Example No. | Resin (A) | Chain Transfer Agent | Weight Average Molecular Weight of Copolymer |
|---|---|---|---|
| 14 | A-15 | $HS(CH_2)_2—COOH$ | 8,300 |
| 15 | A-16 | $HS—CH(CH_2—COOH)—COOH$ | 7,600 |
| 16 | A-17 | 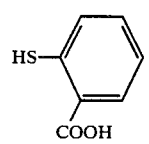 | 7,700 |
| 17 | A-18 | $HSCH_2CH_2SO_3H$ | 7,600 |
| 18 | A-19 | $HS(CH_2)_3O—P(=O)(OH)—OH$ | 7,800 |
| 19 | A-20 | $HS(CH_2)_2O—P(=O)(OC_2H_5)—OH$ | 8,000 |

Then, by following the same procedure as Example 1 using each of the aforesaid resins in place of resin (A-1) in Example 1, each of the electrophotographic light-sensitive materials were prepared.

Each of the light-sensitive materials showed excellent characteristics. Also, on printing using each light-sensitive material as an offset master plate, more than 10,000 prints having clear images could be obtained in each case.

EXAMPLES 20 TO 29

Synthesis of Resin (A-21)

A mixture of 50 g of 2,6-dichlorophenyl methacrylate, 50 g of the compound (MM-1) obtained in Synthesis Example 1 of macromonomer, 2 g of thioglycolic acid, 150 g of toluene, and 50 g of ethanol was heated to 80° C. und. nitrogen gas stream. Then after adding 3 g of A.C.V. to the reaction mixture, the reaction was carried out for 4 hours and further after adding thereto 1.0 g of A.C.V., the reaction was carried out for 4 hours. The weight average molecular weight of the resulting copolymer (A-21) was $8.5 \times 10^3$.

(A-21):

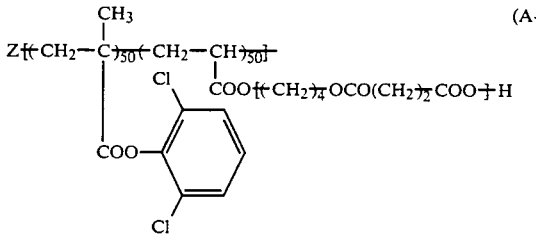

Z: $-C(CH_3)(CN)-CH_2CH_2COOH/-SCH_2COOH$ (1/2) by weight ratio

Preparation of Light-Sensitive Material

A mixture of 9 g (as solid content) of the above resin (A-21), 31 g of each of resins (C) shown in Table 9 below, 0.02 g of a heptamethinecyanine dye (II) having the structure shown below, 0.15 g of phthalic anhydride, and 300 g of toluene was dispersed in a ball mill for 2 hours to provide a coating composition for a photoconductive layer. Then, by following the same procedure as in Example 1, each of electrophotographic light-sensitive materials were prepared.

Cyanine Dye (II):

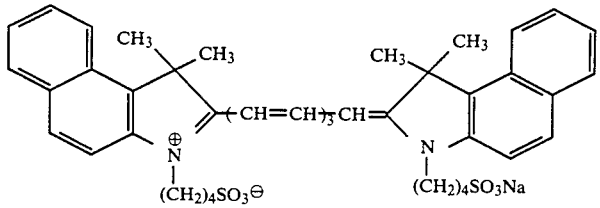

TABLE 9

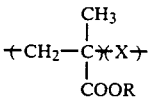

| Resin (C) | R | —X— | Weight Ratio | Weight Average Molecular Weight ($\times 10^4$) |
|---|---|---|---|---|
| C-1 | $-C_2H_5$ | $-CH_2-C(CH_3)(COOCH_2CH_2OH)-$ | 96 / 4 | 12 |
| C-2 | $-C_2H_5$ | $-CH_2-C(CH_3)(COO(CH_2)_{10}OH)-$ | 95 / 5 | 9.5 |
| C-3 | $-C_4H_9$ | $-CH_2-C(CH_3)(CONHC(CH_2OH)_2CH_3)-$ | 98 / 2 | 10 |
| C-4 | $-C_4H_9$ | $-CH_2-C(CH_3)(CONH(CH_2)_{10}OH)-$ | 97 / 3 | 11.5 |
| C-5 | $-C_4H_9$ | $-CH_2-CH(C_6H_4CH_2OH)-$ | 96 / 4 | 20 |

TABLE 9-continued

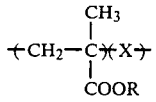

| Resin (C) | R | —X— | Weight Ratio | Weight Average Molecular Weight ($\times 10^4$) |
|---|---|---|---|---|
| C-6 | $-C_2H_5$ | 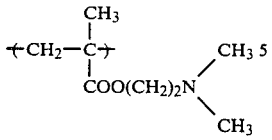 | 95 | 8.8 |
| C-7 | $-C_3H_7$ | 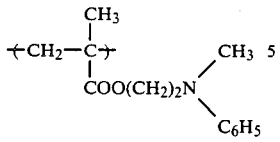 | 95 | 9.5 |
| C-8 | $-C_4H_9$ | 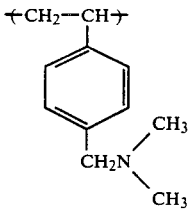 | 96 | 10.5 |
| C-9 | $-C_2H_5$ | 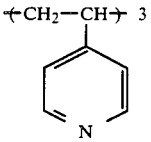 | 97 | 10.5 |
| C-10 | $-C_4H_9$ | 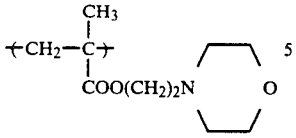 | 95 | 13 |

On each of these light-sensitive materials, the electrostatic characteristics thereof were measured using the paper analyzer as in Example 1. In this case, however, a gallium-aluminium-arsenic semiconductor laser (oscillation wavelength: 830 nm) was used as the light source.

The results obtained are shown in Table 10.

TABLE 10

| Example No. | Resin (C) | $V_{10}$ (−V) | D.R.R. | $E_{1/10}$ (erg/cm$^2$) | Image Forming Performance (30° C., 80% RH) | Printing Durability (No. of Prints) |
|---|---|---|---|---|---|---|
| 20 | C-1 | 580 | 85 | 29 | good | 8,000 |
| 21 | C-2 | 590 | 87 | 29 | " | 8,000 |
| 22 | C-3 | 570 | 83 | 28 | " | 9,000 |
| 23 | C-4 | 585 | 85 | 28 | " | 9,000 |
| 24 | C-5 | 560 | 85 | 31 | " | 8,000 |
| 25 | C-6 | 545 | 82 | 32 | " | 8,000 |
| 26 | C-7 | 550 | 83 | 30 | " | 8,000 |
| 27 | C-8 | 540 | 80 | 33 | " | 8,000 |
| 28 | C-9 | 545 | 82 | 31 | " | 8,000 |
| 29 | C-10 | 540 | 78 | 32 | " | 8,000 |

EXAMPLES 30 TO 41

A mixture of 8 g of resin (A-22) having the structure shown below, 32 g of each of the resins (D) shown in Table 11 below, 0.018 g of the cyanine dye (I) described below, 0.15 g of maleic anhydride, 200 g of zinc oxide, and 300 g of toluene was dispersed in a ball mill for 2 hours to provide a coating composition for a photoconductive layer. Thereafter, by following the same procedure as in Example 1 using the aforesaid coating composition, each of electrophotographic light-sensitive materials was prepared.

(A-22):
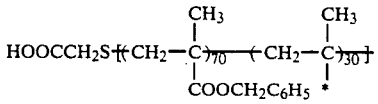
-continued
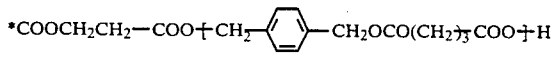
Weight average molecular weight: $8.6\times10^3$
TABLE 11
Resin (D):
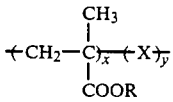
(x, y: weight composition ratio)
| Example | Resin (D) | R, x | | —X— | y | Weight Average Molecular Weight ($\times10^5$) |
|---|---|---|---|---|---|---|
| 30 | D-1 | $-C_2H_5$ | 99.5 | 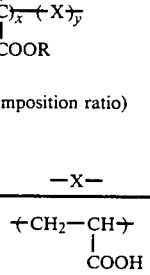 | 0.5 | 1.8 |
| 31 | D-2 | " | 99.5 | 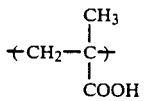 | 0.5 | 2.0 |
| 32 | D-3 | " | 99.2 | 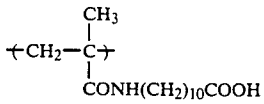 | 0.8 | 2.1 |
| 33 | D-4 | $-C_4H_9$ | 99.7 | 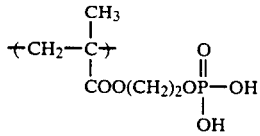 | 0.3 | 2.5 |
| 34 | D-5 | $-C_4H_9$ | 99.7 | 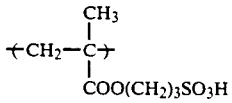 | 0.3 | 1.5 |
| 35 | D-6 | $-C_2H_5$ | 99.5 | 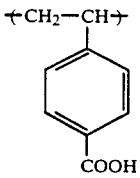 | 0.5 | 1.1 |
| 36 | D-7 | $-CH_2C_6H_5$ | 99.4 | 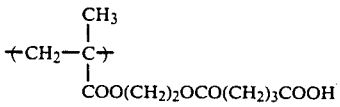 | 0.6 | 2.1 |
| 37 | D-8 | $-C_3H_7$ | 99.4 | 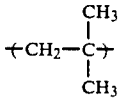 | 0.6 | 2.2 |
| 38 | D-9 | $-C_4H_9$ | 99.5 | 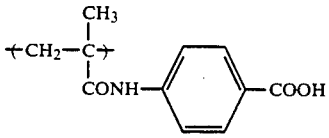 | 0.5 | 2.0 |

TABLE 11-continued

Resin (D):

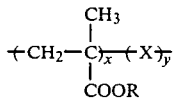

(x, y: weight composition ratio)

| Example | Resin (D) | R, x | | —X— | y | Weight Average Molecular Weight ($\times 10^5$) |
|---|---|---|---|---|---|---|
| 39 | D-10 | $-C_3H_7$ | 99.7 | 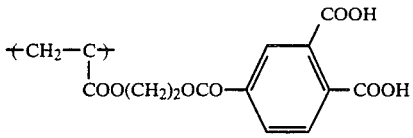 | 0.3 | 2.1 |
| 40 | D-11 | $-C_2H_5$ | 99.7 | 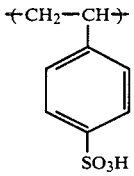 | 0.3 | 1.6 |
| 41 | D-12 | $-C_2H_5$ | 99.4 | 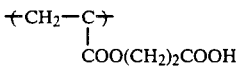 | 0.6 | 2.2 |

Each of the electrophotographic light-sensitive materials was excellent in static property, dark charge retentivity, and light sensitivity and in the practical image reproduction using each of the light-sensitive materials, clear images having neither occurrence of background staining nor occurrence of fine line cutting were obtained even under severe high-temperature and high-humidity conditions (30° C., 80% RH) in each case.

Furthermore, when after making each printing plate in the same manner as in Example 1, printing was run using each sample as the offset master plate, 10,000 prints having clear images having no background stains were obtained.

EXAMPLES 42 TO 47 AND COMPARISON EXAMPLE B

A mixture of 8 g of resin (A-23) having the structure shown below, 32 g of each of resins (B), (C), and (D) shown in Table 12, 200 g of zinc oxide, 0.02 g of uranine, 0.04 g of Rose Bengale, 0.03 g of bromophenol blue, 0.20 g of phthalic anhydride, and 300 g of toluene was dispersed in a ball mill for 2 hours to provide a coating composition for a photoconductive layer and the coating composition was coated on a paper which had been subjected to an electroconductive treatment by a wire bar in a dry coating amount of 20 g/m$^2$ followed by drying for one minute at 110° C.

Then, each coated material was allowed to stand in the dark for 24 hours under the condition of 20° C., 65% RH to obtain each of the electrophotographic light-sensitive materials.

(A-23):

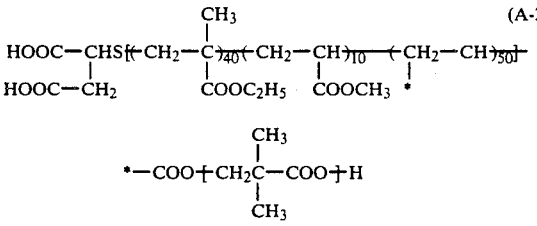

Weight average molecular weight: $8.1 \times 10^3$

TABLE 12

Resin (B), (C), (D): (Weight Average Molecular Weight: $1.5 \times 10^3$ to $2.5 \times 10^5$)

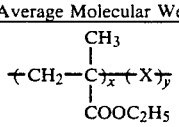

| Example No. | x/y (weight ratio) | —X— | Electrophotographic*8 characteristics (30° C., 80%) $V_{10}$ (−V) | D.R.R (%) | $E_{1/10}$ (lux · sec) | Printing Durability (No. of Prints) |
|---|---|---|---|---|---|---|
| 42 | 100/1 | — | 550 | 90 | 5.6 | 8,000 |
| 43 | 96/4 | 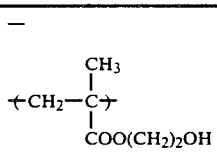 | 545 | 91 | 5.2 | " |

TABLE 12-continued

Resin (B), (C), (D): (Weight Average Molecular Weight: $1.5 \times 10^3$ to $2.5 \times 10^5$)

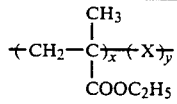

| Example No. | x/y (weight ratio) | —X— | Electrophotographic*8 characteristics (30° C., 80%) $V_{10}$ (−V) | D.R.R (%) | $E_{1/10}$ (lux · sec) | Printing Durability (No. of Prints) |
|---|---|---|---|---|---|---|
| 44 | 95/5 | 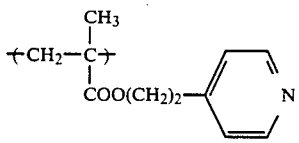 | 545 | 90 | 5.7 | " |
| 45 | 99.6/0.4 | $\leftarrow CH_2-CH \rightarrow$ (COOH) | 550 | 93 | 4.8 | more than 10,000 |
| 46 | 99.7/0.3 | $\leftarrow CH_2-CH \rightarrow$ ($COO(CH_2)_2O-P(=O)(OH)-OH$) | 555 | 94 | 4.9 | more than 10,000 |
| 47 | 99.7/0.3 | $\leftarrow CH_2-C(CH_3) \rightarrow$ ($COO(CH_2)_4SO_3H$) | 545 | 93 | 5.0 | more than 10,000 |
| B | | 40 g of Resin (P-1) of Comparison Example A was used alone. | 550 | 84 | 15.0 | Background stain occurred from the 1st print. |

*8) Electrostatic Characteristics

Each light-sensitive material was charged by corona discharging for 20 seconds at 6 kV using a paper analyzer (Paper Analyzer Type SP-428, manufactured by Kawaguchi Denki K.K.) in the dark at 20° C. and 65% RH, allowed to stand for 10 seconds, and the surface potential $V_{10}$ was measured. Then, the sample was subjected to dark decay for 60 seconds and thereafter the surface potential $V_{70}$ was measured. Thus, the potential retentivity of each sample after dark decaying for 60 seconds, that is, the dark decay retentivity (D.R.R. %) was calculated by the equation of $(V_{70}/V_{10}) \times 100$ (%).

Also, after charging the surface of each photoconductive layer to −400 V by corona discharging, the surface of the photoconductive layer was exposed to visible light at an illuminance of 2.0 lux and the time required for decaying the surface potential $V_{10}$ to 1/10 thereof was determined. From the value, an exposure amount $E_{1/10}$ (lux/sec.) was calculated.

In addition, each offset printing master plate was prepared by the following conditions.

After allowing to stand each of the electrophotographic light-sensitive materials a whole day and night under condition (I) at 20° C., 65% RH or condition (II) at 30° C., 80% RH, a printing plate was made from each sample by a full automatic plate making machine ELP-404V (trade name, manufactured by Fuji Photo Film Co., Ltd.) using ELP-T (trade name, made by Fuji Photo Film Co., Ltd.) as toner and the qualities (fog, image quality) of reproduced images were visually evaluated.

For the light-sensitive materials in the examples of this invention and the light-sensitive material in Comparison Example B were used three kinds of the aforesaid dyes sensitizing in the visible light region as the spectral sensitizing dyes.

In the case of using these dyes, the light-sensitive material in Comparison Example B using a conventional random copolymer as the binder resin showed satisfactory electrophotographic characteristics but when the sample was used as an offset master plate for printing, the oil-desensitizing treatment at the non-image portions was insufficient and background staining occurred from the 1st print.

On the other hand, in the case of the light-sensitive materials of this invention, such a phenomenon was not observed and more than 8,000 prints having clear images and no background fog were obtained.

EXAMPLE 48 AND COMPARISON EXAMPLES C AND D

A mixture of 40 g (as solid content) of resin (A-5) obtained in Synthesis Example 5 of Resin (A), 200 g of zinc oxide, 0.018 g of a cyanine dye (I) having the structure shown below, 0.10 g of phthalic anhydride, and 300 g of toluene was dispersed in a ball mill for 2 hours to provide a coating composition for a photoconductive layer. The composition was coated on a paper which had been subjected to a conductive treatment by a wire bar in a dry coating amount of 20 g/m$^2$ and dried for 30 seconds at 110° C. The coated material was then allowed to stand for 24 hours under the conditions of ° C., 65% RH to obtain an electrophotographic light-sensitive material.

Cyanine Dye (I):

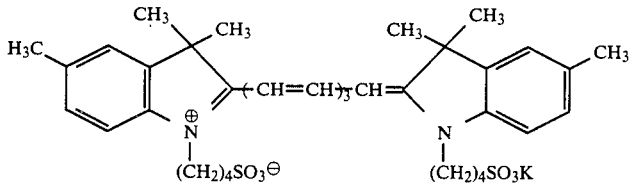

COMPARISON EXAMPLE C

By following the same procedure as Example 48 except that 40 g of a resin (P-1) having the following structure was used in place of the resin (A-5), an electrophotographic light-sensitive material was prepared.

Comparison Resin (P-1):

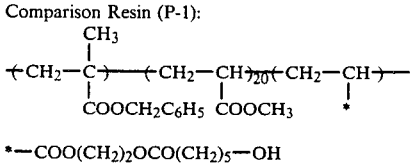

Weight average molecular weight: $3.8\times10^4$

COMPARISON EXAMPLE D

By following the same procedure as Example 48 except that 40 g of a resin (P-2) having the following structure was used in place of the resin (A-5), an electrophotographic light-sensitive material was prepared.

Comparison Resin (P-2):

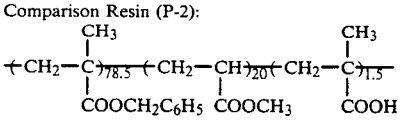

Weight average molecular weight: $4.2\times10^4$

On these light-sensitive materials, the coating property (surface smoothness), film strength, electrostatic characteristics, imaging property at normal condition and imaging property under the environmental condition of 30° C., 80% RH were determined.

Furthermore, each of the light-sensitive materials was used as an offset master plate for printing after processing and the oil-desensitizing property of the photoconductive layer (shown by the contact angle between the photoconductive layer after being oil-desensitized and water) and the printing property (background staining, printing durability, etc.) were determined.

The results obtained are shown in Table 13 below.

In Table 13, the evaluation items *1) to *6) are the same as those shown in Example 1 on Table 6.

TABLE 13

| | Example 48 | Comparison Examples C | D |
|---|---|---|---|
| Smoothness of Photo-*1 conductive Layer (sec/cc) | 95 | 105 | 93 |
| Strength of Photo-*2 conductive Layer (%) | 92 | 65 | 90 |
| Electrophotographic*3 Characteristics | | | |
| $V_{10}$ (−V) | 560 | 430 | 460 |
| DRR (%) | 75 | 35 | 45 |
| $E_{1/10}$ (erg/cm$^2$) | 42 | 105 | 39 |

TABLE 13-continued

| | Example 48 | Comparison Examples C | D |
|---|---|---|---|
| Image Forming*4 Performance I:(20° C., 65%) | good | x Dm low, and fine line cut | x Dm low, and fine line cut |
| II(30° C., 80%) | good | xxx Dm low, densities of fine line, letter, and solid black portion low | Dm low, densities of fine line and letter low |
| Contact Angle*5 with Water | 10 | 18 | 20–30° |
| Printing Durability*6 | 8,000 prints | Fine line cut from the 1st print | Background stain occurred from the 1st print |

These properties were evaluated in the same manner as described for Table 5.

As shown in Table 13, it can be seen that the photoconductive layer of electrophotographic light-sensitive material in the example of this invention was good in the surface smoothness and the electrostatic characteristics as well as the reproduced images had no background stains and had clear images. This is considered to be based on that, in the sample, the binder resin is suitably adsorbed on the photoconductive particles and suitably coats the surface of the particles, and also the binder resin does not hinder the adsorption of the spectral sensitizing dye onto the photoconductive particles.

For the same reason as above, when the light-sensitive material in the example of this invention was used as an offset master plate, the oil-desensitizing treatment by the oil-desensitizing solution could be sufficiently applied thereto to reduce the contact angle between the water drop and the non-image portion of the photoconductive lower below 15 degrees, which showed that the surface thereof was sufficiently rendered hydrophilic. When practical printing was run using the master plate, no background staining of prints was observed.

On the other hand, the electrophotographic light-sensitive material in Comparison Example C was inferior in the electrostatic characteristics, and particularly in D.R.R., and also the electrostatic characteristics were greatly reduced under the severe environmental condition (30° C., 80% RH). At practical imaging, satisfactory reproduced images were not obtained. In the sample, $E_{1/10}$ reduced in appearance but this was caused by the reduction of D.R.R. and was not by the so-called improved photoconductivity of showing photoconductivity by light exposure. In the light-sensitive material accompanied with the aforesaid phenomenon, the potential difference between the imaged portions and the non-imaged portions becomes small, whereby at practical imaging, reproduced images having satisfactory images are not obtained.

The binder resin (P-1) used for the sample in Comparison Example C is a resin containing a hydroxy group only as a polar group having an adsorptive action for zinc oxide particles, which is a conventional random copolymer. In the case of a random copolymer resin having a hydroxy group as the polar group, the content thereof must be over 10% by weight for sufficiently keeping electrostatic charges by the interaction with zinc oxide particles, but, if the content is over 15% by weight, the photoconductive layer is influenced by moisture under a high humidity condition, whereby the layer can not keep electrostatic charges thereon.

Even in the case of using the resin (P-1) in the range of from 10 to 15% by weight, the electrostatic characteristics are still unsatisfactory and it is assumed that such a range of content is not a proper condition in the resin (P-1) for the adsorption and coating of zinc oxide particles.

The light-sensitive material in Comparison Example D had a satisfactory film strength, but, in this sample, the electrostatic characteristics, in particular, D.R.R. were greatly lowered and at practical imaging, satisfactory reproduced images were not obtained. Also, $E_{1/10}$ was reduced in appearance as in Comparison Example A due to the reduction Of D.R.R.

This is considered to show that the resin (P-2) which is a conventional random copolymer having a carboxy group excessively and strongly coat the site of a carboxy group contained in the resin (P-2) and thus the resin hinders the adsorption of spectrally sensitizing dyes to the surface of zinc oxide particles to reduce the electrostatic characteristics and also when an oil-desensitizing treatment is applied to the photoconductive layer, etching of zinc oxide particles does not sufficiently proceed.

From the aforesaid aspects, it is cleat that the light-sensitive material of this invention only was excellent in all the points of the smoothness, film strength, and electrostatic characteristics of the photoconductive layer and the printing property of the light-sensitive material.

EXAMPLES 49 TO 59

By following the same procedure as Example 48 except that each of 40 g of the resins shown in Table 14 below was used in place of the resin (A-5), each of electrophotographic light-sensitive materials was prepared.

When the surface smoothness, film strength and electrostatic characteristics of each light-sensitive material were measured in the same manners as in Example 48, substantially the same results as in Example 48 were obtained.

TABLE 14

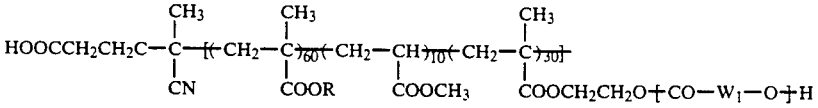

Molecular weight of Resin: $3 \times 10^4$ to $5 \times 10^4$

| Example No. | Resin (A) of Present Invention | R | $-W_1-$ |
|---|---|---|---|
| 49 | A-10 | $-CH_3$ | $-CH_2CH_2CH_2COOCH_2C(CH_3)_2-CH_2-$ |
| 50 | A-11 | $-C_2H_5$ | $-CH_2CH_2COOCH_2CH(C_2H_5)CH_2-$ |
| 51 | A-12 | 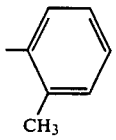 | $-(CH_2)_{10}CH(C_6H_{13})-$ |
| 52 | A-13 | " | $-CH_2CH_2-COO(CH_2)_{74}$ |
| 53 | A-14 | 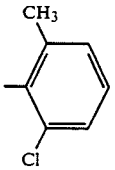 | $-CH_2CH_2COOCH_2-C(C_2H_5)_2-CH_2-$ |
| 54 | A-15 | $-CH_3$ | $-CH_2CH_2COOCH_2CH_2OCH_2CH_2-$ |

TABLE 14-continued

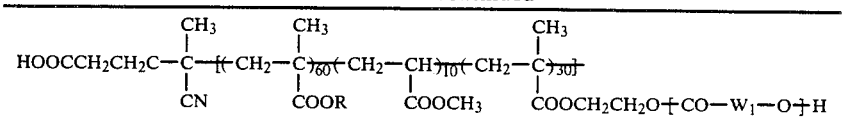

Molecular weight of Resin: $3 \times 10^4$ to $5 \times 10^4$

| Example No. | Resin (A) of Present Invention | R | $-W_1-$ |
|---|---|---|---|
| 55 | A-16 | 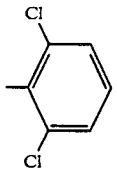 | 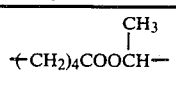 |
| 56 | A-17 | $-CH_2C_6H_5$ | 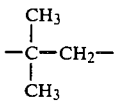 |
| 57 | A-18 | 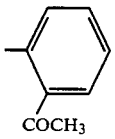 | 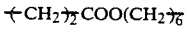 |
| 58 | A-19 | 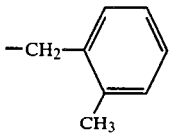 | 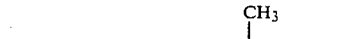 |

EXAMPLE 59

By following the same procedure as Example 48 except that 8 g (as solid component) of resin (A-6) and 32 g (as solid component) of resin (A-9) were used in place of 40 g of the resin (A-5), an electrophotographic light-sensitive material was prepared. On the light-sensitive material thus obtained, the properties were measured as in Example 48.

The surface smoothness of the photoconductive layer was good as 102 (sec/cc), $V_{10}$ thereof was −585° C., D.R.R. 87, and $E_{1/10}$ 26 (erg/cm$^2$). Also, in imaging at 30° C., 80% RH, a good image quality was obtained.

That is, the electrophotographic light-sensitive material of this invention was excellent in charging property, dark charge retentivity, and light sensitivity and gave clear images without forming background staining and fine line cutting even under severe conditions of high temperature and high humidity (30° C., 80% RH) at practical imaging. Furthermore, when the light-sensitive material was used as an offset printing master plate for printing after being processed, 9,000 prints having clear images having no background stains at the non-imaged portions could be obtained.

EXAMPLES 60 AND 61

By following the same procedure as Example 48 except that 7 g (as solid content) of resin (A-7) and 33 g of each of the resins shown in Table 15 below were used in place of 40 g of the resin (A-5), each of electrophotographic light-sensitive materials was prepared.

On each light-sensitive material thus obtained, the properties were measured as in Example 48 and the results obtained are shown in Table 15 together.

TABLE 15

| | Example 60 | Example 61 |
|---|---|---|
| Resin (B) | (B-1) Poly(ethyl-methacrylate) Mw $3.6 \times 10^5$ | (B-2) Poly(butyl-methacrylate) Mw $3.6 \times 10^5$ |
| Smoothness of Photo-*1 conductive Layer (sec/cc) | 100 | 105 |
| Strength of Photo-*2 conductive Layer (%) | 97 | 95 |
| Electrophotographic*3 Characteristics | | |
| $V_{10}$ (−V) | 570 | 570 |
| DRR (%) | 85 | 89 |
| $E_{1/10}$ (erg/cm$^2$) | 25 | 28 |
| Image Forming*4 Performance | | |
| I:(20° C., 65%) | good | good |
| II(30° C., 80%) | good | good |
| Printing Durability | 10,000 prints | 10,000 prints |

The electrophotographic light-sensitive materials of this invention were excellent in charging property, dark charge retentivity, and light-sensitivity and provided clear images without causing background staining and fine line cutting even under severe conditions of high temperature and high humidity (30° C., 80% RH). Furthermore, when each light-sensitive material was used as an offset printing master plate for printing after processing, more than 10,000 prints having clear images having no background stains at the non-imaged portions were obtained.

EXAMPLES 62 TO 67

By following the same procedure as Synthesis Example 17 of Resin (A) except that 3 g of each of the mercapto compounds (chain transfer agent) shown in Table 15 was used in place of 3 g of thioglycolic acid, each of the resins (A) shown in Table 16 was prepared.

TABLE 16

| Example No. | Resin (A) | Chain Transfer Agent | Weight Average Molecular Weight of Compound |
|---|---|---|---|
| 62 | A-20 | $HS(CH_2)_2-COOH$ | 8,300 |
| 63 | A-21 | $HS-\underset{\underset{CH_2-COOH}{\vert}}{CH}-COOH$ | 7,600 |
| 64 | A-22 | 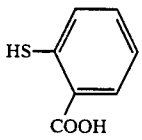 | 7,700 |
| 65 | A-23 | $HSCH_2CH_2SO_3H$ | 7,600 |
| 66 | A-24 | $HS(CH_2)_3O-\overset{\overset{O}{\Vert}}{\underset{\underset{OH}{\vert}}{P}}-OH$ | 7,800 |
| 67 | A-25 | $HS(CH_2)_2O-\overset{\overset{O}{\Vert}}{\underset{\underset{OC_2H_5}{\vert}}{P}}-OH$ | 8,000 |

Then, by following the same procedure as Example 48 except that 7 g of each of the resins (A) prepared above and 33 g of resin (B-1) used in Example 60 were used as the binder resins, each of electrophotographic light-sensitive materials was prepared.

Each light-sensitive material showed excellent characteristics and when each light-sensitive material was used as an offset printing master plate after processing, more than 10,000 prints having clear images were obtained.

EXAMPLES 67 TO 76

Synthesis of Resin (A-26)

A mixture of 50 g of 2,6-dichlorophenyl methacrylate, 50 g of the compound (MM-1) obtained in Synthesis Example 1 of macromonomer, 2 g of thioglycolic acid, 150 g of toluene, and 50 g of ethanol was heated to 80° C. under nitrogen gas stream. Then, after adding 3 g of A.C.V. to the reaction mixture, the reaction was carried out for 4 hours and further adding thereto 1.0 g of A.C.V., the reaction was carried out for 4 hours to obtain the desired copolymer (A-26). The weight average molecular weight thereof was $8.5\times10^3$.

(A-26):

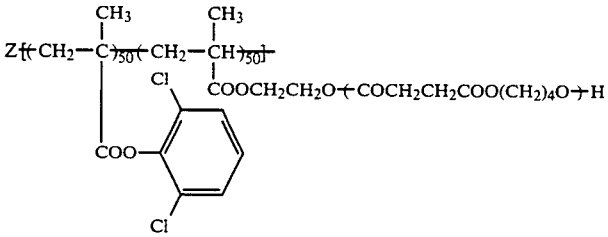

Z: $-\underset{\underset{CN}{\vert}}{\overset{\overset{CH_3}{\vert}}{C}}-CH_2CH_2COOH/-SCH_2COOH$ (1/2) weight ratio

Preparation of Light-Sensitive Materials

A mixture of 7 g (as solid content) of the aforesaid resin (A-26), 33 g of each of the resins (C) shown in Table 17 below, 0.02 g of heptamethinecyanine dye (II) shown before, 0.15 g of phthalic anhydride, and 300 g of toluene was dispersed in a ball mill for 2 hours to obtain a coating composition for photoconductive layer. Then, by following the same procedure as in Example 48 using the coating composition, each of electrophotographic light-sensitive materials was prepared.

TABLE 17

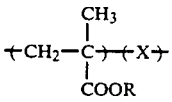

| Resin (C) | R | —X— | | Weight Average Molecular Weight ($\times10^4$) |
|---|---|---|---|---|
| C-1 | $-C_2H_5$ | 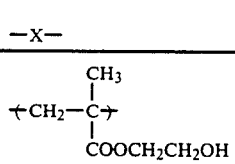 | 4 | 12 |
| 96 | | | | |

TABLE 17-continued

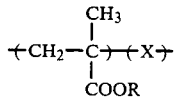

| Resin (C) | R | —X— | | Weight Average Molecular Weight ($\times 10^4$) |
|---|---|---|---|---|
| C-2 | $-C_2H_5$ 95 | 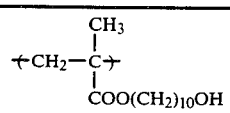 | 5 | 9.5 |
| C-3 | $-C_4H_9$ 98 | 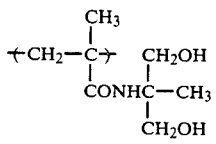 | 2 | 10 |
| C-4 | $-C_4H_9$ 97 | 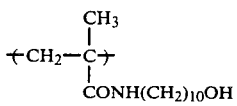 | 3 | 11.5 |
| C-5 | $-C_4H_9$ 96 | 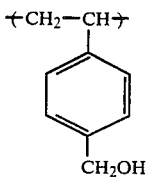 | 4 | 20 |
| C-6 | $-C_2H_5$ 95 | 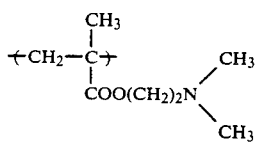 | 5 | 8.8 |
| C-7 | $-C_3H_7$ 95 | 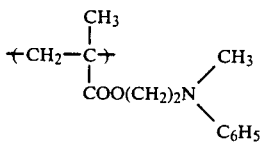 | 5 | 9.5 |
| C-8 | $-C_4H_9$ 96 | 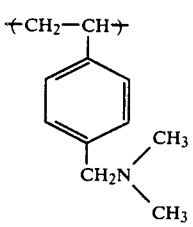 | 4 | 10.5 |
| C-9 | $-C_2H_5$ 97 | 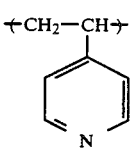 | 3 | 10.5 |
| C-10 | $-C_4H_9$ 95 | 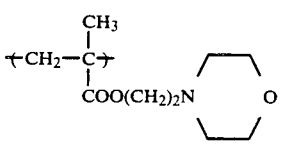 | 5 | 13 |

On each of the light-sensitive materials thus prepared, the electrostatic characteristics were measured using the paper analyzer as in Example 48. In this case, however, a gallium-aluminum-arsenic semiconductor laser light (oscillation wavelength 830 nm) was used as the light source. The results obtained are shown in Table 18.

TABLE 18

| Example No. | Resin (C) | $V_{10}$ (−V) | D.R.R. | $E_{1/10}$ (erg/cm$^2$) | Imaging Property (30° C. 80% RH) | Printing Durability (No. of Prints) |
|---|---|---|---|---|---|---|
| 67 | C-1 | 580 | 84 | 25 | good | 8,000 |
| 68 | C-2 | 595 | 87 | 24 | " | 8,000 |
| 69 | C-3 | 560 | 83 | 26 | " | 8,000 |
| 70 | C-4 | 565 | 84 | 27 | " | 9,000 |
| 71 | C-5 | 550 | 82 | 29 | " | 8,000 |
| 72 | C-6 | 545 | 80 | 31 | " | 8,000 |
| 73 | C-7 | 550 | 80 | 33 | " | 8,000 |
| 74 | C-8 | 545 | 79 | 34 | " | 8,000 |
| 75 | C-9 | 550 | 80 | 32 | " | 8,000 |
| 76 | C-10 | 545 | 81 | 31 | " | 8,000 |

EXAMPLES 77 TO 88

A mixture of 8 g of the resin (A-27) having the structure shown below, 32 g of each of resins (D) shown in Table 19 below, 0.018 g of the cyanine dye (I) shown before, 0.15 g of maleic anhydride, 200 g of zinc oxide, and 300 g of toluene was dispersed in a ball mill for 2 hours to provide a coating composition for photoconductive layer. Then, by following the same procedure as in Example 48, each of electrophotographic light-sensitive materials was prepared.

Resin (A-27):

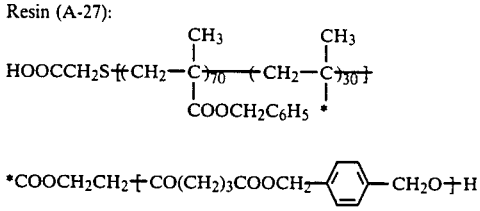

Weight average molecular weight: $8.6\times10^3$

TABLE 19

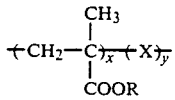

| Example No. | Resin (C) | R, | x | −X− | y | Weight Average Molecular Weight ($\times10^4$) |
|---|---|---|---|---|---|---|
| 77 | D-1 | $-C_2H_5$ | 99.5 |  | 0.5 | 1.8 |
| 78 | D-2 | $-C_2H_5$ | 99.5 | 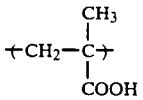 | 0.5 | 2.0 |
| 79 | D-3 | $-C_2H_5$ | 99.2 | 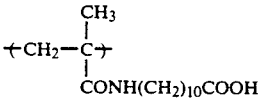 | 0.8 | 2.1 |
| 80 | D-4 | $-C_4H_9$ | 99.7 | 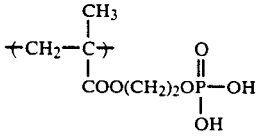 | 0.3 | 2.5 |
| 81 | D-5 | $-C_4H_9$ | 99.7 | 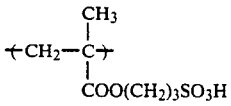 | 0.3 | 1.5 |
| 82 | D-6 | $-C_2H_5$ | 99.5 | 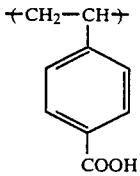 | 0.5 | 1.1 |

TABLE 19-continued

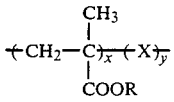

| Example No. | Resin (C) | R, | x | —X— | y | Weight Average Molecular Weight ($\times 10^4$) |
|---|---|---|---|---|---|---|
| 83 | D-7 | $-CH_2C_6H_5$ | 99.4 | 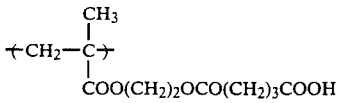 | 0.6 | 2.1 |
| 84 | D-8 | $-C_3H_7$ | 99.4 | 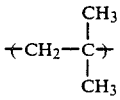 | 0.6 | 2.2 |
| 85 | D-9 | $-C_4H_9$ | 99.5 | 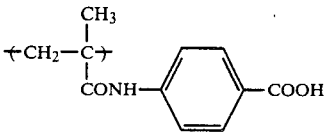 | 0.5 | 2.0 |
| 86 | D-10 | $-C_3H_7$ | 99.7 | 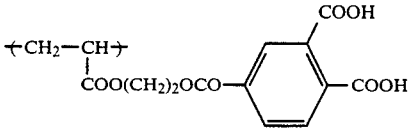 | 0.3 | 2.1 |
| 87 | D-11 | $-C_2H_5$ | 99.7 | 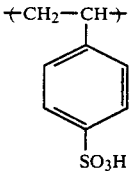 | 0.3 | 1.6 |
| 88 | D-12 | $-C_2H_5$ | 99.4 | 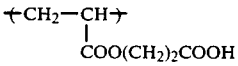 | 0.6 | 2.2 |

As shown in the above table, each of the light-sensitive materials of this invention was excellent in the charging property, dark charge retentivity, and light sensitivity and formed clear images without having background stains and fine line cutting even under severe conditions of high temperature and high humidity (30° C., 80% RH) at practical imaging.

Furthermore, when after making printing plates by processing as in Example 48, each plate was used as offset printing plate for printing, 10,000 prints having clear images having no background stains were obtained.

EXAMPLES 89 TO 94 AND COMPARISON EXAMPLE E

A mixture of 8 g of resin (A-28) having the structure shown below, 32 g of each of resins (B) to (D) shown in Table 20 below, 200 g of zinc oxide, 0.02 g of uranine, 0.04 g of Rose Bengal, 0.03 g of bromophenol blue, 0.20 g of phthalic anhydride, and 300 g of toluene was dispersed in a ball mill for 2 hours to prepare a coating composition for a photoconductive layer. The composition was coated on a paper which had been subjected to an electroconductive treatment by a wire bar in a dry coating amount of 20 g/m$^2$ and dried at 110° C. for 1 minute. The coated material was then allowed to stand in the dark for 24 hours under conditions of 20° C., 65 RH to prepare each of the electrophotographic light-sensitive materials.

Resin (A-29):

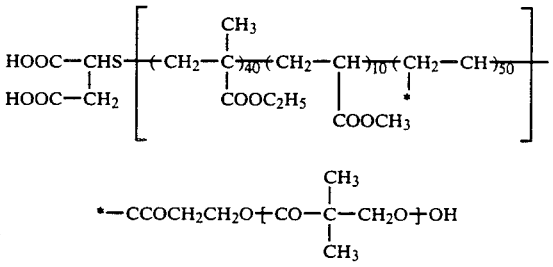

Weight average molecular weight: $8.1 \times 10^3$.

TABLE 20

Resins (B) to (D) (Weight Average Molecular Weight: $1.5 \times 10^5$ to $2.5 \times 10^5$)

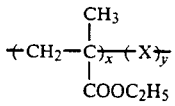

| Example No. | x/y (weight ratio) | —X— | Electrophotographic*8) characteristics (30° C., 80%) $V_{10}$ (—V) | D.R.R. (%) | $E_{1/10}$ (lux · sec) | Printing Durability (No. of Prints) |
|---|---|---|---|---|---|---|
| 89 | 100/0 | — | 550 | 91 | 5.5 | 8,000 |
| 90 | 96/4 | 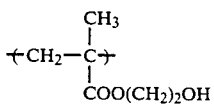 | 545 | 90 | 5.0 | " |
| 91 | 95/5 | 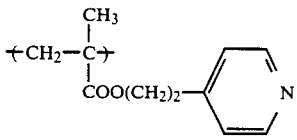 | 545 | 90 | 5.9 | " |
| 92 | 99.6/0.4 | 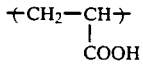 | 565 | 93 | 4.6 | more than 10,000 |
| 93 | 99.7/0.3 | 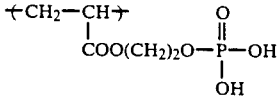 | 575 | 94 | 4.3 | more than 10,000 |
| 94 | 99.7/0.3 | 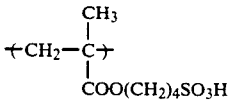 | 550 | 93 | 4.7 | more than 10,000 |
| Comparison Example C | | 40 g of Resin (PA2-2) only of Comparison Example BA2 used | 545 | 83 | 15.0 | Background stain occurred from the 1st print. |

The evaluation of electrostatic characteristics *8) in Table 20 was the same as *8) in Table 12 of Examples 42 to 47 described above.

In addition, each offset printing master plate was prepared by the following condition.

After allowing to stand each of the electrophotographic light-sensitive materials a whole day and night under condition (I) at 20° C., 65% RH or condition (II) at 30° C., 80% RH, a printing plate was made from each sample by a full automatic plate making machine ELP-404V (trade name, manufactured by Fuji Photo Film Co., Ltd.) using ELP-T (trade name, made by Fuji Photo Film Co., Ltd.) as toner and the qualities (fog, image quality) of reproduced images were visually evaluated.

For the light-sensitive materials in the examples of this invention and the light-sensitive material in Comparison Example E were used three kinds of the aforesaid dyes sensitizing in the visible light region as the spectral sensitizing dyes.

In the case of using these dyes, the light- 0 sensitive material in Comparison Example E using a conventional random copolymer as the binder resin showed satisfactory electrophotographic characteristics, but, when the sample was used as an offset master plate for printing, the oil-desensitizing treatment in the non-image portions was insufficient and background staining occurred from the 1st print.

On the other hand, in the case of the light-sensitive materials in the examples of this invention, such a phenomenon was not observed and more than 8,000 prints having clear images and no background fog were

EXAMPLE 95

A mixture of 38 g (as solid content) of resin (A-33) obtained in Synthesis Example 33 of Resin (A), g of zinc oxide, 0.02 g of a heptamethinecyanine dye having the structure shown below, 0.05 g of phthalic anhydride, and 300 g of toluene was dispersed in a ball mill for 2 hours and, after adding thereto 2 g of 3-xylylene diisocyanate, the resulting mixture was further dispersed in a ball mill for 10 minutes to provide a coating composition for an electrophotoconductive layer.

The coating composition thus prepared was coated on a paper which had been subjected to an electroconductive treatment in a dry coating amount of 22 g/m$^2$ by a wire bar, dried for 15 seconds at 100° C., and heated for 2 hours at 120° C. Then, the coated material was allowed to stand for 24 hours in the dark under conditions of 20° C., 65% RH to obtain an electrophotographic light-sensitive material.

Cyanine Dye (III):

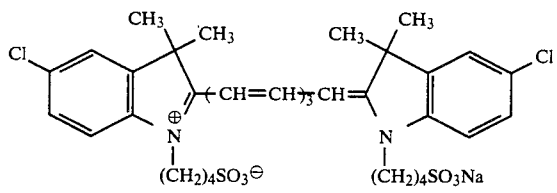

EXAMPLE 96

A mixture of 40 g (a solid content) of the resin (A-33), 200 g of zinc oxide, 0.02 g of the cyan dye shown in Example 95, 0.05 g of phthalic anhydride, and g of toluene was dispersed in a ball mill for 2 hours to obtain a coating composition for an electroconductive layer.

The composition was coated in a paper which had been subjected to an electroconductive treatment by a wire bar in a dry coating amount of 22 g/m$^2$ and dried for 15 seconds at 100° C. The coated material was then allowed to stand in the dark for 4 hours under conditions of 20° C., 65% RH to provide an electrophotographic light-sensitive material.

COMPARISON EXAMPLE F

By following the same procedure as Example 95 except that 38 g of resin (R-1) (weight average molecular weight: $7.5\times10^3$) having the structure shown below was used in place of 39 g of the resin (A-33), an electrophotographic material was prepared.

Resin (R-1):

-continued

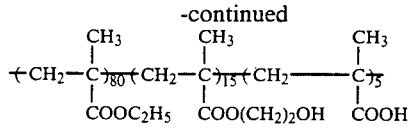

COMPARISON EXAMPLE G

By following the same procedure as Example 96 except that 40 g of a copolymer (R-2) having the following structure was used in place of 40 g of the copolymer (A-33), an electrophotographic light-sensitive material was prepared.

Resin (R-2):

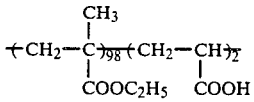

Weight average molecular weight: 34,000.

On these light-sensitive materials, the coating property (surface smoothness), electrostatic characteristics, imaging property under atmospheric condition, and imaging property under severe environmental conditions of 30° C., 80% RH were determined.

Furthermore, each of the light-sensitive materials was used as an offset printing master plate, and the oil-desensitizing property of the photoconductive layer (shown by the contact angle between a water drop and the photoconductive layer after being oil-desensitized) and the printing properties (background staining, printing durability, etc.) were determined.

The results obtained are shown in Table 21 below.

TABLE 21

| | Example 95 | Example 96 | Comparison Example F | Comparison Example G |
|---|---|---|---|---|
| Smoothness of Photo-*1 conductive Layer (sec/cc) | 90 | 96 | 85 | 60 |
| Strength of Photo-*2 conductive Layer (%) | 95 | 60 | 60 | 85 |
| Electrophotographic*3 Characteristics | | | | |
| $V_{10}$ (−V) | | | | |
| I: (20° C., 65%) | 580 | 610 | 500 | 400 |
| II: (30° C., 80%) | 550 | 595 | 470 | 80 |
| DRR (%) | | | | |
| I: (20° C., 65%) | 85 | 89 | 60 | 41 |
| II: (30° C., 80%) | 83 | 88 | 56 | 18 |
| $E_{1/10}$ (erg/cm$^2$) | | | | |
| I: (20° C., 65%) | 32 | 27 | 60 | 150 |
| II: (30° C., 80%) | 34 | 30 | 82 | |
| Image Forming*4 Performance | | | | |
| I: (20° C., 65%) | good | good | Dm slightly low | Dm low, densities of fine line cut letter low |
| II: (30° C., 80%) | good | good | Dm slightly low | Dm low, densities of fine line cut letter low |
| Contact angle*5 with Water (°C.) | 13 | 11 | 12 | 25–30 |
| Printing Durability*6 | 7,000 prints | 3,000 prints | 3,000 prints | background stain occurred from the 1st print |

In Table 21, the evaluation terms *1) to *6) shown in the above table were the same as those described in Example 1 above on the evaluation terms in Table 6.

As shown in Table 21, the light-sensitive materials of this invention were excellent in the smoothness, film strength, and electrostatic characteristics of the photoconductive layer and gave clear images having no background stains at practical imaging. This is assumed to be based on that the binder resin is sufficiently adsorbed on the photoconductive particles and sufficiently coats the surface of the particles. For the same reason, when the light-sensitive material was used as an offset master plate, the surface of the photoconductive layer was sufficiently oil-desensitized by the oil-desensitizing solution and the contact angle between the non-image portion of the photoconductive layer thus oil-desensitized and a water drop was as small as below 20 degrees, which showed that the surface was sufficiently rendered hydrophilic by the treatment. When 7,000 prints were printed using the offset master plate of Example 95 under the printing condition wherein the 3,000th print was deteriorated in the case of using the master plate in Example 96, no background stains were observed.

The light-sensitive material in Example 96 wherein only resin (A) of this invention was used without using the crosslinking agent was very excellent in electrostatic characteristics, but, when the light-sensitive material was used as an offset master plate for printing after processing, the image quality of the 3,000th print was reduced.

Also, in the light-sensitive material in Comparison Example F wherein the resin having a carboxy group directly bonded to the straight chain thereof and having no grafted portion, D.R.R. for 90 seconds was reduced and also $E_{1/10}$ increased.

Furthermore, in the light-sensitive material in Comparison Example G wherein a copolymer having a chemical structure having a carboxy group directly bonded to the straight chain thereof as the resin in Comparison Example F and having a larger weight average molecular weight was used, the electrostatic characteristics were greatly reduced. This is assumed that by the use of the binder resin having the increased molecule weight, the aggregation of photoconductive particles occurs when the resin adsorbs onto the particles, which gives bad influences on the electrostatic characteristics.

Thus, it is clear that in only the case of using the resins in this invention, electrophotographic light-sensitive materials having a satisfactory electrostatic characteristics and printing aptitude are obtained.

EXAMPLE 97

A mixture of 8 g of the aforesaid resin (A-34), 32 g of a resin (E-1) shown below, 200 g of zinc oxide, 0.02 g of the cyanine dye (III) used in Example 95, 0.01 g of phthalic anhydride, and 300 g of toluene was dispersed in a ball mill for 2 hours to prepare a coating composition for an electrophotoconductive layer.

The composition was coated on a paper which had been subjected to an electroconductive treatment by a wire bar in a dry coating amount of 22 g/m$^2$, dried for 15 seconds at 100° C. and for one hour at 120° C. Then, the coated product was allowed to stand for 24 hours under the conditions of 20° C., 65% RH to obtain an electrophotographic light-sensitive material.

Resin (E-I):

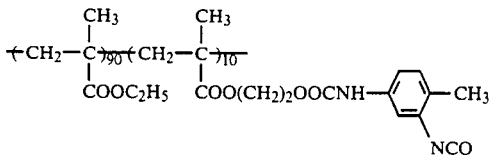

Weight average molecular weight: $6.5\times10^4$

When the characteristics were measured on the light-sensitive material as in Example 95, the following results were obtained.

| | | | |
|---|---|---|---|
| Smoothness of Photoconductive Layer: | | | 88 (cc/sec.) |
| Strength of Photoconductive Layer: | | | 88% |
| Electrophotographic characteristics: | | | |
| | $V_{10}$ (V) | D.R.R. (%) | $E_{1/10}$ (erg/cm$^3$) |
| I (20° C., 65% RH): | −585 | 89 | 40 |
| II (30° C., 80% RH): | −570 | 80 | 43 |
| Imaging Property: | Good images were obtained under both conditions (20° C., 65% RH) and (30° C., 80% RH). | | |
| Printing Durability: | 6000 prints having good printed images were obtained. | | |

As shown above, the light-sensitive material of this invention had excellent electrophotographic characteristics and high printing durability.

EXAMPLES 98 TO 105

A mixture of 6.5 g of each of resins (A) shown in Table 22 below, 33.5 g of each of resins (B), shown in Table 22, 200 g of zinc oxide, 0.018 g of a cyanine dye (IV) shown below, 0.15 g of maleic anhydride, and g of toluene was dispersed in a ball mill for 2 hours.

Then, after adding a predetermined amount of each of the crosslinking agents shown in Table 22 to the dispersion, the mixture was further dispersed in a ball mill for 10 minutes to prepare a coating composition for an electroconductive layer. The composition was coated on a paper which had been subjected to an electroconductive treatment by a wire bar in a coating amount of 22 g/m$^2$ and dried for 15 second at 100° C. and then for 2 hours at 120° C. Then, the coated product was allowed to stand for 24 hours under conditions of 20° C., 65% RH to obtain an electrophotographic light-sensitive material.

Cyanine Dye (IV):

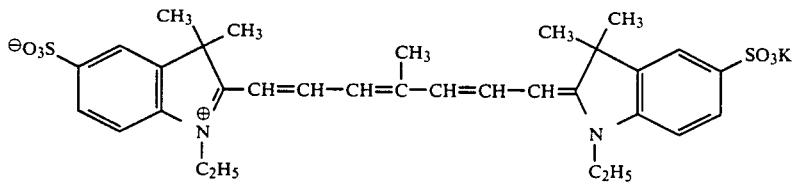

TABLE 22

| Example | Resin (A) | Resin (E) | | Crosslinking Agent | |
|---|---|---|---|---|---|
| 98 | A-12 | 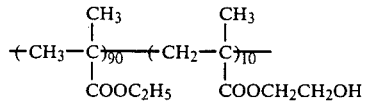 (E-2) | $\overline{M}w$ 38,000 | 1,3-xylylenedi-isocyanate | 1.5 g |
| 99 | A-13 | 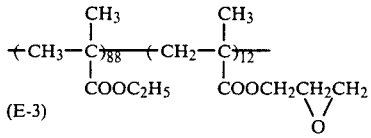 (E-3) | $\overline{M}w$ 40,000 | 1,6-hexamethylene-diamine | 1.5 g |
| 100 | A-15 | 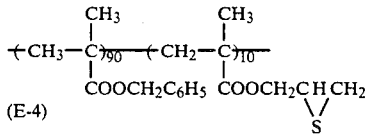 (E-4) | $\overline{M}w$ 41,000 | Terephthalate | 1.5 g |
| 101 | A-21 | 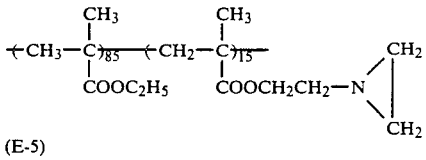 (E-5) | $\overline{M}w$ 38,000 | 1,4-tetramethylene-diamine | 1.5 g |
| 102 | A-25 | 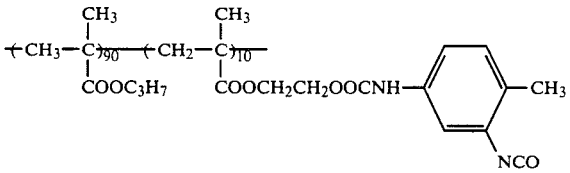 (E-6) | $\overline{M}w$ 37,000 | polyethylene glycol | 1.2 g |
| 103 | A-28 | " | | polypropylene glycol | 1.2 g |
| 104 | A-32 | 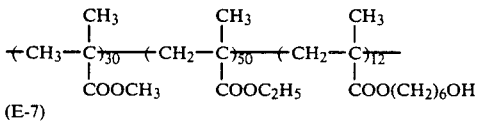 (E-7) | $\overline{M}w$ 42,000 | 1,6-hexamethylene-diisocyanate | 2 g |
| 105 | A-35 | 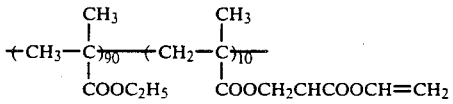 (E-8) | $\overline{M}w$ 55,000 | ethyleneglycol-dimethacrylate | 2.5 g |

On each of the light-sensitive materials, the electrostatic characteristics were measured using the paper analyzer as in Example 95.

Each of the light-sensitive materials was excellent in the charging property, dark decay retentivity, and light-sensitivity and gave clear images without having background fogs and fine line cutting under the severe conditions of high temperature and high humidity (30° C., 80% RH) at practical imaging.

When each light-sensitive material was used as an offset master, the photoconductive layer thereof was sufficiently oil-desensitized by an oil-desensitizing solution and the contact angle between the non-imaged portion of the desensitized layer and water was as low as 15 degrees or less, which showed that the photoconductive layer was sufficiently rendered hydrophilic. At practical printing, from 6,000 to 7,000 prints having clear images without having background fogs were obtained.

EXAMPLES 106 TO 111

A mixture of 7 g of each of resins (A) shown in Table 23, 20 g of each of resins (E) in Group X shown in Table 23, 200 g of zinc oxide, 0.50 g of Rose Bengal, 0.25 g of bromophenol blue, 0.30 g of uranine, 0.15 g of phthalic anhydride, and 240 g of toluene was dispersed in a ball mill for 2 hours.

Then, a solution of 13 g of each of resins (E) in Group Y shown in Table 23 dissolved in 80 g of toluene was added to the dispersion and the mixture was further dispersed in a ball mill for 10 minutes to provide a coating composition for a photoconductive layer. The composition was coated on a paper which had been subjected to an electroconductive treatment by a wire bar in a coating amount of 18 g/m$^2$ and dried for 30 seconds at 110° C. and then for 2 hours at 120° C. Then, the coated product was allowed to stand for 24 hours under the conditions of 20° C., 65 RH to obtain an electrophotographic light-sensitive material.

EXAMPLES 112 AND 113

TABLE 23

| Example | Resin (A) | Resin (E) Group X | | Resin (E) Group Y | |
|---|---|---|---|---|---|
| 106 | A-26 | 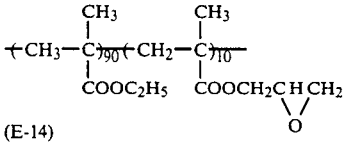 (E-14) | $\overline{M}w$ 42,000 | 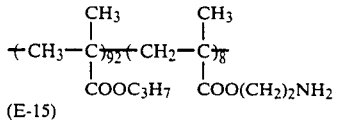 (E-15) | $\overline{M}w$ 38,000 |
| 107 | A-26 | 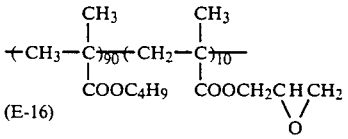 (E-16) | $\overline{M}w$ 45,000 | (E-15) | |
| 108 | A-26 | 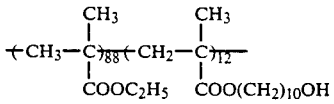 (E-17) | $\overline{M}w$ 38,000 | 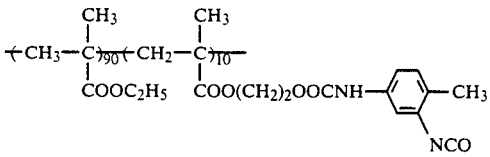 (E-18) | $\overline{M}w$ 46,000 |
| 109 | A-30 | (E-14) | $\overline{M}w$ 38,000 | 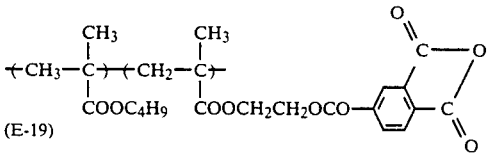 (E-19) | $\overline{M}w$ 33,000 |
| 110 | A-30 | (E-17) | | (E-19) | |
| 111 | A-30 | (E-19) | | (E-15) | |

Each of the light-sensitive materials of this invention was excellent in the charging property, dark charge retentivity, and light-sensitivity and gave clear images without having background fogs under the severe conditions of high temperature and high humidity (30° C., 80% RH) at practical imaging.

Furthermore, when each light-sensitive material was used for printing as an offset master plate after being processed, from 6,000 to 7,000 prints having clear images were obtained.

In this case, in the case of making the printing plate from the light-sensitive material, toner images were formed by an automatic plate making machine ELP404V (trade name, manufactured by Fuji Photo Film Co., Ltd.) using ELP-T (trade name, made by Fuji Film Co., Ltd.) as a toner.

A mixture of 8 g of resin (A-35) or (A-36) shown in Table 24 below, 32 g of each of resins (E) shown in Table 24, 200 g of zinc oxide, 0.02 g of uranine, 0.04 g of Rose Bengal, 0.03 g of bromophenol blue, 0.20 g of phthalic anhydride, and 300 g of toluene was dispersed in a ball mill for 2 hours to prepare a coating composition for a photoconductive layer. The composition was coated on a paper which had been subjected to an electroconductive treatment by a wire bar in a dry coating amount of 20 g/m$^2$ and dried for one minute at 110° C. Then, after applying over all exposure to the surface of the photoconductive layer by a high pressure mercury lamp, the coated product was allowed for 24 hours in the dark under the conditions of 20° C., 65% RH to obtain an electrophotographic light-sensitive material.

The properties of each light-sensitive material thus prepared are shown in Table 25 below.

TABLE 24

| Example No. | Resin (A) | Resin (E) | |
|---|---|---|---|
| 112 | (A-35) | 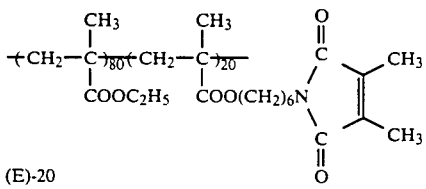 (E)-20 | $\overline{M}w$ $5.4 \times 10^4$ |

TABLE 24-continued

| Example No. | Resin (A) | Resin (E) | $\overline{M}w$ |
|---|---|---|---|
| 113 | (A-36) | $\text{-}(CH_2-C(CH_3)(COOC_3H_7))_{70}(CH_2-C(CH_3)(COOCH_2CH_2OCOCH_2CH{=}CH-C_6H_5))_{30}\text{-}$ (E)-21 | $6.0 \times 10^4$ |

TABLE 25

| | Example 112 | Example 113 |
|---|---|---|
| Smoothness (cc/sec) | 90 | 93 |
| Strength (%) | 88 | 85 |
| $V_{10}$ (−V) | 540 | 540 |
| D.R.R (%) | 82 | 82 |
| $E_{1/10}$ (lux. sec) | 10.2 | 9.8 |
| Printing Durability | 7,000 prints | 6,500 prints |

In addition, the electrostatic characteristics were evaluated as 8*) shown above in Examples 42 to 47.

As shown in the above table, each of the light-sensitive materials was excellent in the charging property, dark charge retentivity, and light-sensitivity and gave clear images having neither background stains nor fine line cutting under the severe conditions of high temperature and high humidity (30° C., 80% RH).

Furthermore, when each light-sensitive material was used for printing as an offset master plate after being processed, from 6,500 to 7,000 prints having clear images without having background stains at the non-imaged portions were obtained.

EXAMPLE 114

A mixture of 6 g (as solid content) of resin (A-8) prepared in Synthesis Example 8 of Resin (A), 34 g of resin (E-22) having the structure shown below, 200 g of zinc oxide, 0.02 g of a heptamethinecyanine dye (I) shown before, 0.20 g of phthalic anhydride, and 300 g of toluene was dispersed in a ball mill for 3 hours and after adding thereto 2 g of 1,3-xylylene diisocyanate, the mixture was further dispersed in a ball mill for 10 minutes.

The dispersion was coated on a paper which had been subjected to an electroconductive treatment by a wire bar in a coating amount of 20 g/m$^2$ and dried for 15 second at 100° C. and further for 2 hours at 120° C. Then, the coated product was allowed to stand for 24 hours in the dark under the conditions of 20° C., 65% RH to obtain an electrophotographic light-sensitive material.

Resin (E-22):

-continued $$\text{-}(CH_2-C(CH_3)(COOC_2H_5))_{88}(CH_2-C(CH_3)(COO(CH_2)_2OCO(CH_2)_5OH))_{12}\text{-}$$

Weight average molecular weight: $5.3 \times 10^4$

EXAMPLE 115

A mixture of 40 g (as solid content) of resin (A-8), 200 g of zinc oxide, 0.02 g of the aforesaid cyanine dye, 0.20 g of phthalic anhydride, and 300 g of toluene was dispersed in a ball mill for 2 hours.

The dispersion was coated on a paper which had been subjected to an electroconductive treatment by a wire bar in a dry coating amount of 20 g/m$^2$ and dried for 15 seconds at 100° C. Then, the coated product was allowed to stand for 4 hours in the dark under the conditions of 20° C., 65% RH to obtain an electrophotographic light-sensitive material.

COMPARISON EXAMPLE H

By following the same procedure as Comparison Example H except that 40 g of a copolymer (R-1) having the structure shown below was used in place of 40 g of the resin (A-8), an electrophotographic light-sensitive material was prepared.

Resin (R-1):

$$\text{-}(CH_2-C(CH_3)(COOC_2H_5))_{98}(CH_2-CH(COOH))_{2}\text{-}$$

Weight average molecular weight: 34,000

On each of the light-sensitive materials, the coating property (surface smoothness), film strength, electrostatic characteristics, imaging property at normal condition, and imaging property under the surrounding condition of 30° C., 80% RH were determined. Furthermore, when the light-sensitive materials were used as offset master plates after processing, the desensitizing property of each photoconductive layer (shown by the contact angle of the oil-desensitized photoconductive layer and water) and the printing property (background staining, printing durability, etc.) were determined.

The results obtained are shown in Table 26 below.

TABLE 26

| | Example 114 | Example 115 | Comparison Example H |
|---|---|---|---|
| Smoothness of Photo-*1 conductive Layer (sec/cc) | 110 | 115 | 89 |
| Strength of Photo-*2 conductive Layer (%) | 90 | 55 | 80 |
| Electrophotographic*3 Characteristics | | | |
| $V_{10}$ (−V) | | | |

TABLE 26-continued

| | Example 114 | Example 115 | Comparison Example H |
|---|---|---|---|
| I: (20°C., 65%) | 585 | 610 | 410 |
| II: (30° C., 80%) | 575 | 605 | 260 |
| DRR (%) | | | |
| I: (20°C., 65%) | 88 | 89 | 42 |
| II: (30° C., 80%) | 84 | 88 | 20 |
| $E_{1/10}$ (erg/cm$^2$) | | | |
| I: (20°C., 65%) | 23 | 18 | 145 |
| II: (30° C., 80%) | 22 | 19 | no light-sensitivity |
| Image Forming*4 Performance | | | |
| I: (20°C., 65%) | good | good | Dm low, Fine line, Letter cut |
| II: (30° C., 80%) | good | good | Image undiscrimiable |
| Contact Angle*5 with Water (°C.) | 10 or below | 10 or below | 25 to 30 Large deviation |
| Printing Durability*6 | 8,000 prints | 1,000 prints | Background stain from the 1st print |

In Table 26, the evaluations items were the same as those described in Example 1 as to Table 6.

As shown in Table 26, it can be seen that the photoconductive layer of the light-sensitive material in the examples of this invention was excellent in the smoothness and the electrostatic characteristics as well as the reproduced images had no background stains and had clear images. This is considered to be based on that, in the sample of this invention, the binder resin is suitably adsorbed on the photoconductive particles and suitably coats the surface of the particles. For the same reason as above, when the light-sensitive material of this invention was used as an offset master plate, the oil-desensitizing treatment by an oil-desensitizing solution could be sufficiently applied thereto to reduce the contact angle between the non-image portion and water to 10 degrees or below, which showed that the surface thereof was sufficiently rendered hydrophilic. When the offset master of Example 114 in this invention was used for printing under the printing conditions under which the 1000th print was deteriorated in the case of using a master plate in Example 115, 8,000 prints having no background stains were obtained.

Further, in the case of the light-sensitive material in Example 115 wherein the resin (A) only was used for the binder resin without using a crosslinking agent, the electrostatic characteristics were very good, but, when the light-sensitive material was used as an offset master plate for printing after processing, the image quality of the 1,000th print was reduced.

On the other hand, in the light-sensitive material in Comparison Example H wherein a conventionally known copolymer having a carboxy group directly bonded to the straight chain and having increased weight average molecular weight was used as the binder resin without using a crosslinking agent, the electrostatic characteristics were greatly reduced. This is assumed to be based on that by using the binder resin having the increased molecular weight, photoconductive particles are aggregated when the resin is adsorbed on the particles.

As shown above, in only the case of using the resins in this invention, an electrophotographic light-sensitive material having satisfactory electrostatic characteristics and printing aptitude is obtained.

EXAMPLE 116

A mixture of 8 g of resin (A-42) described above, 18 g of resin (E-23) shown below, 200 g of zinc oxide, 0.02 g of the cyanine dye (I) used in Example 48, 0.20 g of phthalic anhydride, and 300 g of toluene was dispersed in a ball mill for 3 hours. Then, after further adding thereto 14 g of resin (E-24) shown below, the mixture was further dispersed for 10 minutes.

The dispersion was coated on a paper subjected an electroconductive treatment by a wire bar at a coated amount of 20 g/m$^2$ and dried for 15 seconds at 100° C. and then for one hour at 120° C. Then, the coated product was allowed to stand for 24 hours under the conditions of 20° C., 65% RH to provide an electrophotographic light-sensitive material.

Resin (E-23):

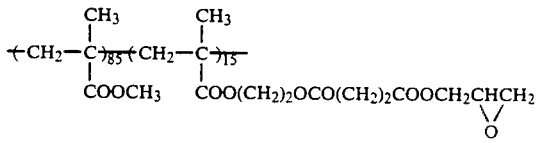

Weight average molecular weight: $3.5\times10^4$

Resin (E-24):

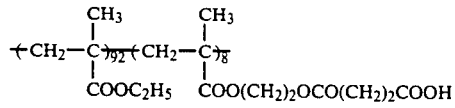

Weight average molecular weight: $3.3\times10^4$

The properties of the light-sensitive materials were measured as in Example 1, and the results obtained are shown below.

| | | | |
|---|---|---|---|
| Smoothness of Photoconductive Layer: | 120 (cc/sec.) | | |
| Strength of Photoconductive Layer: | 85% | | |
| Electrostatic characteristics: | $V_{10}$ (V) | D.R.R. (%) | $E_{1/10}$ (erg/cm$^3$) |
| I (20° C., 65% RH): | −580 | 86 | 23 |
| II (30° C., 80% RH): | −565 | 83 | 21 |
| Imaging Property: | Good reproduced images were formed under both the conditions | | |

-continued

| | |
|---|---|
| | (20° C., 65% RH) and (30° C., 80% RH). |
| Printing Durability: | 7,000 prints having good printed images were obtained. |

As described above, the light-sensitive material of this invention had excellent electrostatic characteristics and high printing durability.

EXAMPLES 117 TO 124

A mixture of 6.5 g of each of resins (A) shown in Table 27 below, 33.5 g of each of resins (E) shown in Table 27, 200 g of zinc oxide, 0.018 g of the cyanine dye (IV) shown below, 0.30 g of maleic anhydride, and 300 g of toluene was dispersed in a ball mill for 2 hours. After adding thereto a predetermined amount each of the crosslinking agents shown in Table 27, the mixture was dispersed in a ball mill for 10 minutes.

The dispersion was coated on a paper which had been subjected an electroconductive treatment by a wire bar in a dry coating amount of 22 g/m$^2$ and dried for 15 seconds at 100° C. and further for 2 hours at 120° C. Then, the coated product was allowed to stand for 24 hours under the conditions of 20° C., 65% RH to obtain an electrophotographic light-sensitive material.

Cyanine Dye (IV):

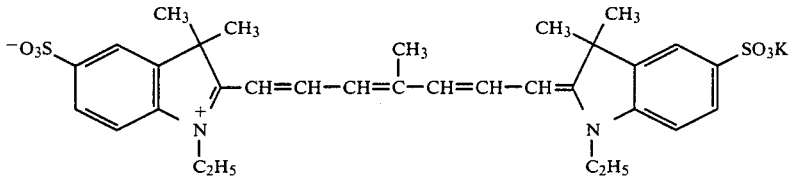

TABLE 27

| Example | Resin (A) | Resin (E) | | Crosslinking Agent | |
|---|---|---|---|---|---|
| 117 | A-12 | $\leftarrow CH_2-C(CH_3)(COOC_2H_5)\rangle_{90}\leftarrow CH_2-C(CH_3)(COOCH_2CH_2OH)\rangle_{10}$ (E-23) | $\overline{M}w$ 38,000 | 1,3-xylylenedi-isocyanate | 1.5 g |
| 118 | A-13 | $\leftarrow CH_2-C(CH_3)(COOC_2H_5)\rangle_{88}\leftarrow CH_2-C(CH_3)(COOCH_2CH(O)CH_2)\rangle_{12}$ (E-24) | $\overline{M}w$ 40,000 | 1,6-hexamethylene-diamine | 1.3 g |
| 119 | A-16 | $\leftarrow CH_2-C(CH_3)(COOCH_2C_6H_5)\rangle_{90}\leftarrow CH_2-C(CH_3)(COOCH_2CH(S)CH_2)\rangle_{10}$ (E-25) | $\overline{M}w$ 41,000 | Terephthalate | 1.5 g |
| 120 | A-18 | $\leftarrow CH_2-C(CH_3)(COOC_2H_5)\rangle_{85}\leftarrow CH_2-C(CH_3)(COOCH_2CH_2-N(CH_2)_2)\rangle_{15}$ (E-26) | $\overline{M}w$ 38,000 | 1,4-tetramethylene-diamine | 1.2 g |
| 121 | A-22 | $\leftarrow CH_2-C(CH_3)(COOC_3H_7)\rangle_{90}\leftarrow CH_2-C(CH_3)(COOCH_2CH_2OOCNH-C_6H_3(CH_3)(NCO))\rangle_{10}$ (E-27) | $\overline{M}w$ 37,000 | Ppolyethylene glycol | 1.2 g |
| 122 | A-26 | " | | Polypropylene glycol | 1.2 g |
| 123 | A-27 | $\leftarrow CH_2-C(CH_3)(COOCH_3)\rangle_{30}\leftarrow CH_2-C(CH_3)(COOC_2H_5)\rangle_{50}\leftarrow CH_2-C(CH_3)(COO(CH_2)_6OH)\rangle_{12}$ (E-28) | $\overline{M}w$ 42,000 | 1,6-hexamethylene-diisocyanate | 2 g |

TABLE 27-continued

| Example | Resin (A) | Resin (E) | | Crosslinking Agent | |
|---|---|---|---|---|---|
| 124 | A-7 | 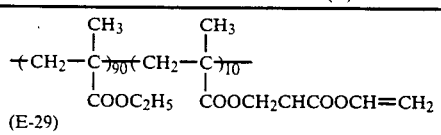 (E-29) | $\overline{M}w$ 55,000 | ethyleneglycol-dimethacrylate | 2 g |

On each of the light-sensitive materials, the electrostatic characteristics were measured using the paper analyzer as in Example 1.

Each of the light-sensitive materials of this invention was excellent in charging property, dark charge retentivity, and light-sensitivity and gave clear images having neither background fogs nor fine line cutting under the severe conditions of high temperature and high humidity (30° C., 80% RH) at practical imaging.

Also, when each light-sensitive material was used as an offset master plate after processing, the oil-desensitizing treatment with an oil-desensitizing solution was sufficiently applied to the photoconductive layer and the contact angle between the oil-desensitized layer and water was as low as 15 degrees or below, which showed that the layer was sufficiently rendered hydrophilic. At practical printing using the master plate, from 6,000 to 7,000 clear prints having no background fog were obtained.

EXAMPLES 125 TO 130

A mixture of 7 g of each of resins (A) shown in Table 28 below, 20 g of each of resins (E) in Group X shown in Table 28, 200 g of zinc oxide, 0.50 g of Rose Bengal, 0.25 g of bromophenol blue, 0.30 g of uranine, 0.20 g of tetrahydrophthalic anhydride, and 240 g of toluene was dispersed in a ball mill for 3 hours.

Then, after adding thereto a solution of 13 g of each of resins (E)in Group Y shown in Table 28 dissolved in 80 g of toluene, the mixture was further dispersed in a ball mill for 10 minutes.

The dispersion was coated on a paper which had been subjected to an electroconductive treatment by a wire bar in a dry coating amount of 18 g/m$^2$ and dried for 30 seconds at 110° C. and further for 2 hours at 120° C. Then, the coated product was allowed to stand for 24 hours under the conditions of 20° C., 65% RH to obtain an electrophotographic light-sensitive material.

TABLE 28

| Example | Resin (A) | Resin (E) Group X | | Resin (E) Group Y | |
|---|---|---|---|---|---|
| 125 | A-37 | 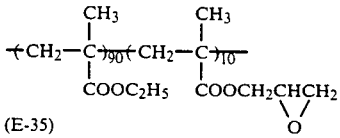 (E-35) | $\overline{M}w$ 42,000 | 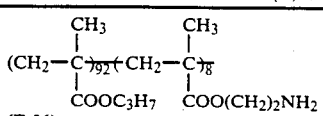 (E-36) | $\overline{M}w$ 38,000 |
| 126 | A-38 | 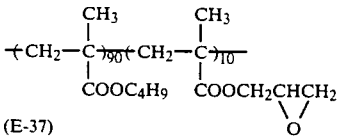 (E-37) | $\overline{M}w$ 45,000 | (E-36) | |
| 127 | A-41 | 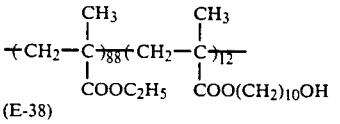 (E-38) | $\overline{M}w$ 38,000 | 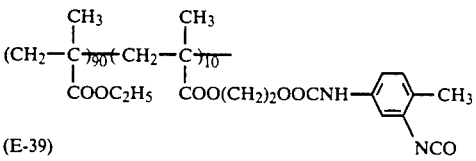 (E-39) | $\overline{M}w$ 46,000 |
| 128 | A-49 | (E-35) | | 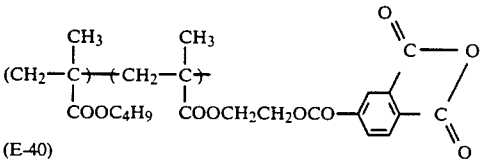 (E-40) | Mw 33,000 |
| 129 | A-51 | (E-39) | | (E-40) | |
| 130 | A-52 | (E-46) | | (E-36) | |

Each of the light-sensitive materials was excellent in charging property, dark charge retention, and light-sensitivity and gave clear images having no background stain even under severe conditions of high temperature and high humidity (30° C., 80% RH) at practical imaging.

Furthermore, when each was used as an offset master plate for printing, from 6,000 to 7,000 prints having clear images were obtained.

In addition, in the case of making the printing plate from each sample, toner images were formed by an automatic plate making machine ELP404V using ELP-T as toner.

EXAMPLES 131 AND 132

A mixture of 8 g of resin (A-24) or (A-26) shown in Table 29 below, 32 g of each of resins (E) shown in Table 29, 200 g of zinc oxide, 0.02 g of uranine, 0.04 g of Rose Bengal, 0.03 g of bromophenol blue, 0.30 g of phthalic anhydride, and 300 g of toluene was dispersed in a ball mill for 2 hours.

The dispersion was coated on a paper which had been subjected to an electroconductive treatment by a wire bar in a dry coating amount of 20 g/m$^2$ and dried for one minute at 110° C.

Then, after applying an overall exposure to the sample by a high pressure mercurylamp and the coated product was allowed to stand for 24 hours under the conditions of 20° C., 65% RH to provide each electrophotographic light-sensitive material.

The properties of each light-sensitive material thus prepared are shown in Table 30 below.

TABLE 29

| Example No. | Resin (A) | Resin (E) | |
|---|---|---|---|
| 131 | (A-24) | 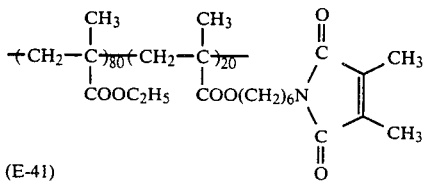 (E-41) | $\overline{M}w$ $5.4 \times 10^4$ |
| 132 | (A-26) | 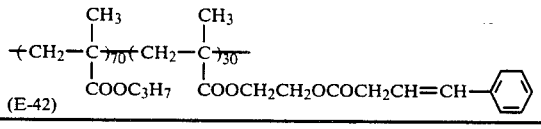 (E-42) | $\overline{M}w$ $6.0 \times 10^4$ |

TABLE 30

| | Example 131 | Example 132 |
|---|---|---|
| Smoothness (cc/sec) | 90 | 93 |
| Strength (%) | 88 | 85 |
| $V_{10}$ (−V) | 540 | 540 |
| D.R.R (%) | 82 | 82 |
| $E_{1/10}$ (lux. sec) | 10.2 | 9.8 |
| Printing Durability | 7,000 prints | 6,500 prints |

In Table 30, the electrostatic characteristics shown above were measured in the same manners as described above in Examples 42 to 47.

The values of the electrostatic characteristics were those under the conditions of 30° C., 80% RH.

Each of the light-sensitive materials was excellent in charging property, dark charge retentivity, and light-sensitivity, and gave clear images having neither background fog nor fine line cutting under severe conditions of high temperature and high humidity (30° C., 80% RH).

Furthermore, when each sample was used for printing as an offset master plate after processing, from 6,500 to 7,000 prints having clear images without having background fog at the non-image portions were obtained.

While the invention has been described in detail and with reference to specific embodiments thereof, it will be apparent to one skilled in the art that various changes and modifications can be made therein without departing from the spirit and scope thereof.

What is claimed is:

1. An electrophotographic light-sensitive material comprising an electroconductive support having formed thereon a photographic layer containing at least inorganic photoconductive particles and a binder resin, wherein the binder resin containing a copolymer having at least one of polyester type macromonomers having a weight average molecular weight of from $1\times10^3$ to $1.5\times10^4$ represented by following formulae (I), (II), (III), and (IV) as a copolymer component;

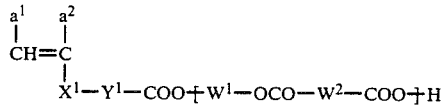

(I)

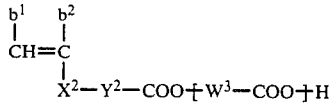

(II)

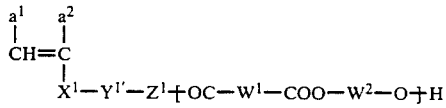

(III)

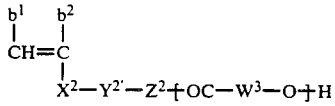

(IV)

wherein the group in the brackets represents a recurring unit; $a^1$ and $a^2$, which may be the same or different, each represents a hydrogen atom, a halogen atom, a cyano group, a hydrocarbon group having from 1 to 8 carbon atoms, —COO—Z, or —COO—Z bonded through a hydrocarbon group having from 1 to 8 carbon atoms (wherein Z represents a hydrocarbon group having from 1 to 18 carbon atoms); $X^1$ represents a direct bond, —COO—, —OCO—, —$(CH_2)_{l^1}$—COO—, —$(CH_2)_{l^2}$—OCO— (wherein $l^1$ and $l^2$ each represents an integer of from 1 to 3),

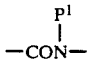

(wherein $P^1$ represents a hydrogen atom or a hydrocarbon group having from 1 to 12 carbon atoms), —CONHCONH—, —CONHCOO—, —O—,

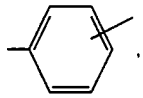

or —$SO_2$—; $Y^1$ represents group bonding $X^1$ to —COO—; $W^1$ and $W^2$, which may be the same or different, each represent a divalent aliphatic group, a divalent aromatic group (which may have at least one bonding group selected from —O—, —S—,

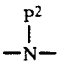

(wherein $P^2$ represents a hydrogen atom or a hydrocarbon group having from 1 to 12 carbon atoms), —$SO_2$—, —COO—, —OCO—, —CONHCO—, —NHCONH—,

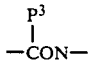

(wherein $P^3$ has the same significance as $P^2$),

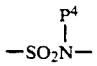

(wherein $P^4$ has the same significance as $P^2$), and

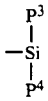

in the bond of each divalent organic residue) or an organic residue composed of a combination of these residues; $Y^{1'}$ represent a group bonding $X^1$ to $Z^1$; $Y^{2'}$ represents a group bonding $X^2$ to $Z^2$; $Z^1$ represents —$CH_2$—, —O—, or —NH—; $b^1$ and $b^2$ have the same meaning as $z^1$ and $a^2$; and $X^2$ and $Z^2$ have the same meaning as $X^1$ and $Z^1$, respectively; and $W^3$ represents a divalent aliphatic group.

2. The electrophotographic light-sensitive material as in claim 1, wherein the copolymer has at least one acid group selected from —$PO_3H_2$, —$SO_3H$, and —COOH at the terminal of the main chain of the copolymer.

3. The electrophotographic light-sensitive material as in claim 1 or 2, wherein the copolymer has a weight average molecular weight of from $1\times10^3$ to $2\times10^4$ and the binder resin further contains resin (B) shown below;

Resin (B): A resin having a weight average molecular weight of from $5\times10^4$ to $5\times10^5$ and not having —$PO_3H_2$, —$SO_3H$, —$CO_2H$, and a basic group.

4. The electrophotographic light-sensitive material as in claim 1 or 2, wherein the copolymer has a weight average molecular weight of from $1\times10^3$ to $2\times10^4$ and the binder resin further contains resin (C) shown below;

Resin (C): A resin having a weight average molecular weight of from $5\times10^4$ to $5\times10^5$ and containing a copolymer component having at least one functional group selected from -OH and a basic group at from 0.1 to 15% by weight.

5. The electrophotographic light-sensitive material as in claim 1 or 2, wherein the copolymer has a weight average molecular weight of from $1\times10^3$ to $2\times10^4$ and the binder resin further contains resin (D) shown below;

Resin (D): A resin having a weight average molecular weight of from $5\times10^4$ to $5\times10^5$ and contains a containing a copolymer component having an acid group at a content of less than 50% of the content of the acid group contained in the copolymer or containing a copolymer having at least one acid group selected from —$PO_3H_2$, —$SO_3H$, —COOH, and

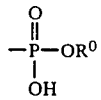

(wherein $R^o$ represents a hydrocarbon group), said acid group having larger pKa than the pKa of the acid group contained in the copolymer.

6. The electrophotographic light-sensitive material as in claim 1, wherein the binder resin further contains a heat- and/or photo-curable resin having a crosslinking functional group.

7. The electrophotographic light-sensitive material as in claim 1, wherein the binder resin contains a crosslinking agent.

8. The electrophotographic light-sensitive material as in claim 1, wherein the content of said polyester type macromonomer in said copolymer is from about 1 to about 70 parts by weight per 100 parts by weight of the copolymer.

9. The electrophotographic light-sensitive material as in claim 1, wherein said copolymer further contains a copolymer component corresponding to the monomer represented by the general formula (V):

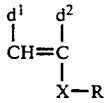

(V)

wherein $d^1$ and $d^2$, which may be the same or different, each has the same meaning as $a^1$ and $a^2$;

X represents —COO—, —OCO— or —O—; and

R represents a hydrocarbon group having from 1 to 18 carbon atoms.

* * * * *